US005988150A

United States Patent [19]

Osanai

[11] Patent Number: 5,988,150

[45] Date of Patent: Nov. 23, 1999

[54] EVAPORATED FUEL TREATMENT DEVICE OF ENGINE

[75] Inventor: Akinori Osanai, Susono, Japan

[73] Assignee: Toyota Jidosha Kabushiki Kaisha, Aichi, Japan

[21] Appl. No.: 08/984,326

[22] Filed: Oct. 3, 1997

[30] Foreign Application Priority Data

| | | | |
|---|---|---|---|
| Dec. 5, 1996 | [JP] | Japan | 8-325426 |
| Feb. 7, 1997 | [JP] | Japan | 9-925389 |
| Feb. 14, 1997 | [JP] | Japan | 9-930386 |
| Nov. 10, 1997 | [JP] | Japan | 9-307614 |

[51] Int. Cl.[6] ..... F02M 33/04

[52] U.S. Cl. ..... 123/698; 123/520

[58] Field of Search ..... 123/698, 516–520

[56] References Cited

U.S. PATENT DOCUMENTS

| | | | |
|---|---|---|---|
| 5,611,320 | 3/1997 | Hara et al. | 123/698 |
| 5,634,454 | 6/1997 | Fujitsu | 123/698 |
| 5,655,507 | 8/1997 | Kawasaki | 123/698 |
| 5,694,911 | 12/1997 | Kawamoto et al. | 123/698 |
| 5,699,778 | 12/1997 | Muraguchi et al. | 123/698 |
| 5,727,537 | 3/1998 | Nakagawa et al. | 123/698 |

FOREIGN PATENT DOCUMENTS

| | | |
|---|---|---|
| 6-93898 | 4/1994 | Japan . |
| 6-93899 | 4/1994 | Japan . |
| 6-146965 | 5/1994 | Japan . |
| 6-200804 | 7/1994 | Japan . |
| 7-259615 | 10/1995 | Japan . |
| 7-269399 | 10/1995 | Japan . |
| 305646 | 11/1995 | Japan . |
| 8-144870 | 6/1996 | Japan . |

*Primary Examiner*—Erick R. Solis
*Attorney, Agent, or Firm*—Oliff & Berridge, PLC

[57] ABSTRACT

An evaporated fuel treatment device comprising a purge control valve arranged between a canister and an intake passage of an engine. A drive pulse of the purge control valve is controlled by a duty ratio. When the engine operating state is one in which a large amount of evaporated fuel is produced in the fuel tank, the feedback correction coefficient is maintained at a is position deviated from the reference value so as to enable the feedback correction coefficient to change in accordance with the fluctuations of the air-fuel ratio.

29 Claims, 55 Drawing Sheets

EVAPORATED FUEL TREATMENT DEVICE OF ENGINE

BACKGROUND OF THE INVENTION

1. Field of the Invention

The present invention relates to an evaporated fuel treatment device of an engine.

2. Description of the Related Art

Known in the art is an internal combustion engine provided with a canister for temporarily storing evaporated fuel and a purge control valve for controlling the amount of purge of the fuel vapor to be purged from the canister to the inside of an intake passage and using the purge control valve to control the amount of purge of the fuel vapor so that the purge rate of the fuel vapor becomes a predetermined target purge rate (see Japanese Unexamined Patent Publication (Kokai) No. 7-305646). In this internal combustion engine, the amount of fuel injection is corrected by a feedback correction coefficient and a purge air fuel ratio correction coefficient so as to suitably maintain the air-fuel ratio at the target air-fuel ratio.

That is, in a usual internal combustion engine, the basic fuel injection time required for making the air-fuel ratio the stoichiometric air-fuel ratio is found in advance by experiments and stored and the basic fuel injection time is corrected by a feedback control coefficient so that the air-fuel ratio becomes the stoichiometric air-fuel ratio based on an output signal of an air-fuel ratio sensor provided in the engine exhaust passage. In this case, the feedback control coefficient is normally set to repeatedly fluctuate about a reference value, for example, 1.0.

On the other hand, when the purge action of fuel vapor is started, the basic fuel injection time is corrected by the purge air-fuel ratio correction coefficient showing the vapor concentration in the intake air. The feedback control coefficient repeatedly fluctuates about 1.0 even during the purge action. That is, when the purge action is started, the air-fuel ratio becomes rich, so the feedback control coefficient falls to where the air-fuel ratio becomes the stoichiometric air-fuel ratio. The amount of drop of the feedback control coefficient at this time shows the vapor concentration In the intake air. Therefore, to find the vapor concentration there, the purge air-fuel ratio correction coefficient is gradually updated until the feedback control coefficient returns to 1.0. In this case, the final purge air-fuel ratio correction coefficient comes to show the vapor concentration and the fuel injection time is shortened by exactly the amount of the final purge A/F correction coefficient. When the final purge A/? correction coefficient is calculated, the feedback control coefficient once again fluctuates about 1.0.

Note that in actuality, the narrow range about 1.0 is set for the feedback control coefficient for calculating the vapor concentration. Only when the feedback control coefficient exceeds this set range is the purge A/F correction coefficient reduced or increased so that the feedback control coefficient returns to the set range. By correcting the amount of fuel injection by the feedback control coefficient and the vapor air-fuel ratio correction coefficient in this way, the air-fuel ratio is maintained at the stoichiometric air-fuel ratio even when a purge action is being performed.

On the other hand, if the feedback control coefficient deviates widely from 1.0 due to some reason or another, the air-fuel ratio will become excessively lean or excessively rich. Therefore, it is necessary to prevent the feedback control coefficient from deviating widely from 1.0 in this way. Therefore, usually, an allowable limit of fluctuation is set for the feedback control coefficient and the feedback control coefficient is made to only be able fluctuate within this allowable limit of fluctuation.

Since, however, the fuel vapor is sucked into the intake passage by the difference in the pressure in the canister and the pressure inside the intake passage, if the degree of opening of the purge control valve is made constant, the larger the vacuum in the intake passage, the greater the purge rate will become. Therefore, in this case, to maintain the purge rate constant, the greater the vacuum in the intake passage, the smaller the degree of opening of the purge control valve must be made. Accordingly, in the past, to maintain the purge rate at the target purge rate, the degree of opening of the purge control valve has been controlled in is accordance with the operating state of the engine.

The fuel vapor absorbed in the activated charcoal in the canister, however, is sucked into the intake passage by the difference between the pressure in the canister and the pressure in the intake passage, so if the degree of opening of the purge control valve were controlled in accordance with the operating state of the engine in the above way when the fuel vapor absorbed in the activated charcoal of the canister was being purged, it would be possible to maintain the purge rate at the target purge rate and therefore prevent the air-fuel ratio from fluctuating.

A little after the engine starts operating, however, the rise of the temperature of the fuel in the fuel tank and vibration cause a large amount of evaporated fuel to be generated in the fuel tank. The evaporated fuel generated in the fuel tank is made to flow through a purge passage directly into the intake passage. In this case, however, since the fuel vapor is pushed out from the fuel tank into the intake passage, the amount of the fuel vapor supplied from the fuel tank to the intake passage is not dependent on the magnitude of the vacuum generated in the intake passage, but is dependent on the amount of the evaporated fuel generated in the fuel tank. Therefore, if the amount of the fuel vapor which is directly supplied from the fuel tank to the inside of the intake passage increases, even if the purge control valve is used to control the purge rate to a target purge rate, the concentration of fuel vapor in the intake air will greatly change in accordance with a change in the amount of purge.

That is, when the purge rate is controlled to become the target purge rate, if the amount of intake air falls, the amount of purge will be reduced, while if the amount of intake air increases, the amount of purge will be increased. In this case, if the amount of purge is increased, the amount of purge of the fuel vapor from the canister will be increased in exact proportion and the amount of purge of the fuel vapor from the fuel tank will be maintained constant. Therefore, if the amount of purge is increased, the concentration of fuel vapor in the intake air will become lower. If the amount of fuel vapor directly supplied from the fuel tank to the inside of the intake passage is increased in this way, when the amount of purge increases, the concentration of fuel vapor in the intake air will become lower, while when the amount of purge decreases, the concentration of fuel vapor in the intake air will become higher.

Note that even when the concentration of fuel vapor fluctuates widely in accordance with the changes in the amount of purge in this way, if the feedback control coefficient is changed to track these changes of the concentration of fuel vapor, the air-fuel ratio will not fluctuate that much. That is, for example, if the amount of intake air falls and the amount of purge falls like at the time of a deceleration operation, the concentration of fuel vapor will widely increase and therefore the feedback control coefficient will become smaller to maintain the air-fuel ratio at the stoichiometric air-fuel ratio. At this time, if the feedback control coefficient can be kept smaller until the air-fuel ratio reaches the stoichiometric air-fuel ratio, there will be almost no fluctuation in the air-fuel ratio.

In the past, however, as explained above, when the feedback control coefficient exceeded a set range, the feedback control coefficient was returned to a set range about 1.0. That is, for example, even when the amount of purge was small and therefore the concentration of fuel vapor was high, the feedback control coefficient was returned to within the set range around 1.0. Therefore, when an acceleration operation was performed from this state and the amount of purge increased, the concentration of fuel vapor widely fell, so the feedback control coefficient was increased from near 1.0 to maintain the air-fuel ratio at the stoichiometric air-fuel ratio. At this time, however, since the amount of fluctuation of the concentration of fuel vapor is large, the feedback control coefficient reaches the allowable limit of fluctuation and can no longer increase any further. That is, the feedback control coefficient is made not to be able to increase up to where the air-fuel ratio becomes the stoichiometric air-fuel ratio. As a result, the air-fuel ratio becomes considerably lean and therefore a good acceleration operation cannot be obtained. Not only this, but there is also the problem that the exhaust emission deteriorates.

A similar situation occurs even when the amount of purge is reduced as at the time of deceleration operation. That is, even when the amount of purge is large and the concentration of the fuel vapor is low, the feedback control coefficient is returned to within the set range near 1.0. Therefore, if a deceleration operation is performed from this state and the amount of purge is reduced, the concentration of the fuel vapor is greatly increased, so the feedback control coefficient ends up falling from near 1.0 to maintain the air-fuel ratio at the stoichiometric air-fuel ratio. At this time, however, the amount of fluctuation of the concentration of the fuel vapor is large, so the feedback control coefficient reaches the allowable limit of fluctuation and then can no longer fall further. That is, the feedback control coefficient cannot become small enough so that the air-fuel ratio is made the stoichiometric air-fuel ratio. As a result, the air-fuel ratio becomes considerably rich and therefore the problem arises that the exhaust emission deteriorates.

On the other hand, the air-fuel ratio does not only fluctuate when a large amount of evaporated fuel is produced in the fuel tank as explained above. The air-fuel ratio also fluctuates widely due to changes in the state of driving of the vehicle.

That is, in an internal combustion engine designed so as to control the purge rate of the fuel vapor to become a predetermined target purge rate, for example, as disclosed in Japanese Unexamined Patent Publication (Kokai) No. 6-146965, when the air-fuel ratio deviates from the target air-fuel ratio, the calculated value of the concentration of the fuel vapor is updated by exactly a predetermined set amount without regard to the purge rate and the amount of fuel injection is corrected bared on the updated concentration of the fuel vapor so that the air-fuel ratio becomes the target air-fuel ratio.

When the air-fuel ratio deviates from the target air-fuel ratio in this way, however, if the concentration of the fuel vapor is updated by exactly a predetermined set amount without regard to the purge rate in this way, in particular when the purge rate becomes larger from a small state, the problem arises that the air-fuel ratio ends up deviating from the target air-fuel ratio.

That is, the air-fuel ratio does not fluctuate due to just the effect of the purge action. It also fluctuates due to the change in the state of driving of the vehicle. Accordingly, if the deviation of the air-fuel ratio is considered to be due entirely to the effect of the purge action and the amount of deviation of the air-fuel ratio is reflected back into the update value of the concentration of fuel vapor, the concentration of fuel vapor which is calculated will end up deviating from the actual concentration of fuel vapor. If the concentration of fuel vapor which is calculated deviates from the actual concentration of the vapor in this way, there will be no problem when the purge rate does not change or the purge rate becomes smaller, but there will be a problem when the purge rate becomes larger than a small value.

That is, for example, assume that the air-fuel ratio deviates by 2 percent from the target air-fuel ratio due to the change in the state of driving of the vehicle, not the effect of the purge action, and that the purge rate is a small value, for example, 0.5 percent. At this time, if the deviation of the air-fuel ratio is considered to be all due to the effect of the purge action and the amount of deviation of the air-fuel ratio is reflected back into the update value of the concentration of the fuel vapor, the vapor concentration which is calculated will end up deviating by 4 percent per unit purge rate (2%/0.5%) with respect to the actual concentration of the vapor. In this case, if the purge rate is maintained at 0.5 percent, the calculated vapor concentration will continue to deviate by 2 percent from the actual vapor concentration.

If the purge rate increases, however, for example, if the purge rate rises from 0.5 percent to 5 percent, the amount of deviation of the calculated vapor concentration becomes 20 percent (4% amount of deviation per unit purges rate x purge rate 5%). If the amount of deviation of the vapor concentration calculated becomes 20 percent, the amount of fuel supplied corrected based on the calculated vapor concentration will deviate considerably from the amount of fuel supply necessary for maintaining the target air-fuel ratio and therefore the problem will arise of the air-fuel ratio deviating considerably from the target air-fuel ratio.

On the other hand, when the air-fuel ratio deviates by 2 percent from the target air-fuel ratio due to the effect of the state of driving of the vehicle and the purge rate is a large value, for example, 5 percent, the vapor concentration which is calculated will be only 0.4 percent per unit purge rate (2%/5%). Therefore, at this time, there is little error in the vapor concentration and no particular problem. Further, when the purge rate falls from this state, the amount of deviation of the concentration of vapor will gradually become smaller, so there will be no particular problem in this case as well. Accordingly, a problems occurs only when updating the concentration of the fuel vapor when the purge rate is low.

SUMMARY OF THE INVENTION

An object of the present invention is to provide an evaporated fuel treatment device capable of preventing an air-fuel ratio from fluctuating.

According to the present invention, there is provided an evaporated fuel treatment device for an engine provided with an intake passage, comprising: a purge control valve for controlling an amount of purge of fuel vapor to be purged into the intake passage so that the purge rate of the fuel vapor becomes a predetermined target purge rate; air-fuel ratio detecting means for detecting the air-fuel ratio; and correcting means for correcting an amount of fuel injection by a feedback control coefficient and a purged air-fuel ratio correction coefficient, the feedback correction coefficient increasing or decreasing with respect to a reference value based on an air-fuel ratio detected by the air-fuel ratio detecting means so that the air-fuel ratio becomes a target air-fuel ratio, the purged air-fuel ratio correction coefficient increasing or decreasing so that an average value of fluctuation of the feedback correction coefficient returns to a predetermined set range including the reference value when the average value of fluctuation of the feedback correction coefficient exceeds the set range, and the set range being changed based on either one of a change of concentration of fuel vapor in intake air and a purge rate of the vapor of the fuel.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
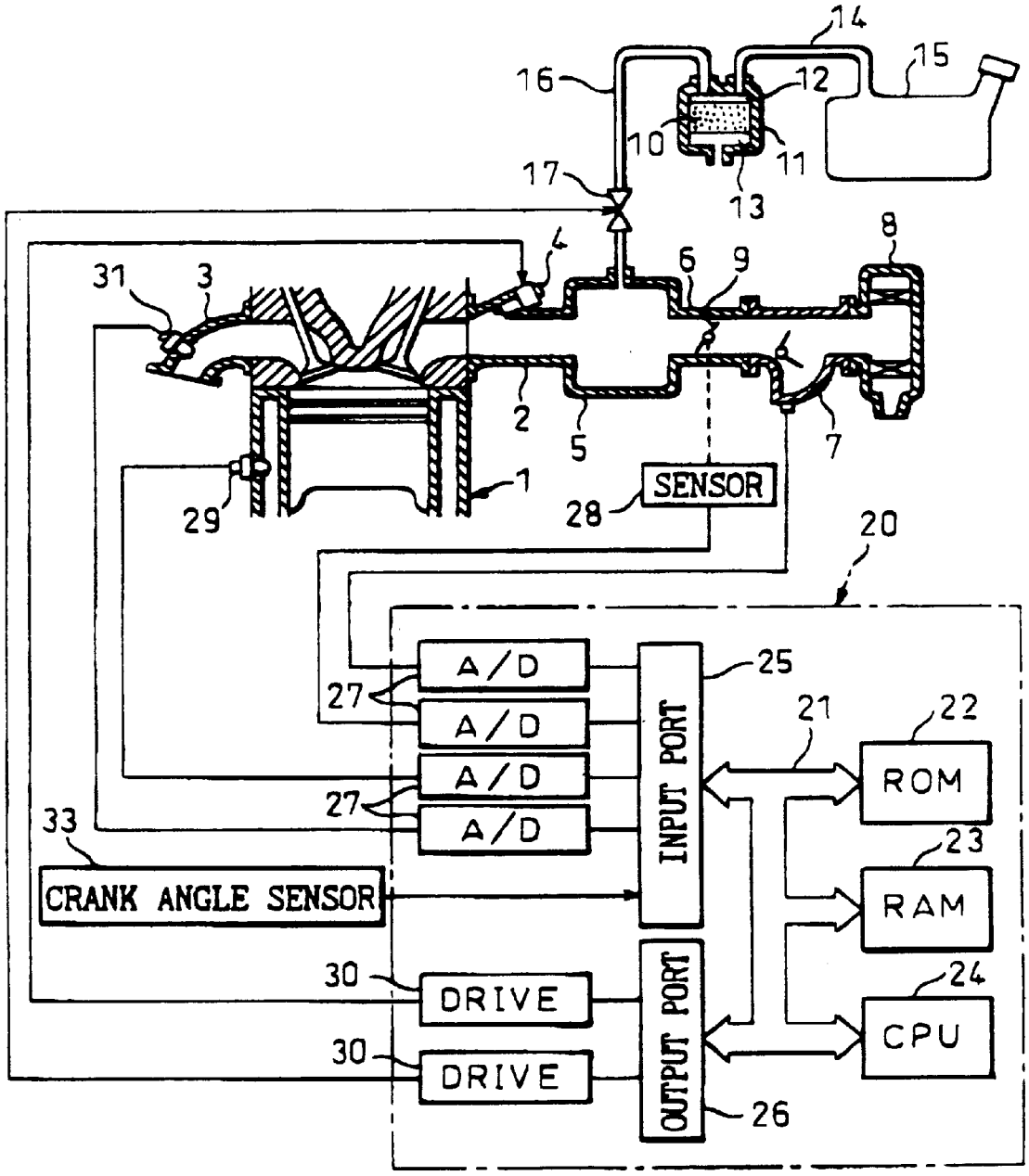
FIG. 1 is an overall view of an internal combustion engine.

Referring to FIG. 1, 1 is an engine body, 2 an intake tube, 3 an exhaust manifold, and 4 a fuel injector attached to each of the intake tubes 2. Each intake tube 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber is 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAN) 23, a microprocessor (CPU) 24, an input port 25, and an output port 26 connected to each other through a bidirectional bus 21. The air flow meter 7 generates an output voltage proportional to the amount of the intake air. This output voltage is input through the corresponding AD converter 27 to the input port 25. The throttle valve 9 has attached to it a throttle sensor 28 which detects the degree of opening of the throttle valve. The output signal of the throttle sensor 28 is input through the corresponding AD converter 27 to the input port 25, The engine body 1 has attached to it a water temperature sensor 29 for generating an output voltage proportional to the coolant water temperature of the engine. The output voltage of the water temperature sensor 29 is input through the corresponding AD converter 27 to the input part 25. The exhaust manifold 3 has an air-fuel ratio sensor 31 attached to it. The output signal of the air-fuel ratio sensor 31 is input through the corresponding AD converter 27 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 30 to the fuel injectors 4 and the purge control valve 17.

In the internal combustion engine shown in FIG. 1, the fuel injection time TAU is calculated based fundamentally on the following equation:

$$TAU=TP\cdot FW\cdot(FAF+KGj-FPG)$$

where, the coefficients show the following:

TP: basic fuel injection time

FW: correction coefficient

FAF: feedback correction coefficient

KGj: learning coefficient of air-fuel ratio

FPG: purge air-fuel ratio correction coefficient (hereinafter referred to as the purge A/F correction coefficient)

The basic fuel injection time TP is the experimentally found injection time required for making the air-fuel ratio the target air-fuel ratio. The basic fuel injection time TP is stored in advance in the ROM 22 as a function of the engine load Q/N (amount of intake air Q/engine speed N) and the engine speed N.

The correction coefficient Fw expresses the engine warmup increase coefficient and the acceleration increase coefficient all together. When no upward correction is needed, FW is made 0.

The feedback correction coefficient FAF is set to control the air-fuel ratio to the target air-fuel ratio based on the output signal of the air-fuel ratio sensor 31.

The purge A/F correction coefficient FPG is made 0 in the period from when the engine starts to operate to when the purge is started and becomes larger the higher the concentration of the fuel vapor when the purge action is started. Note that during engine operation, when the purge action is temporarily stopped, the FPG is made 0 in the period when the purge action is stopped.

As explained above, however, the feedback control coefficient FAF is for controlling the air-fuel ratio to the target air-fuel ratio based on the output signal of the air-fuel ratio sensor 31. As the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9V when the air-fuel ratio is rich and generates an output voltage of about 0.1V when the air-fuel ratio is lean.

Figure 2:
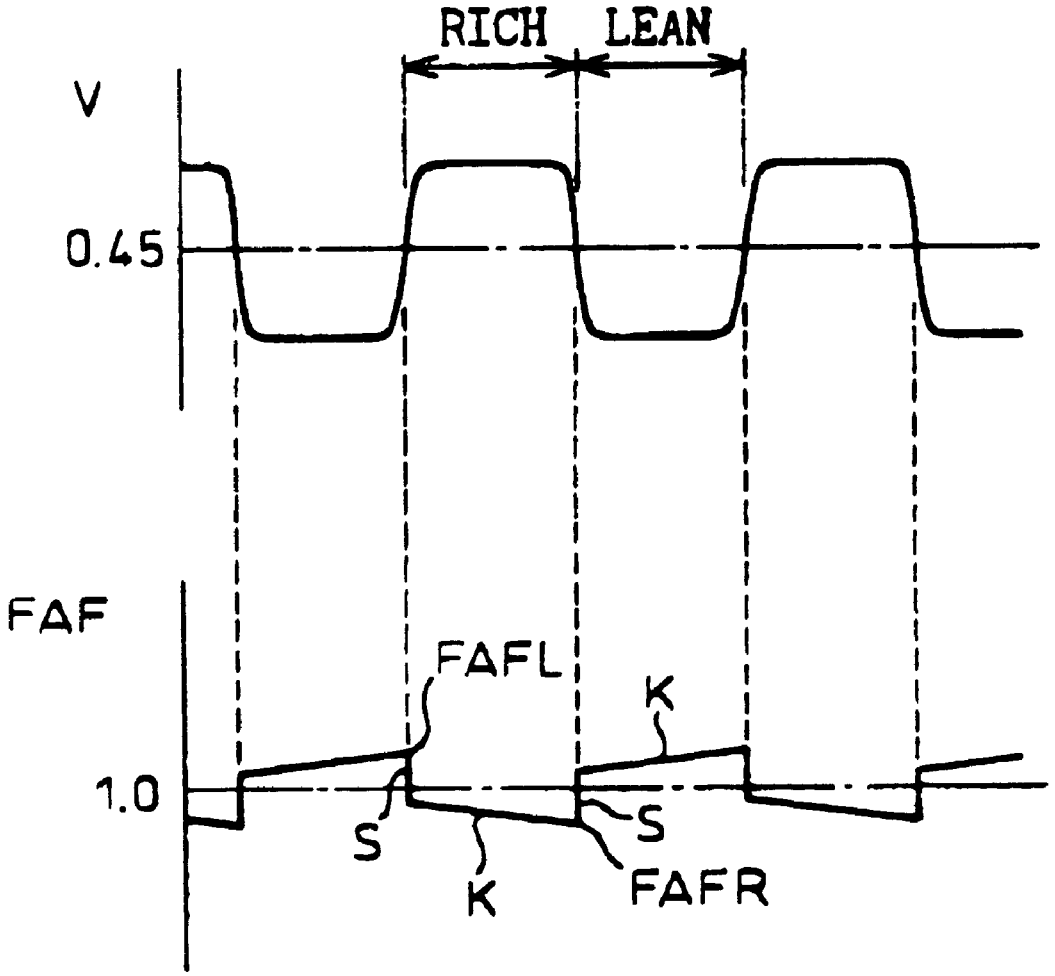
FIG. 2 is a view of the changes in the air-fuel ratio feedback correction coefficient FAF.

FIG. 2 shows the relationship between the output voltage V of the $O_2$ sensor 31 and the feedback control coefficient FAF when the air-fuel ratio is maintained at the target air-fuel ratio. As shown in FIG. 2, when the output voltage V of the $O_2$ sensor 31 becomes higher than for example 0.45V, that is, when the air-fuel ratio becomes rich, the feedback control coefficient FAF is rapidly reduced by the skip amount S, then is gradually reduced by the integration constant K. As opposed to this, when the output voltage V of the $O_2$ sensor 31 becomes lower than the reference voltage, that is, when the air-fuel ratio becomes lean, the feedback control coefficient FAF is rapidly reduced by the skip amount S is and then gradually reduced by the integration constant K.

That is, when the air-fuel ratio becomes rich, the feedback control coefficient FAF is reduced, so the amount of fuel injection is reduced, while when the air-fuel ratio becomes lean, the feedback control coefficient FAF is increased and the amount of fuel injection is increased. Therefore, the air-fuel ratio is maintained at the stoichiometric air-fuel ratio. As shown in FIG. 2, at this time, the feedback control coefficient FAF fluctuates about a reference value, that is, 1.0.

Further, in FIG. 2, FAFL shows the value of the feedback control coefficient FAF when the air-fuel ratio changes from lean to rich, while FAFR shows the value of the feedback control coefficient FAF when the air-fuel ratio changes from rich to lean. In the embodiment of the present invention, as the average of the fluctuation of the feedback control coefficient FAF (hereinafter referred to simple as the average value), the average value between FAFL and FAFR is used.

Next, an explanation will be given of the purge operation while referring to FIG. 3. Note that in FIG. 3, PGR shows the purge rate of the fuel vapor.

Figure 3:
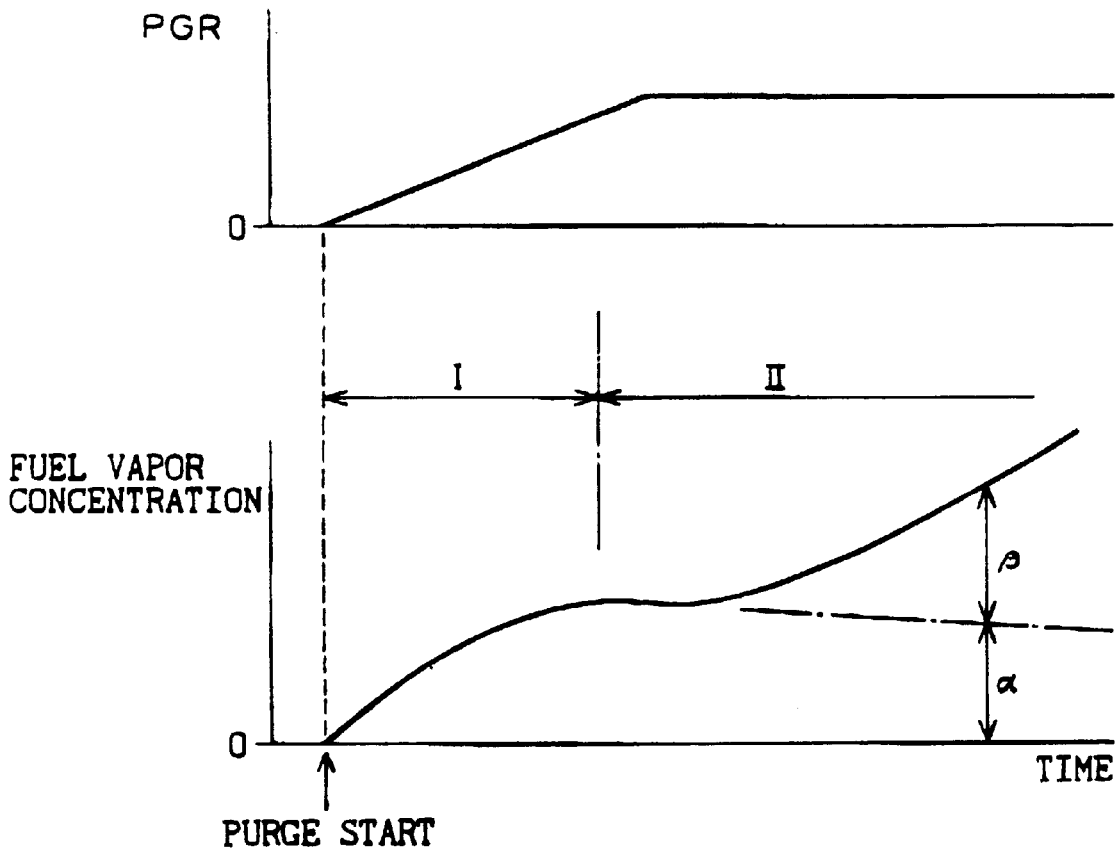
FIG. 3 is a view of changes in the purge vapor concentration.

As shown in FIG. 3, in the embodiment of the present invention, when the purge action is started for the first time after the start of engine operation, the purge rate PGR is gradually increased from zero. When the purge rate PGR reaches a certain value, for example, 6 percent, the purge rate PGR is maintained constant.

On the other hand, when the purge action is started, the evaporated fuel absorbed in the activated carbon 10 of the canister 11 is purged through the conduit 16 into the surge tank 5. Further, at this time, part of the evaporated fuel produced in the fuel tank 15 is directly purged through the conduit 16 into the surge tank 5. Right after the engine starts operating, however, normally not that much evaporated fuel is produced in the is fuel tank 15 and therefore at this time the majority of the fuel vapor purged is due to the evaporated fuel disassociated from the activated carbon 10.

When the purge is started and the purge rate PGR gradually increases, the amount of purge increases along with it, so the concentration of fuel vapor in the intake air gradually increases. Next, after a while, the concentration of fuel vapor starts to fall. That is, when the purge is started, the amount of the evaporated fuel absorbed in the activated carbon 10 gradually becomes smaller and therefore a little while after the purge is started, the concentration of fuel vapor starts to fall. The period from when the purge is started to when the concentration of fuel vapor starts to fall is shown by I in FIG. 3.

On the other hand, after the elapse of the period I, the concentration of fuel vapor gradually rises and therefore a large amount of evaporated fuel is produced in the fuel tank IS. When a large amount of evaporated fuel is generated in the fuel tank 15, the evaporated fuel in the fuel tank 15 is pushed out through the conduit 14 and the conduit 16 directly into the surge tank 5 and therefore the concentration of fuel vapor increases. In FIG. 3, a shows the concentration of fuel vapor due to the evaporated fuel disassociated from the activated carbon 10, while β shows the concentration of fuel vapor due to the evaporated fuel pushed out from the fuel tank 15.

As will be understood from these α and β, the concentration of fuel vapor due to the evaporated fuel disassociated from the activated carbon 10 gradually falls, while this concentration of fuel vapor due to the evaporated fuel pushed out from the fuel tank 15 gradually rises. The period during which the evaporated fuel is pushed out from the fuel tank 15 is shown by II in FIG. 3. Note that the ratio between the curves of change α and β of the concentration of fuel vapor shown in FIG. 3 is shown generally for purposes of explanation. In particular, β changes in various ways in according with the state of operation of the engine.

Next, an explanation will be made about the learning of the concentration of the fuel vapor with reference to FIG. 4. The learning of the concentration of the fuel vapor starts by accurately finding the vapor concentration per unit purge rate. THE vapor concentration per unit purge rate is shown by FGPG in FIG. 4. The purge A/F correction coefficient FPG is obtained by multiplying the purge rate PGR with the FGPG.

The concentration of vapor FGPG per unit purge rate is calculated based on the following equation with every skip (S in FIG. 2) of the feedback control coefficient FAF:

$$tFG=(1-FAFAV)/(PGR\cdot a)$$

$$FGPG=FGPG+tFG$$

Here, tFG shows the update value of FGPG performed with every skip of FAF, while FAFAV shows the average value of the feedback control coefficient (=(FAFL+FAFR)/2). In the embodiment of the present invention, a is set to 2.

That is, when the purge is started, the air-fuel ratio becomes rich, so the feedback control coefficient FAF for making the air-fuel ratio the stoichiometric air-fuel ratio becomes smaller. Next, at the time t1, when it is judged by the $O_2$ sensor 31 that the air-fuel ratio has changed from rich to lean, the feedback control coefficient FAF is increased. In this case, the amount of change ΔFAR (ΔFAF=(1.0−FAF)) of the feedback control coefficient FAF from when the purge is started to the time t1 shows the amount of change of the air-fuel ratio due to the purges action. This amount of change &FAF shows the concentration of fuel vapor at the time t1.

When the time t1 is reached, the air-fuel ratio is maintained at the stoichiometric air-fuel ratio. The air-fuel ratio is then kept from deviating from the stoichiometric air-fuel ratio by returning the average value FAFAV of the feedback control coefficient to 1.0 by gradually updating the vapor concentration FGPG per unit purge rate with every skip of the feedback control coefficient FAF. The update value tPG per time of the FGPG at this time is made half of the amount of deviation of the average value FAFAV of the feedback control coefficient with respect to 1.0, therefore the update value tFG becomes tFG=(1−FAFAV)/(PGR·2) as explained above.

Figure 4:
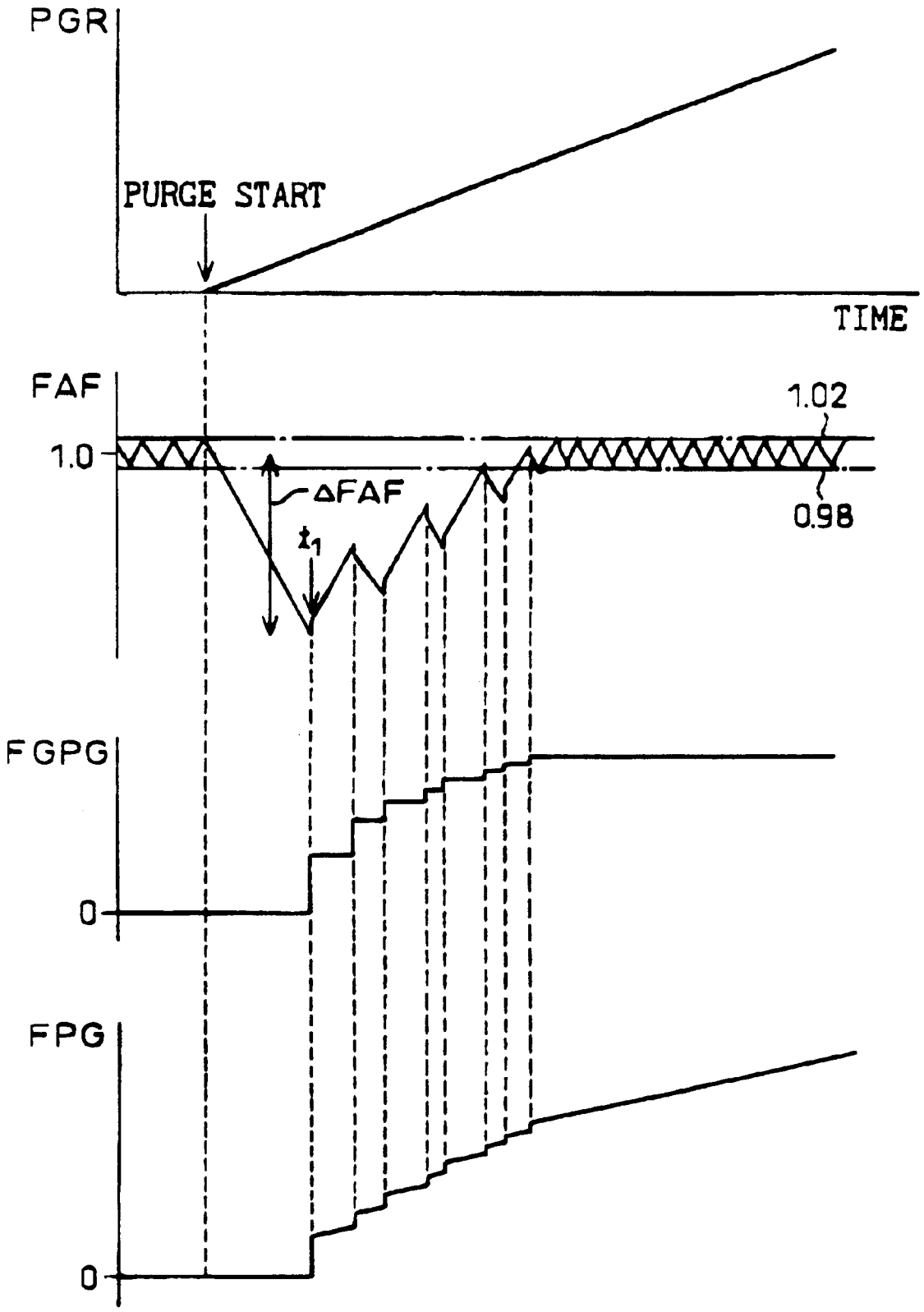
FIG. 4 is a view of changes in the feedback control coefficient FAF etc. at the time of start of a purge action.

When the update action of the FGPG is repeated several times as shown in FIG. 4, the average value FAFAV of the feedback control coefficient returns to 1.0 and then the vapor concentration FGPG per unit purge rate becomes constant. The FGPG becoming constant in this way means that the FGPG at this time accurately shows the vapor concentration per unit purge rate and therefore means that the learning of the vapor concentration has ended. Note that if the amount of the evaporated fuel absorbed in the activated carbon 10 becomes smaller, the vapor concentration FGPG per unit purge rate becomes smaller along with the same, so the FCPG is updated again at this time.

On the other hand, the actual concentration of fuel vapor becomes the value of the purge rate PGR multiplied with the vapor concentration FGPG per unit purge rate. Therefore, the purge A/F correction coefficient FPG (=FGPG·PGR) showing the actual concentration of fuel vapor is updated as shown in FIG. 4 every time FGPG is updated and increases as the purge rate PGR increases.

As explainesd above, if the feedback control coefficient FAF deviates from the reference value, that is, 1.0, the average value FAFAV of the feedback control coefficient is returned to 1.0. In relation to this point, in the embodiment of the present invention, a first set range with respect to the reference value is set for the feedback control coefficient FAF. When the average value FAFAV of the feedback control coefficient exceeds the first set range, FAFAV is returned to the first set range. In the embodiment of the present invention, as shown in FIG. 4, the upper limit of the first set range is made 1.02 and the lower limit 0.98.

In this way, in this embodiment of the present invention, to find the vapor concentration, when the average value FAFAV of the feedback control coefficient exceeds the first set range, the average value FAFAV of the feedback ccntrol coefficient is returned to within the first set range. If the feedback control coefficient FAF is controlled in this way, when a large amount of evaporated fuel. is produced in the fuel tank 15, that is, in the period II of FIG. 3, a problem occurs. This will be explained next with reference to FIGS. 5A and 5B and FIGS. 6A and 6B.

As explained above, the feedback control coefficient FAF fluctuates about 1.0. Sometimes however the feedback control coefficient FAF deviates widely from 10 due to some reason or another. If the feedback control coefficient Fed deviates widely from 1.0, the air-fuel ratio becomes excessively lean or rich, so it is necessary to prevent the feedback control coefficient FAF from deviating widely from 1.0. Therefore, usually, an allowable limit of fluctuation is set for the feedback control coefficient FAF. The upper limit of this allowable limit of fluctuation is usually 1.2 while the lower limit is 0.8.

On the other hand, when a large amount of evaporated fuel is produced in the fuel tank 15, the evaporated fuel in the fuel tank 15 is pushed out into the surge tank 5 directly. In this state, the amount of the evaporated fuel directly supplied from the fuel tank 15 to the surge tank 5 does not depend on the magnitude of the vacuum in the surge tank 5, but depends on the amount of the evaporated fuel produced in the fuel tank 15. In this case, even if the purge control valve 17 is used for control so that the purge rate becomes the target purge rate, as explained at the start, the concentration of the fuel vapor in the intake air will fluctuate widely in accordance with a change in the amount of purge. Next, this will be explained with reference to FIGS. 5A and 5B and FIGS. 6A and 6B.

Figure 5A:
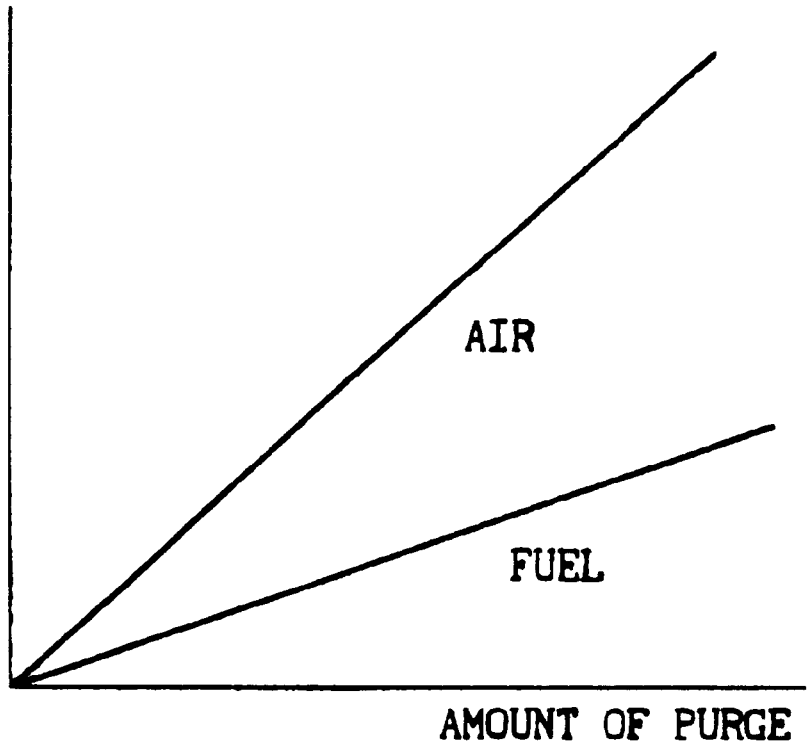
FIGS. 5A and 5B are views of the relationships between the amount of purge and the vapor concentration.
Figure 5B:
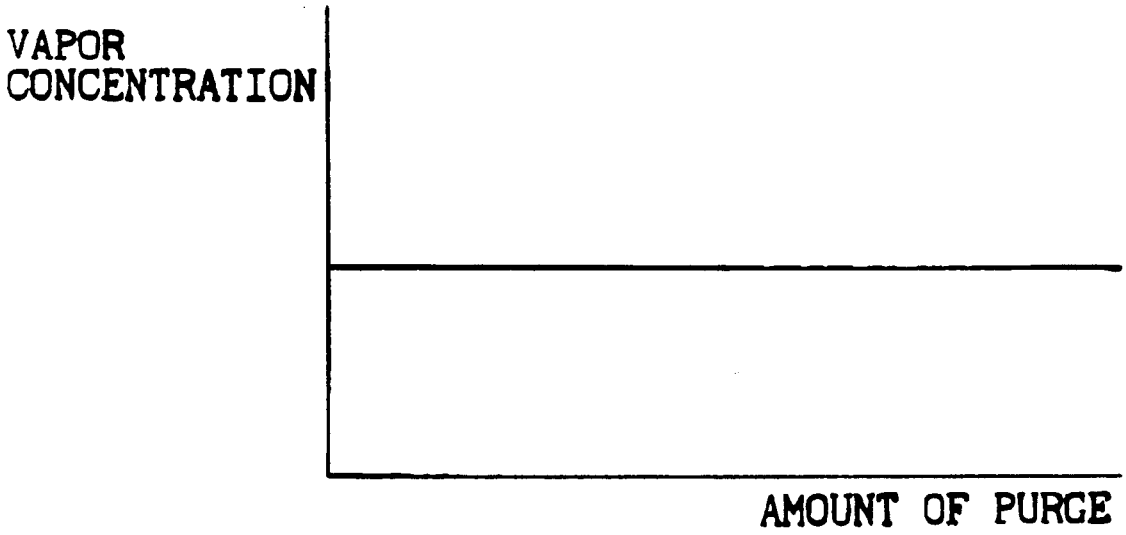

FIGS. 5A and 5B show cases where not that much evaporated fuel is produced in the fuel tank 5 in the case where the purge control valve 17 is used to control the purge rate to the target purge rate. Note that FIG. 5A shows the ratio between the air and fuel contained in the purge gas.

When not that much evaporated fuel is produced in the fuel tank 5, the fuel in the purge gas is the fuel disassociated from the activated carbon 10 in the canister 11. In this case, as shown in FIG. 5A, the amount of air and the amount of fuel included in the purge gas increase in proportion to the increase of the amount of purge. In this case, as shown in FIG. 5B, the vapor concentration in the intake air is maintained constant regardless of the amount of purge.

Figure 6A:
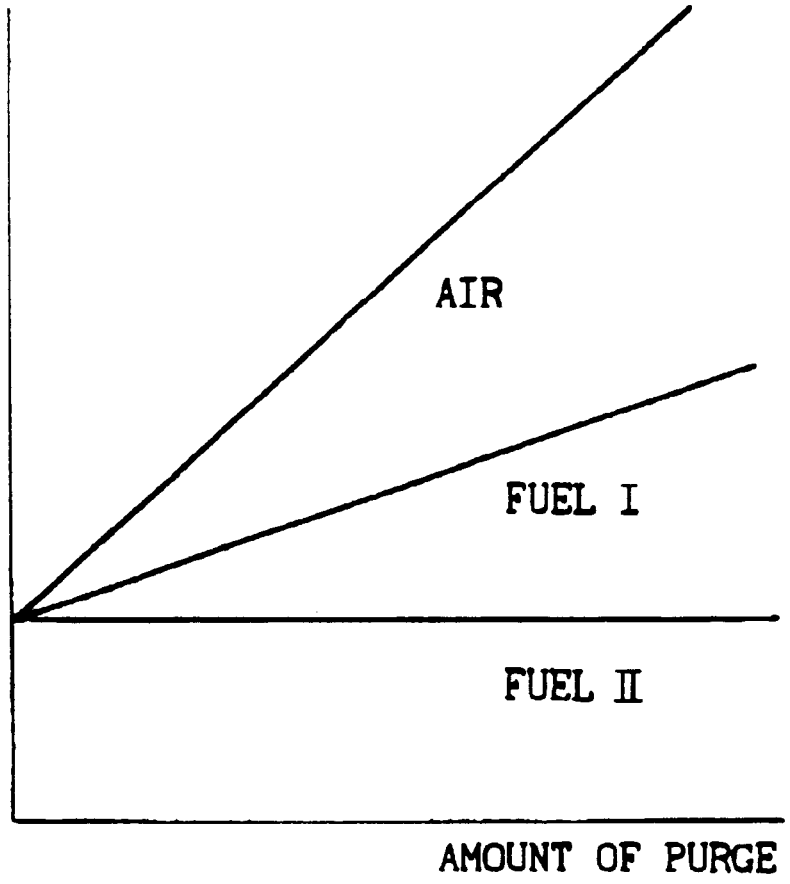
FIGS. 6A and 6B are views of the relationships between the amount of purge and the vapor concentration.
Figure 6B:
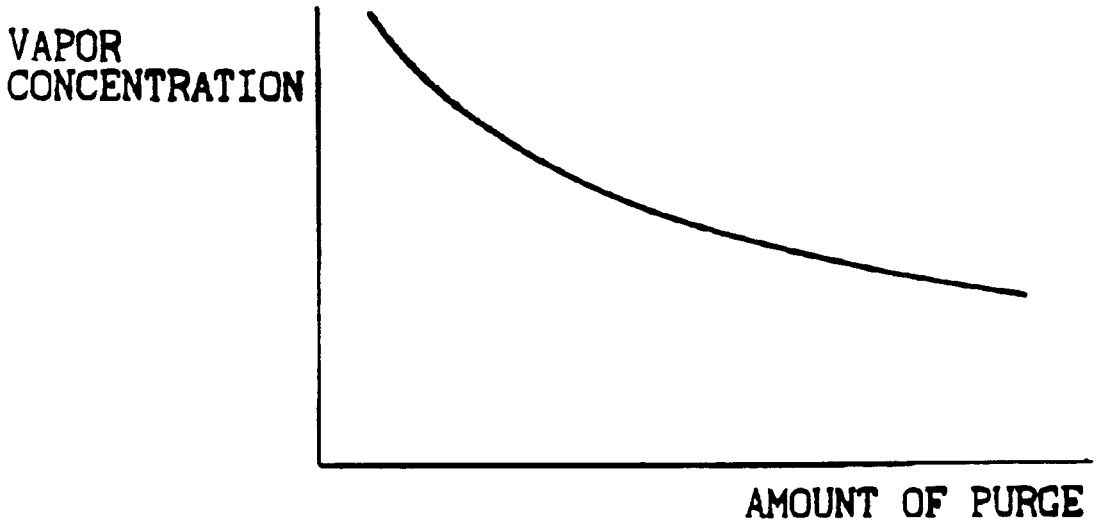

On the other hand, FIGS. 6A and 6B show the case where a large amount of evaporated fuel is produced in the fuel tank 5 in the case where the purge control valve 17 is used to control the purge rate to the target purge rate. In this case, the evaporated fuel is directly pushed out from the fuel tank 5 to the intake passage, so as shown by the fuel II in FIG. 6A, the amount of fuel supplied from the fuel tank 5 to the intake passage becomes constant regardless of the amount of purge. On the other hand, the fuel I disassociated from the activated carbon 10 of the canister 11 and the air increase along with an increase of the amount of purge.

In this case, when a large amount of evaporated fuel is produced in the fuel tank 5, the fuel contained in the purge gas becomes the sum of the fuel I and the fuel II and therefore the vapor concentration in the purge gas becomes higher the smaller the amount of purge. As a result, as shown in FIG. 6B, the vapor concentration in the intake air becomes higher the smaller the amount of purge and becomes lower the larger the amount of purge.

Figure 7:
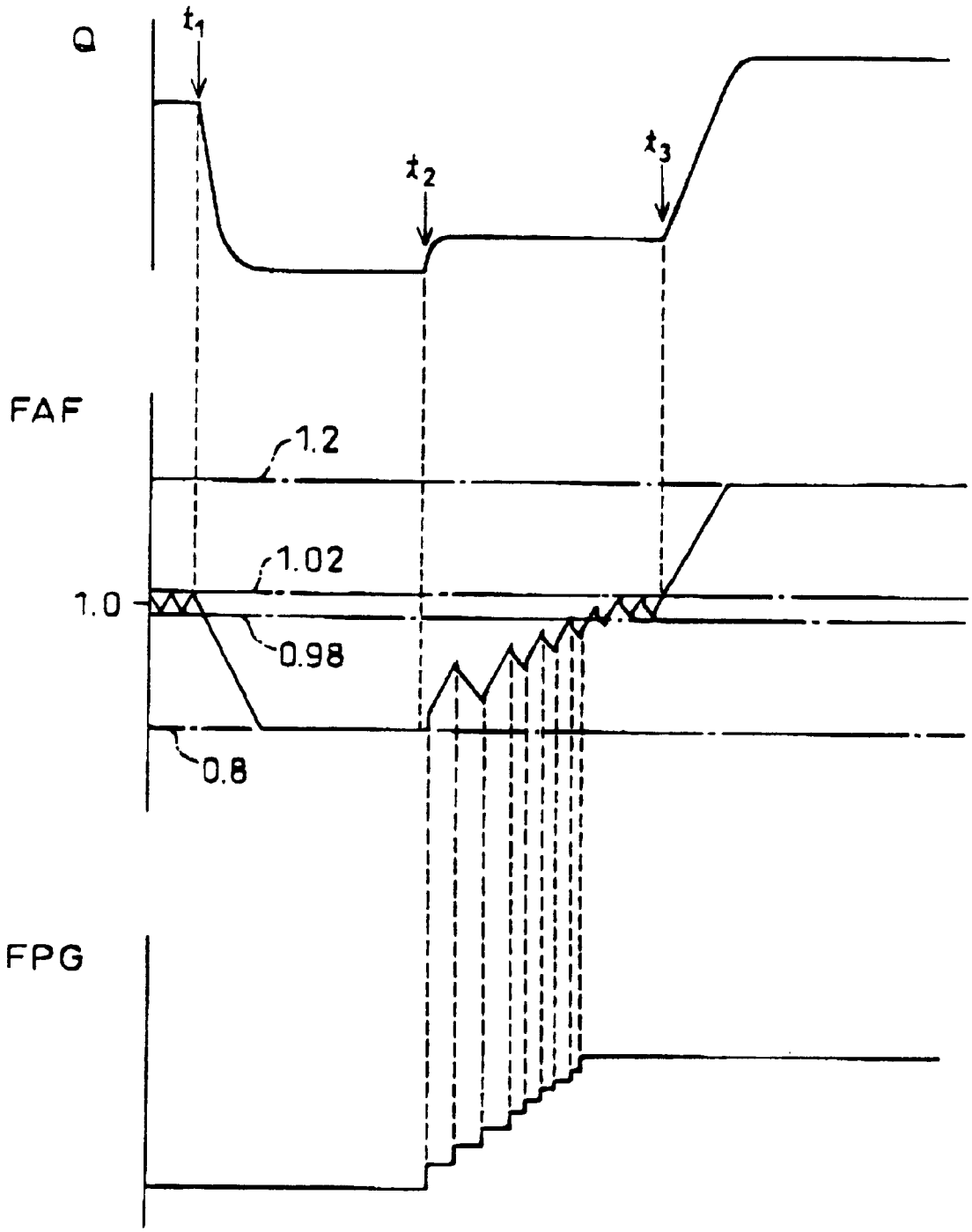
FIG. 7 is a view of changes in the feedback control coefficient FAF etc. in the case of fluctuations in the air-fuel ratio.
Figure 8:
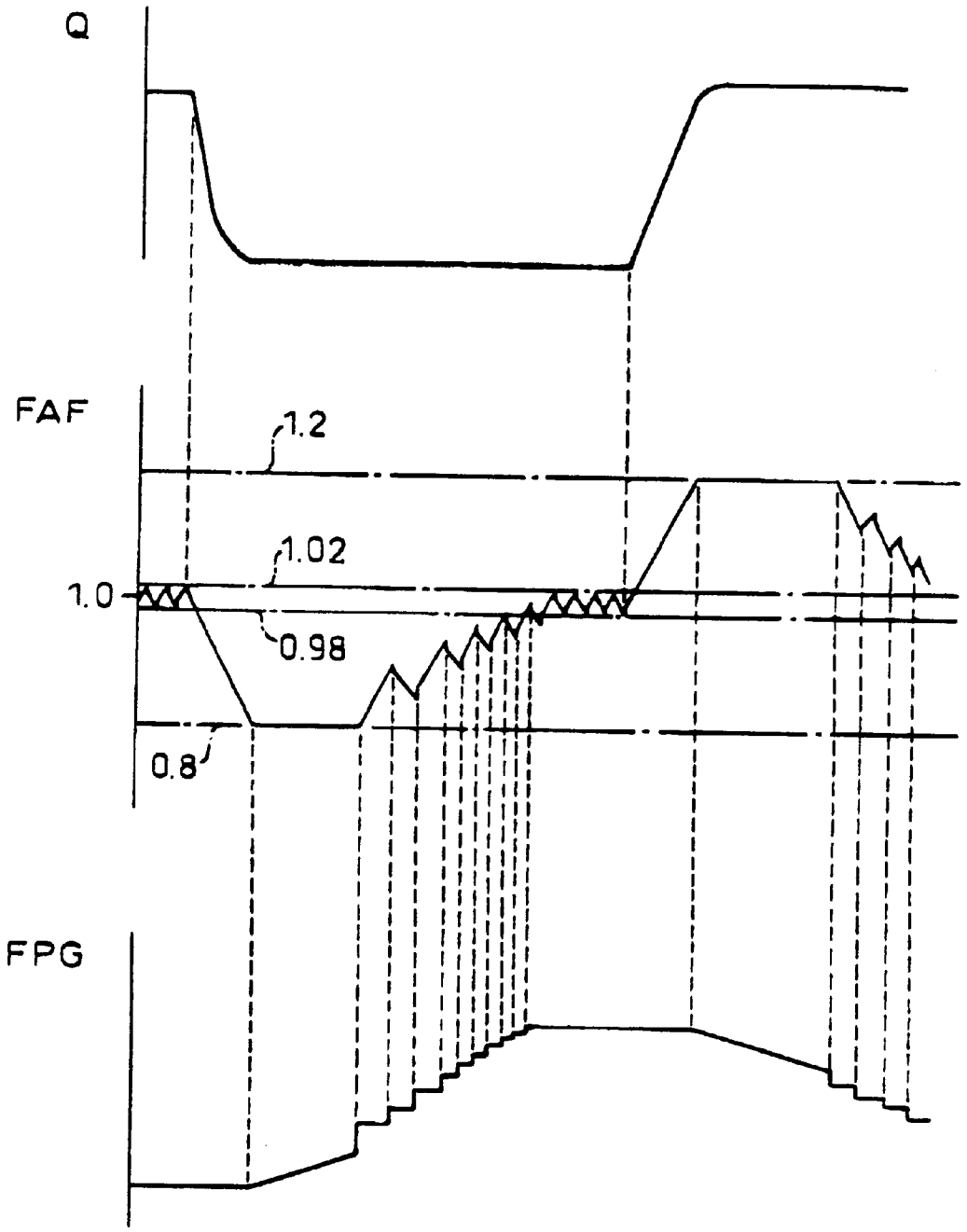
FIG. 8 is a view of changes in the feedback control coefficient FAF etc. in the case of fluctuations in the air-fuel ratio.

FIG. 7 and FIG. 8 show the changes in the feedback control coefficient FAF in the case where the vapor concentration in the intake gas fluctuates widely in accordance with the amount of purge in this way. Note that FIG. 7 shows the case where the purge A/F correction coefficient FPG is updated with each skip of the feedback control coefficient FAF in the same way as the above embodiment of the present invention.

As shown in FIG. 7, before the time t1, the average value FAFAV of the feedback control coefficient is assumed to have been maintained in the first set range. Next, when the deceleration operation is performed at the time t1, the amount of intake air Q falls widely and the amount of purge falls widely at the time t1. If the amount of purge falls widely, the vapor concentration increases and therefore the air-fuel ratio becomes rich. If the air-fuel ratio becomes rich, the feedback control coefficient FAF for maintaining the air-fuel ratio at the stoichiometric air-fuel ratio falls.

When however a large amount of evaporated fuel is produced in the fuel tank 15, the amount of purge changes widely. At this time, the amount of change of the concentration of the fuel vapor becomes larger, therefore as shown in FIG. 7, before the air-fuel ratio becomes the stoichiometric air-fuel ratio, the feedback control coefficient FAF reaches the lower limit of the allowable limit of fluctuation, that is, 0.8. When the feedback control coefficient FAF reaches the lower limit of the allowable limit of fluctuation, the FAF is subsequently maintained at 0.8. If the FAF is maintained at 0.8 in this way, the air-fuel ratio becomes considerably rich during this period and therefore the exhaust emission deteriorates.

Next, assuming that the amount of intake air Q was slightly increased at the time t2, the amount of purge is also slightly increased. As a result, the vapor concentration falls, so the feedback control coefficient FAF starts to rise. If the feedback control coefficient FAF starts to rise, the updating action of the purge A/F correction coefficient FPG is started and the average value FAFAV of the feedback control coefficient is returned to within the first set range.

Next, assuming that an acceleration operation is performed at the time t3, the amount of purge is widely increased. As a result, the vapor concentration falls widely, so before the air-fuel ratio reaches the stoichiometric air-fuel ratio, the feedback control coefficient FAF reaches the upper limit of the allowable limit of fluctuation, that is, 1.2. Therefore, in this case, the air-fuel ratio continues to remain considerably lean and therefore the exhaust emission deteriorates and a good acceleration operation can no longer be ensured.

FIG. 8 shows the case where the purge A/F correction coefficient FPG is gradually increased when the feedback control coefficient FAF reaches the lower limit of the allowable limit of fluctuation, that is, 0.8, and the purge A/F correction coefficient FPG is gradually reduced when the feedback control coefficient FAF reaches the upper limit of the allowable limit of fluctuation, that is, 1.2. In this case as well, the feedback control coefficient FAF is maintained temporarily at 0.8 or 1.2, so the air-fuel ratio becomes considerably rich or considerably lean.

Figure 9:
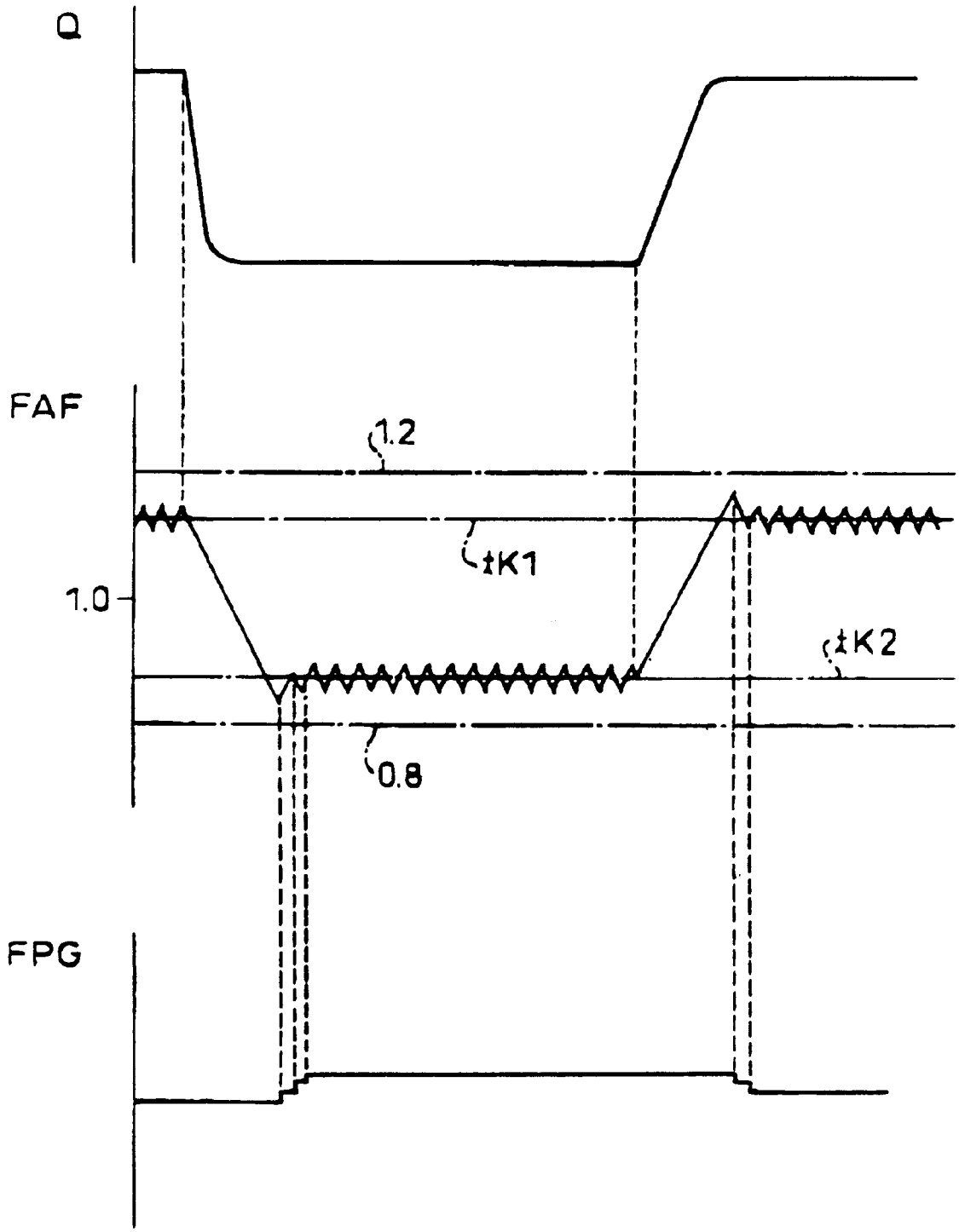
FIG. 9 is a view of changes in the feedback control coefficient FAF etc. in the present invention.

Therefore, in the present invention, as shown in FIG. 9, a second set range (range between tK1 and tK2) wider than the first set range is set. When the average value FAFAV of the feedback control coefficient exceeds the upper limit tK1 of the second set range, the average value FAFAV of the feedback control coefficient is returned to near the upper limit tK1, while when the average value FAFAV of the feedback control coefficient exceeds the looser limit tK2 of the second set range, the average value FAPAV of the feedback control coefficient is returned to near the lower limit tK2 of the second set range.

The upper limit tK1 and the lower limit tK2 of the second set range of FIG. 9 show the first embodiment of the present invention. In the first embodiment, the upper limit tK1 and the lower limit tK2 are made constant values. Specifically, the upper limit tK1 is made a value larger than 1.02 and smaller than 1.2, for example, 1.15, while the lower limit tK2 is made a value smaller than 0.98 and larger than 0.8, for example, 0.35.

In the first embodiment, when the average value FAFAV of the feedback control coefficient exceeds the upper limit tK1, the purge A/F correction coefficient FPG is updated so that the average value FAFAV of the feedback control coefficient returns toward the upper limit tK1 by exactly the amount it exceeds the upper limit tK1. Therefore, as shown in FIG. 9, when the average value FAFAV of the feedback control coefficient exceeds the upper limit tK1, the FAFAV is maintained at substantially the upper limit tK1 thereafter. On the other hand, when the average value FAFAV of the feedback control coefficient exceeds the lower limit tR2, the purge A/F correction coefficient FPG is updated so that the average value FAFAV of the feedback control coefficient returns toward the lower limit tK2 by exactly the amount it exceeds the lower limit tK2. Therefore, as shown in FIG. 9, when the average value FAFAV of the feedback control coefficient exceeds the lower limit tK2, the FAFAV is maintained at substantially the lower limit tK2 after that.

In the first embodiment, when operating state is one in which a large amount of evaporated fuel is produced in the fuel tank 15, the set range for the feedback control coefficient FAF is changed from the first set range shown in FIG. 4 (between 0.98 and 1.02) to the second set range shown in FIG. 9 (between tK1 and tK2). After changing from the first set range to the second set range, the amount of intake air is widely increased. Therefore, if the amount of purge is widely increased, the feedback control coefficient FAF is maintained once at 1.2, but finally is maintained near the upper limit tK1 of the second set range as shown in FIG. 9. On the other hand, the amount of intake air is widely reduced after changing from the first set range to the second set range. Therefore, if the amount of purge is widely reduced, the feedback control coefficient FAF is maintained once at 0.8, but finally is maintained near the lower limit tK2 of the second set range as shown in FIG. 9.

In this wary, when the feedback control coefficient FAF is maintained near the upper limit tK1 in this way, if the amount of intake air Q is widely reduced and if the amount of purge is widely reduced, as shown in FIG. 9, the feedback control coefficient FAF can fall to where the air-fuel ratio becomes the stoichiometric air-fuel ratio. Therefore, it is possible to prevent the air-fuel ratio from becoming excessively rich. On the other hand, when the feedback control coefficient FAF is maintained near the lower limit tK2, if the amount of intake air Q is widely increased and if the amount of purge is widely increased, as shown in FIG. 9, the feedback control coefficient FAF can rise to where the air-fuel ratio becomes the stoichiometric air-fuel ratio. Therefore, the air-fuel ratio can be prevented from becoming excessively lean.

Next, an explanation will be made of the routine for the control of the purge referring to FIG. 10 and FIG. 11. Note that this routine is executed by interruption every predetermined time interval.

Figure 10:
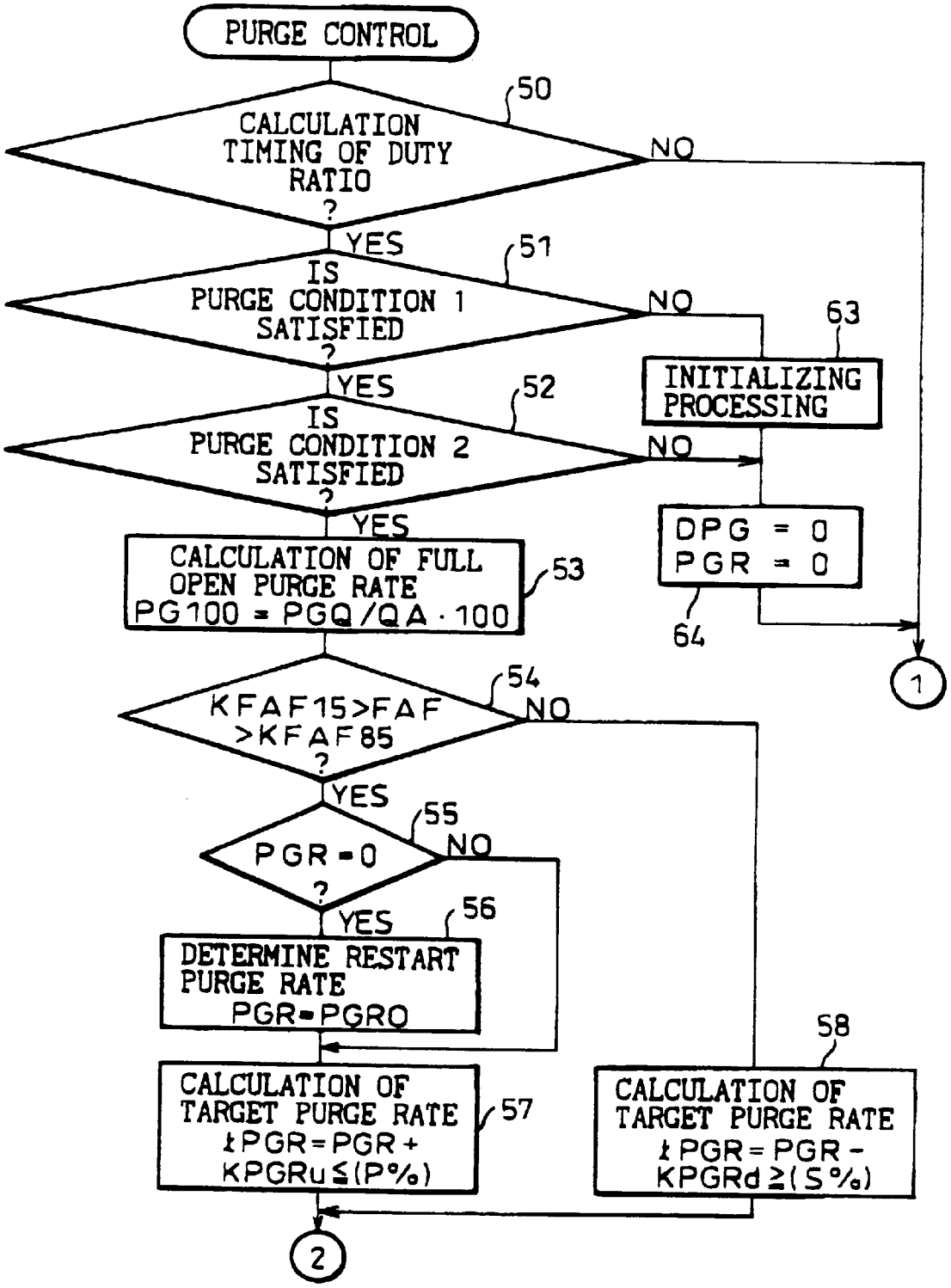
FIGS. 10 and 11 are flow charts of the purge control.
Figure 11:
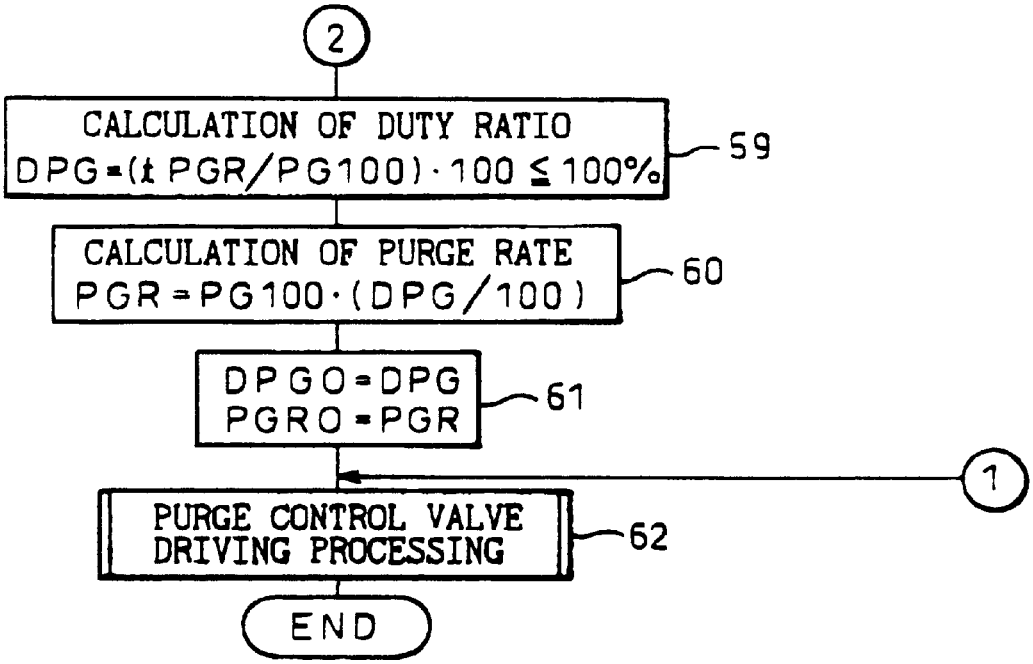

Referring to FIG. 10 and FIG. 11, first, at step 50, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 64, where the processing for driving the purge control valve 17 is executed. As opposed to this, when it is the time for calculation of the duty ratio, the routine proceeds to step 51, where it is judged if the purge condition 1 is satisfied or not, for example, if the engine warmup has been completed or not. When the purge condition 1 is not satisfied, the routine proceeds to step 63, where the initialization processing is performed, then at step 64, the duty ratio DPG and the purge rate PGR are made zero. As opposed to this, when the purge condition 1 is satisfied, the routine proceeds to step 52, where it is judged if the purge condition 2 is satisfied or not, for example, whether feedback control of the air-fuel ratio is being performed or not. When the purge condition 2 is not satisfied, the routine proceeds to step 64, while when the purge condition 2 is satisfied, the routine proceeds to step 53.

At step 53, the ratio between the full open purge amount PGQ and the amount QA of intake air, that is, the full open purge rate PG100 (=(PGQ/QA)·100), is calculated. Herze, the full open purge amount PGQ shows the amount of purge when the purge control valve 17 is fully open. The full open purge rate PG100 is a function of for example the engine load Q/N (amount QA of intake air/engine speed N) and the engine speed N and is found in advance by experiments. It is stored in advance in the ROM 22 in the form of a map as shown in the following table.

TABLE 1

| | q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load Q/N becomes, the larger the full open purge amount PGQ with respect to the amount QA of intake air becomes, so an shown in Table 1, the full open purge rate PG100 becomes larger the lower the engine load Q/N becomes and the full open purge amount PCQ with respect to the amount QA of intake air becomes larger the lower the engine speed N becomes, so as shown in Table 1, the full open purge rate PG100 becomes larger the lower the engine speed N.

Next, at step 54, it is judged if the feedback control coefficient FAY is between the upper limit KFAF15 (=1.15) and the lower limit KFAF85 (=0.85) or not. When KFAV15>FAF>KFAF85, that is, when the air-fuel ratio is being controlled by feedback to the stoichiometric air-fuel ratio, the routine proceeds to step 55, where it is judged if the purge rate PGR is zero or not. When the purge action is already being performed, PGR>0, so at this time the routine jumps to step 57. As opposed to this, further, when the purge action has not yet been started, the routine proceeds to step 56, where the purge rate GRPO is made the restart purge rate PGR. When the purge condition 1 and the purge condition 2 are satisfied for the first time after the engine has started operating, the purge rate PGR0 is made zero by the initialization processing (step 63), so at this time PGR becomes 0.

As opposed to this, when the purge action is stopped once and then the purge control is resumed, the purge rate PGF0 just before the purge control was stopped is made the restart purge rate FGR.

Next, at step 57, the target purge rate tPGR (=PGR+KPRGu) is calculated by adding a constant value KPGRu to the purge rate PGR. That is, when KFAF15>FAF>KFAF85, it is understood, the target purge rate tPGR is gradually increased every 100 msec. Note that an upper limit value P (P is for example 6%) is set for this target purge rate tPGR, therefore the target purge rate tPGR con only rise up to this upper limit value P. Next, the routine proceeds to step 59.

On the other hand, when it is judged at step 54 that FAF≧RPAF15 or FAF23 KFAF85, the routine proceeds to step 58, where the constant value KPGRd is subtracted from the purge rate PGR to calculate the target purge rate tPGR (=PGR−KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 59.

At step 59, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is controlled in accordance with the ratio of the target purge rate tTPG to the full open purge rate PG100 in this way, no matter what purge rate the target purge rate tTPG is, regardless of the engine operating state, the actual purge rate will be maintained at the target purge rate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PC100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual puree rate will be maintained at 4 percent regardless of the engine operating state.

Next, at step 60, the full open rate PG100 is multiplied by thc duty ratio DPG to calculate the actual purge rate PGR (=PG100·(DPG/100)). That is, as explained above, the duty ratio DPG is expressed by (tPGR/PG100)·100. In this case, when the target purge rate tPGR becomes larger than the full open purge rate PG100, the duty ratio DPG would become more than 100 percent. The duty ratio DPC, however, cannot become more than 100 percent. At this time, the duty ratio DPG is made 100 percent, therefore the actual purge rate PGR becomes smaller than the target purge rate tPGR. Accordingly, the actual purge rate PGR is expressed by PG100·(DPG/100) as explained above.

Next, at step 61, the duty ratio DPG is made DPGO and the purge rate PGR is made PGR0. Next, at step 62, processing is performed to drive the purge control valve 17. This drive processing is shown in FIG. 12, therefore, an explanation will next be made of the drive processing of FIG. 12.

Figure 12:
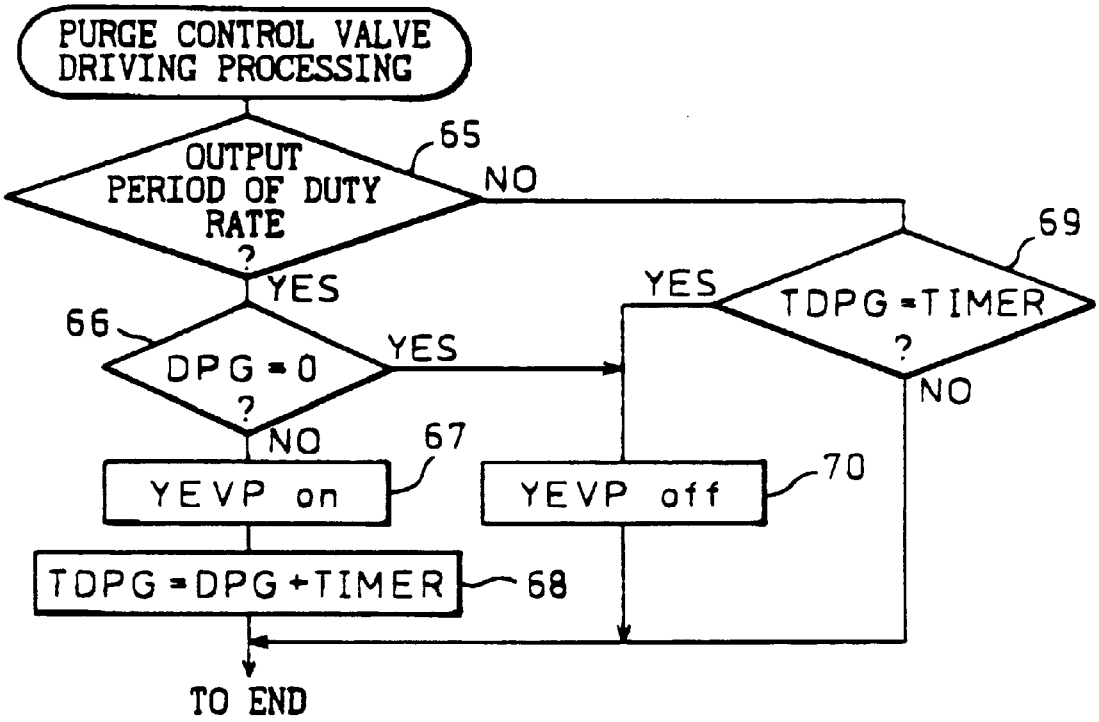
FIG. 12 is a flow chart of the processing for driving a purge control valve.

Referring to FIG. 12, first, at step 65, it is judged if the output period of the duty ratio, that is, the rising period of the drive pulse of the purge control valve 17, has arrived or not. The output period of the duty ratio is 100 msec. If the output period of the duty ratio has arrived, the routine proceeds to step 66, where it is judged if the duty ratio DPG is zero or not. When DPG is 0, the routine proceeds to step 70, where the drive pulse YF!VP of the purge control valve 17 is turned off. As opposed to this, when DPG is not 0, the routine proceeds to step 67, where the drive pulse YEVP of the purge control valve 17 is turned on. Next, at step 68, the duty ratio DPG is added to the current time TIMER to calculate the off time TDPG of the drive pulse (=DPG+TIMER).

On the other hand, when it is judged at step 65 that the output period of the duty ratio has not arrived, the routine proceeds to step 69, where it is judged if the current time TIMER is the off time TDPG of the drive pulse. When TDPG=TIMER, the routine proceeds to step 70, where thet drive pulse YEVF is turned off.

Next, the routine for calculation of the feedback control coefficient FAF shown in FIG. 13 will be explained. This routine is executed by interruption every predetermined interval for example.

Figure 13:
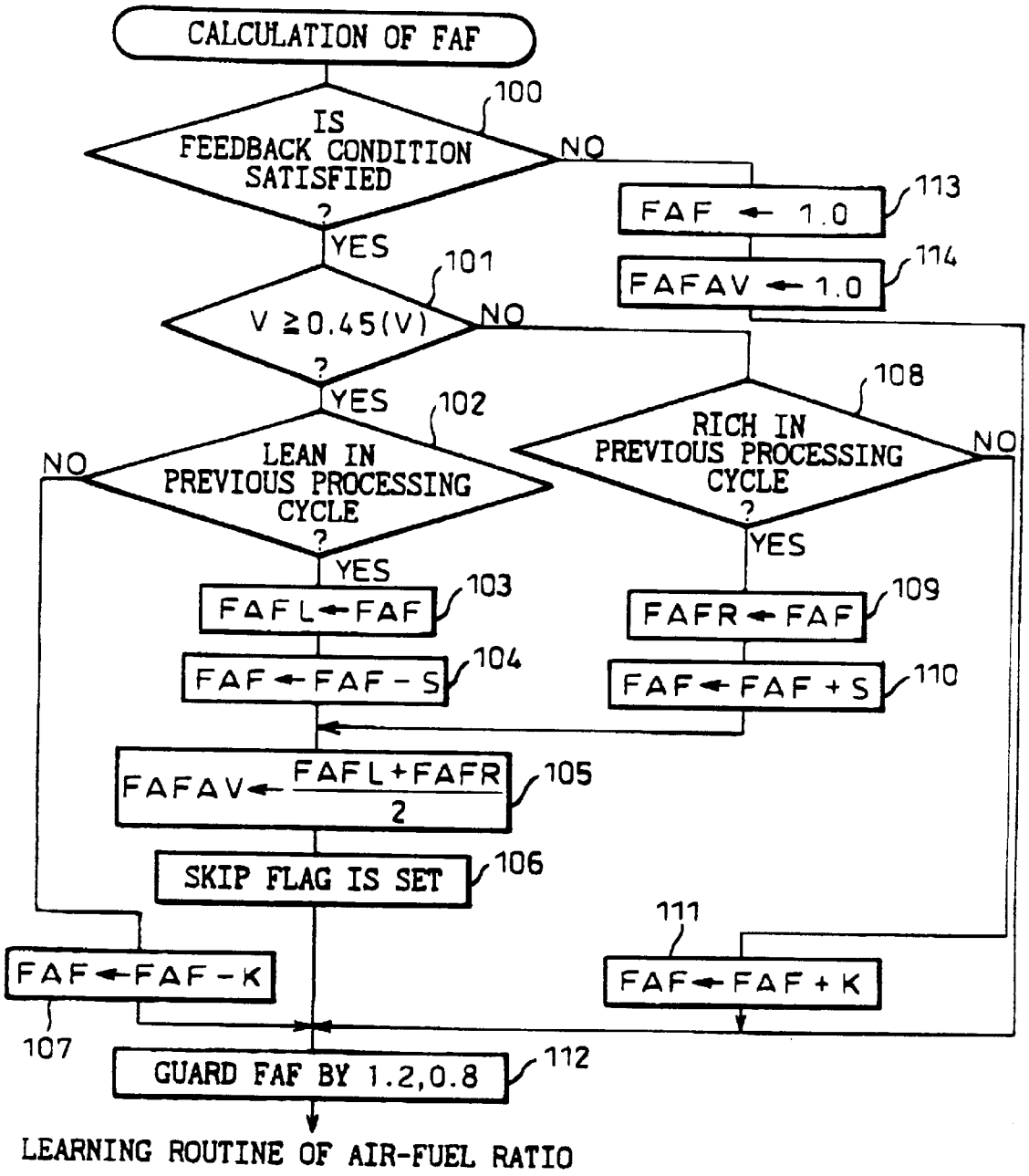
FIG. 13 is a flow chart of the calculation of the feedback control coefficient FAF.

Referring to FIG. 13, first, at step 100, it is judged if the feedback control conditions of the air-fuel ratio are satisfied or not. When the feedback control conditions are not satisfied, the routine proceeds to step 113, where the feedback control coefficient FAF is fixed to 1.0, then at step 114, the average value FAFAV of the feedback control coefficient is fixed to 1.0. Next, the routine proceeds to step 112. As opposed to this, when the feedback control conditions are satisfied, the routine proceeds to step 101.

At step 101, it is judged whether the output voltage of the $O_2$ sensor 31 is higher than 0.45V or not, that is, whether the air-fuel ratio is rich or not. When V≧0.45V, that is, when the air-fuel ratio is rich, the routine proceeds to step 102, where it is judged if the air-fuel ratio was lean at the time of the previous processing cycle or not. When it was lean at the time of the previous processing cycle, that is, when it has changed from lean to rich, the routine proceeds to step 103, where the feedback control coefficient FAF is made FAFL and the routine proceeds to step 104. At step 104, a skip value S is subtracted from the feedback control coefficient FAP, therefore, as shown in FIG. 2, the feedback control coefficient FAF is rapidly reduced by the skip value S. Next, at stop 105, the average value FAFAV of the FALFL and FAFR is calculated. Next, at step 106, the skip Flag is set. Next, the routine proceeds to step 112. On the other hand, when it is judged at step 102 that the air-fuel ratio was rich at the time of the previous processing cycle, the routine proceeds to step 107, where the integral value K (K<<S) is subtracted from the feedback control coefficient FAF, then the routine proceeds to step 112. Therefore, as shown in FIG. 2, the feedback control coefficient FAF is gradually reduced.

On the other hand, when it is judged at step 101 that V<0.45V, that is, when the air-fuel ratio is lean, the routine proceeds to step 108, where it is judged if the air-fuel ratio was rich at the time of the previous processing cycle. When it was rich at the time of the previous processing cycle, What is, when it changed from rich to lean, the routine proceeds to step 109, where the feedback control coefficient FAF is made FAFR and the routine proceeds to step 110. At step 110, the skip value S is added to the feedback control coefficient FAF, therefore, as shown in FIG. 2, the feedback control coefficient FAF is rapidly increased by exactly the skip value S. Next, at step 105, the average value FAFAV of the FAFL and FAFR is calculated. On the other hand, when it was judged at step 108 that the air-fuel ratio was lean at the time of the previous processing cycle, the routine proceeds to step 111, where the integral value K is added to the feedback control coefficient FAF. Therefore, as shown in FIG. 2, the feedback control coefficient FAF is gradually increased.

At step 112, the feedback control coefficient FAF is guarded by the upper limit 1.2 and the lower limit 0.8 of the allowable range of fluctuation. That is, the value of FAF is guarded so that FAF does not become larger than 1.2 and does not become smaller than 0.8. As explained above, when the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio.

Figure 14:
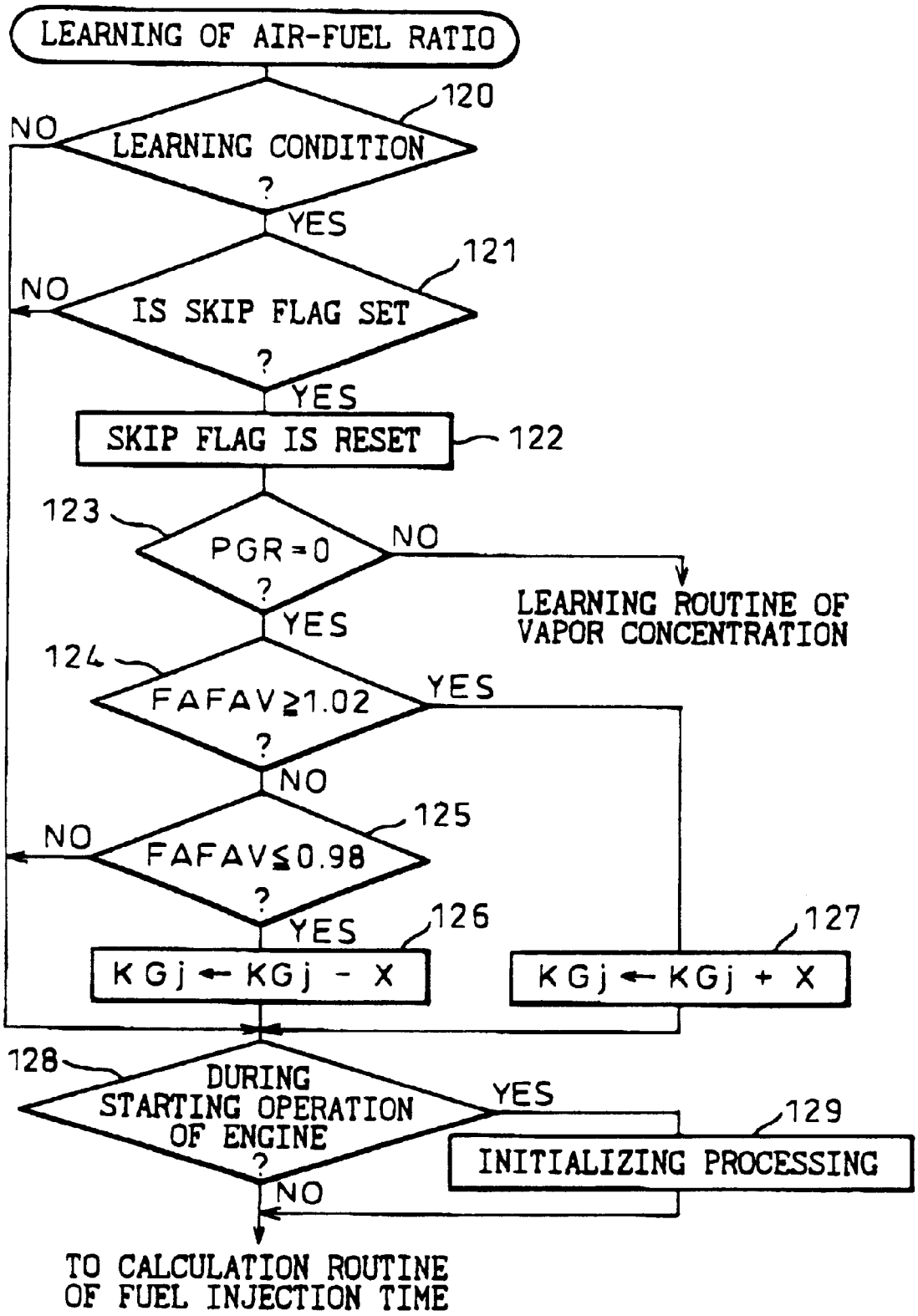
FIG. 14 is a flow chart of the learning of the air-fuel ratio.

When the routine for calculation of the feedback control coefficient FAF shown in FIG. 13 is completed, the routine for learning the air-fuel ratio shown in FIG. 14 is started.

Referring to FIG. 14, first, at step 120, it is judged if the learning conditions of the air-fuel ratio are satisfied or not. When the learning conditions of the air-fuel ratio are not satisfied, the routine jumps to step 128, while when the learning conditions of the air-fuel ratio are satisfied, it proceeds to step 121. At step 121, it is judged if the skip flag has been set or not. When the skip flag has not been set, the routine jumps to step 128. As opposed to this, when the skip flag has been set, thee routine proceeds to step 122, where the skip flag is reset, then the routine proceeds to step 123. That is, the routine proceeds to step 123 every time the feedback control coefficient FAF is made to skip.

At step 123, it is judged if the purge rate PGR is zero or not, that is, if the purge action is being performed. When the purge rate PGR is not zero, that is, when the purge action is being performed, the routine proceeds to the learning routine of the vapor concentration shown in FIG. 15 and FIG. 16. As opposed to this, when the purge rate PGR is zero, that is, when the purge action is not being performed, the routine proceeds to step 124, where the learning of the air-fuel ratio is performed.

That is, first, at step 124, it is judged if the average value FAFAV of the feedback control coefficient is larger than 1.02 or not. When FAFAV≧1.02, the routine proceeds to step 127, where the constant value X is added to the learning value KGj of the air-fuel ratio for the learning region j. That is, in the embodiment of the present invention, a plurality of learning regions j are set in advance in accordance with the engine load. A learning value KGj of the air-fuel ratio is set for each learning region j. Therefore, at step 127, the learning value KGj of the air-fuel ratio of the learning region j in accordance with the engine load is updated. Next, the routine proceeds to step 128.

On the other hand, when it is judged at step 124 that FAFAV<1.02, the routine proceeds to step 125, where it is judged if the average value FAFAV of the feedback control coefficient is smaller than 0.98. When FAFAV≦0.98, the routine proceeds to step 126, where a constant value X is subtracted from the learning value KGj of the air-fuel ratio of the learning region j in accordance with the engine load. On the other hand, when it is judged at step 125 that FAFAV>0.98, that is, when FAFAV is between 0.98 and 1.02, the routine jumps to step 128 without updating the learning value KGj of the air-fuel ratio.

At step 128 and step 129, the initialization processing for learning the vapor concentration is performed. That is, at step 128, it is judged if the engine is in the middle of warmup. When the engine is warming up, the routine proceeds to stop 129, where the vapor concentration FGPG per unit purge rate is made zero and the count CPGR of purge execution time is cleared. Next, the routine proceeds to the routine for calculation of the fuel injection time shown in FIG. 17. On the other hand, when the engine is not warming up, the routine proceeds directly to the routine for calculation of the fuel injection time shown in FIG. 17.

Figure 15:
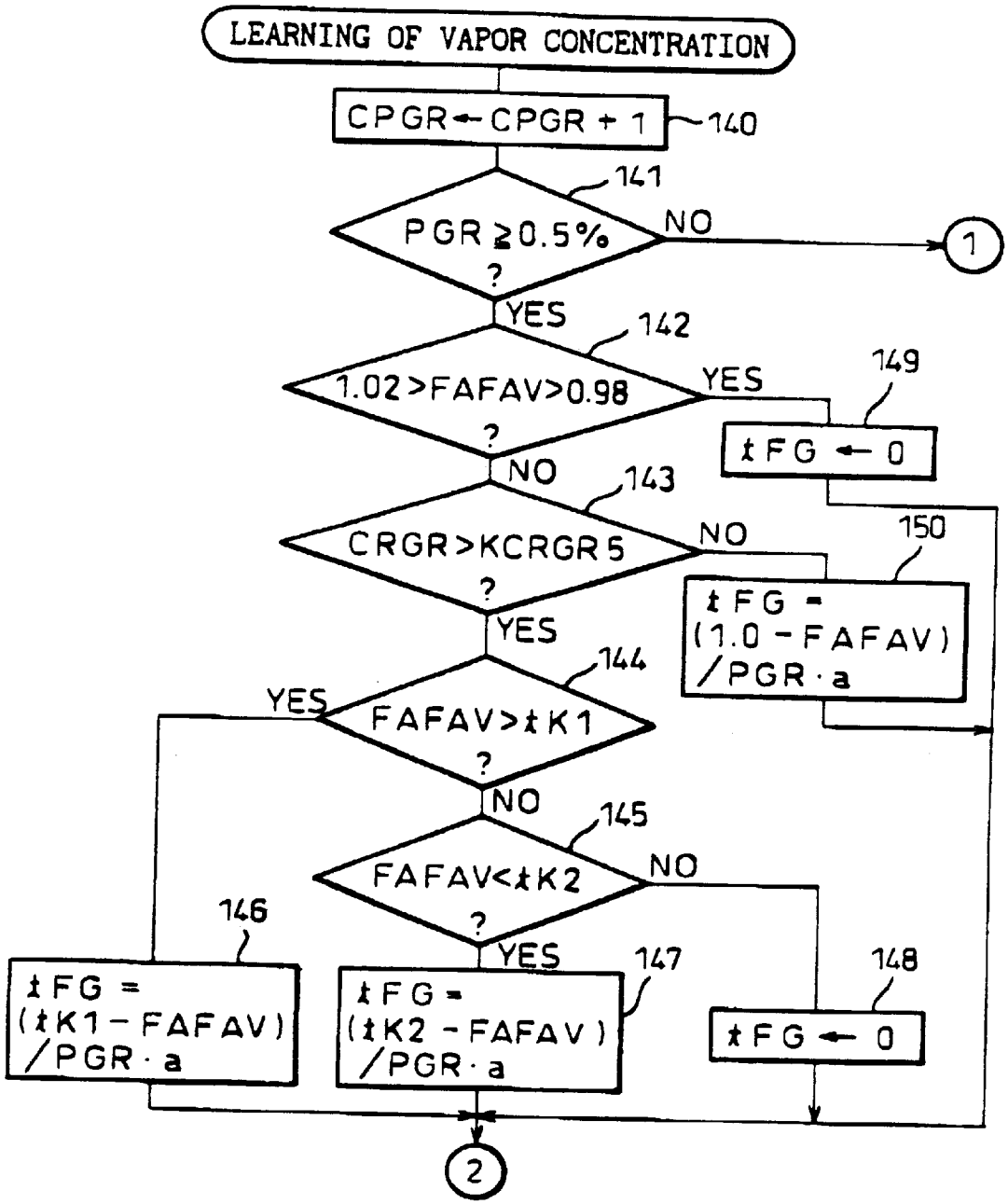
FIGS. 15 and 16 are flow charts of the learning of the vapor concentration.
Figure 16:
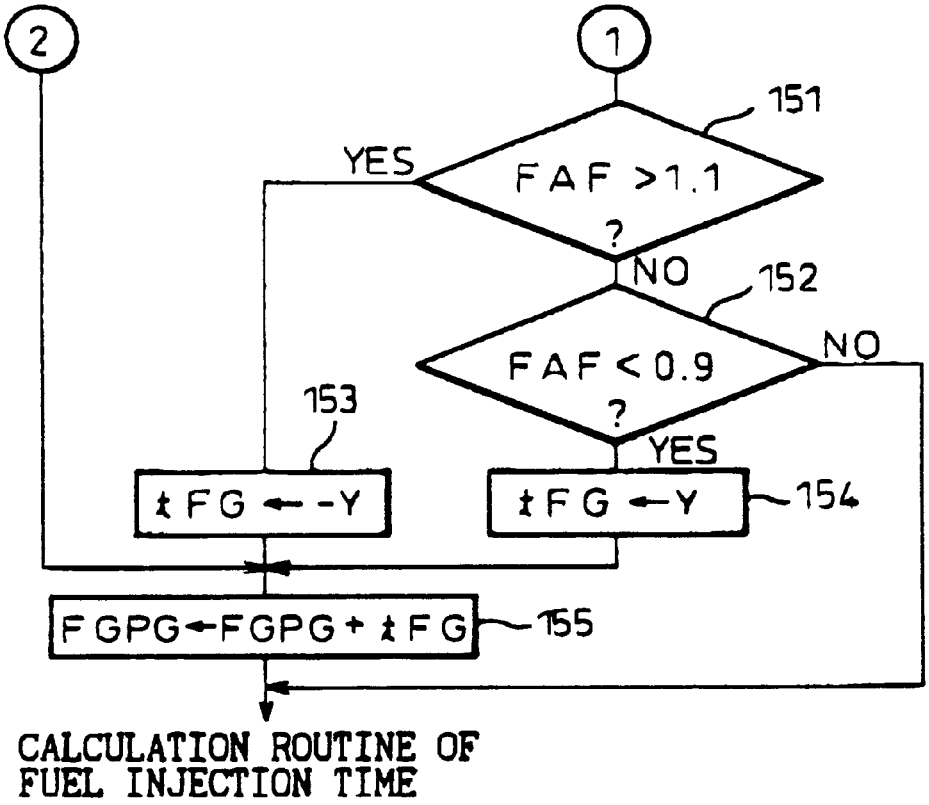

An explained above, when it is judged at step 123 that the purge action is being performed, the routine proceeds to the routine for learning the vapor concentration shown in FIG. 15 and FIG. 16. Next, the routine for learning the vapor concentration will be explained.

Referring to FIG. 15 and FIG. 16, first, at step 140, the count CPGR of purge execution time is incremented by exactly 1. As explained above, the count CPGR of the purge execution time is cleared at the time of engine warmup, so the count CPGR of the purge execution time shows the cumulative time over which the purge action is performed after the engine warms up.

Next, at step 141, it is judged if the purge rate PGR is larger than 0.5 percent or not. When PGR≧0.5 percent, that is , except when the purge rate PGR is extremely small, the routine proceeds to step 142, where it is judged if the average value FAFAV of the feedback control coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 149, where the update value tFG of the vapor concentration FGPG per unit purge rate is made zero, then the routine proceeds to step 155. Therefore, at this time, the vapor concentration FGPG is not updated.

On the other hand, when it is judged at step 142 that the average value FAFAV of the feedback control coefficient is outside of the first set range, that is, when FAFAV≧1.02 or FAFAV≦0.98, the routine proceeds to step 143, where it is judged if the count CPGR of the purge execution time is larger than the predetermined set value KCPGR5 or not. This set value KCPGR5 corresponds to about 5 minutes. Therefore, at step 143, it is judged if the purge execution time has exceeded about 5 minutes. The region I shown in FIG. 3 is considered about 5 minutes. Therefore, at step 143, it is judged if the region is the region I or the region II of FIG. 3.

When CPGR≦KCPGR5, that is, when the region I of FIG. 3, the routine proceeds to step 150, where the update value tFG, of the vapor concentration FGPG is calculated based on the following equation:

$$tFG=(1.0-FAFAV)/PGR\cdot a$$

Here, a, as explained above, is 2. That is, in the region I of FIG. 3, when the average value EAFAV of the feedback control coefficient is outside of the first set range (between 0.98 and 1.02), half of the deviation of the FAFAY with respect to 1.0 is made the update value tFG. At this time, FAFAV is gradually returned to the first set range as shown in FIG. 4.

On the other hand, when it is judged at step 143 that CPGR>KCPGR5, that is, when the region is the region II of FIG. 3, the routine proceeds to step 144. From step 144 to step 148, when the average value FAFAV of the feedback control coefficient is outside the second range (between tK1 and tK2, for example, between 0.85 and 1.15), half of the amount by which the second set range is exceeded is Blade the update value tFG of the vapor concentration FCPG.

That is, at step 144, it is judged if the average value FAFAV of the feedback control coefficient is larger than the upper limit tK1 of the second set range. When FAFAV>tK1, the routine proceeds to step 146, where the update value tFG is calculated based on the following equation:

$$tFG=(tK1-FAFAV)/PGR\cdot a$$

Here, a is for example 2. That is, when FAFAV exceeds the upper value tK1 of the second set range, half of the difference of the upper limit tK1 and FAFAV is made the update value tFG. At this time, FAFAV is gradually returned to the upper limit tK1 of the second set range as shown in FIG. 9.

On the other hand, when it is judged at step 144 that FAFAV≦tK1, the routine proceeds to step 145, where it is judged if the average value FAFAV of the feedback control coefficient is smaller than the lower limit tK2 of the second set range. When FAFAV<tK2, the routine proceeds to step 147, where the update value tFG is calculated based on the following formula.

$$tFG=(tK2-FAFAV)/PGR\cdot a$$

Here, a is for example 2. That is, when FAFAV becomes smaller than the lower value tK2 of the second set range, half of the difference of the lower limit tK2 and FAFAV is made the update value tFG. At this time, FAFAR is gradually returned to the lower limit tK2 of the second set range as shown in FIG. 9.

On the other hand, when it is judged at step 145 that FAFAV≧tK2, that is, when the average value FAFAV of the feedback control coefficient is in the second set range, the routine proceeds to step 148, where the update value tFG is made zero. Therefore, when FAFAV is in the second set range, the vapor concentration FGPG is not updated.

If the update value tFG is calculated at step 146, 147, 148, 149, or 150, the routine proceeds to step 155, where the update value tFG is added to the vapor concentration FGPG. Next, the routine proceeds to the routine for calculation of the fuel injection time shown in FIG. 17.

On the other hand, when it is judged at step 141 that PGR<0.5 percent, the routine proceeds to step 151, where it is judged if the feedback control coefficient FAF is larger than 1.1. When FAF>1.1, the routine proceeds to step 153, where the update value tFG is made the constant value −Y, then the routine proceeds to step 155. On the other hand, when it is judged at step 151 that FAF≦1.1, the routine proceeds to step 152, where it is judged if the feedback control coefficient FAF is smaller than 0.9 or not. When FAF<0.9, the routine proceeds to step 154, where the update value tFG is made the constant value Y, then the routine proceeds to step 155. When it is judged at step 152 that FAF≧0.9, the routine proceeds to the routine for calculation of the fuel injection time shown in FIG. 17.

That is, when the purge rate PGR is extremely small, if the amount of fluctuation of the feedback control coefficient FAF were to be directly reflected back into the update value tFG of the vapor concentration FGPG, the error of the vapor concentration FGPG would become large. Therefore, in this case, only when the feedback control coefficient FAF fluctuates widely from 1.0, the vapor concentration FGPG is updated by the constant small update value −Y or Y.

Next, an explanation will be made of the routine for calculation of the fuel injection time shown in FIG. 17.

Figure 17:
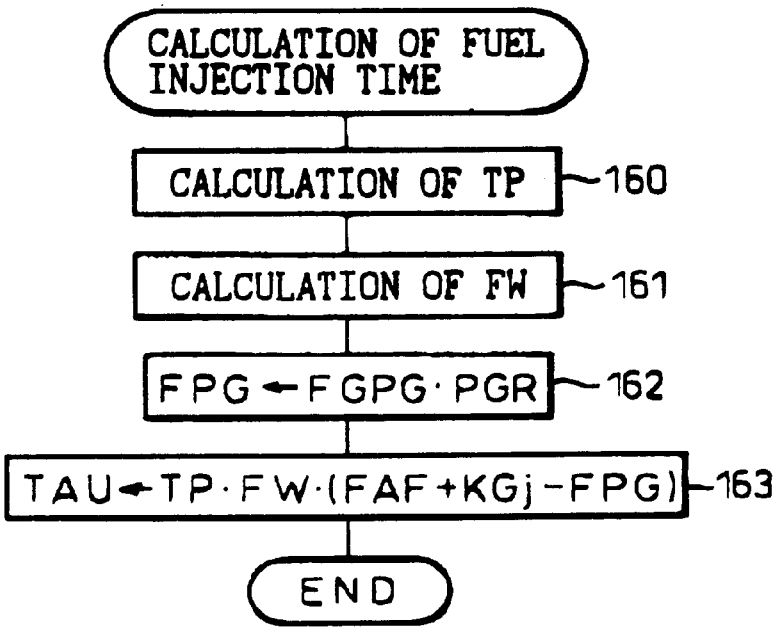
FIG. 17 is a flow chart of the calculation of the fuel injection time.

Referring to FIG. 17, first, at step 160, the basic fuel injection time TP is calculated based on the engine load Q/N and the engine speed N. Next, at step 161, the correctoin coefficient FW for the increase at engine warmup etc. is calculated. Next, at step 162, the purge rate PGR is multiplied with the vapor concentration FGFG per unit purge rate to calculate the purge A/F correction coefficient FPG (=FGPG·PGR). Next, at stop 163, the fuel injection time TAU is calculated based on the following equation:

$$TAU=TP\cdot FW\cdot(FAF+KGj-FPG)$$

Next, a second embodiment will be explained with reference to FIG. 18 to FIG. 22.

Figure 18:
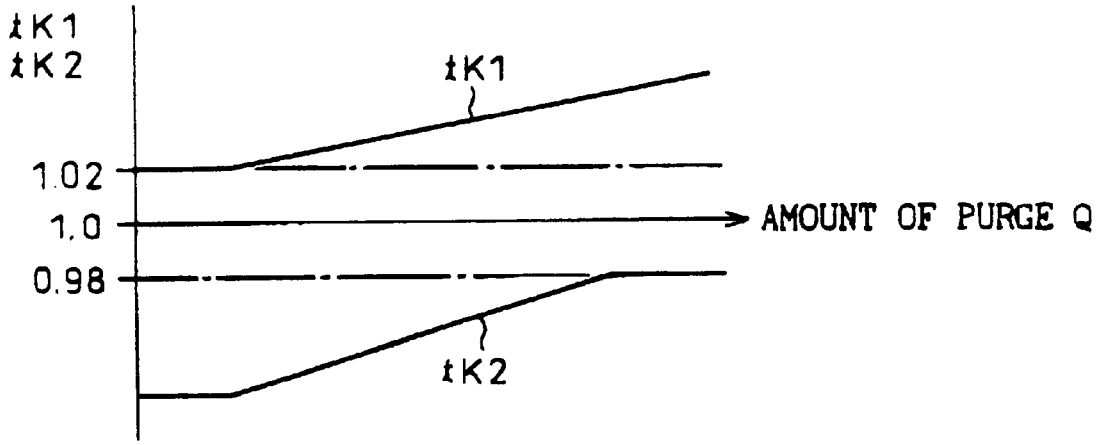
FIG. 18 is a view of an upper limit tK1 and a lower limit tK2 of a second set range.

In the second embodiment, as shown in FIG. 18, the upper limit tK1 and the lower limit tK2 of the second set range are changed in accordance with the amount of purge Q per unit time. That is, the upper limit tK1 of the second set range becomes larger than greater the amount of purge Q with respect to the upper limit 1.02 of the first set range, while the lower limit tK2 of the second set range becomes smaller than smaller the amount of purge Q with respect to the lower limit 0.98 of the first set range. The reasons for setting the upper limit tK1 and the lower limit tK2 in this way will be explained with reference to FIG. 18.

As explained above, if the amount of intake air increases and the amount of purge Q increases in the region II shown in FIG. 3, in the end, the feedback control coefficient FAF is maintained near the upper limit tK1 of the second set range. That is, when the amount of purges is Qb in FIG. 19, the feedback control coefficient FAF is maintained near the point b, while when the amount of purge is Qc, the feedback control coefficient FAF is maintained near the point c.

Next, the amount of purge is reduced to Qa. At this time, the smaller the amount of reduction of the amount of purge Q, the smaller the increase of the concentration of the fuel vapor, therefore the smaller the amount of reduction of the feedback control coefficient FAF. That is, the amount of reduction of the feedback control coefficient FAF becomes smaller when the amount of reduction of the amount of purge is small (Qb→Qa) than when the amount of reduction of the amount of purge is large (Qc→Qa). Therefore, even if the value of the upper limit tK1 of the second set range at the point b is smaller than the value of the upper limit tK1 at the point c, the feedback control coefficient FAF can change until the air-fuel ratio becomes the stoichiometric air-fuel ratio without reaching the allowable limit of fluctuation. That is, even if the upper limit tK1 is made large along with the increase of the amount of purge Q, there is no danger of the feedback control coefficient FAF reaching the allowable limit of fluctuation.

The same thing may be said regarding the lower limit tK2 of the second set range. That is, the amount of reduction of the feedback control coefficient FAF becomes smaller when the amount of reduction of the amount of purge is small (Qc→Qd) than when the amount of reduction of the amount of purge is large (Qc→Qa). Therefore, even if the value of the lower limit tK2 of the second set range at the point d is made larger than the value of the lower limit tK2 at the point a, the feedback control coefficient FAF may be changed to where the air-fuel ratio becomes the stoichiometric air-fuel ratio without reaching the allowable limit of fluctuation. That is, even if the lower limit tK2 is made larger along with the increase of the amount of purge Q, there is no danger of the feedback control coefficient FAF reaching the allowable limit of fluctuation.

If the upper limit tK1 and the lower limit tK2 are set in this way, however, in the region II shown in FIG. 3, the feedback control coefficient FAF is maintained at a position nearer the reference value, that is, 1.0, compared with the first embodiment. In other words, the feedback control coefficient FAF is maintained at a position further away from the allowable limit of fluctuation compared with the first embodiment. Therefore, there is the advantage that it is possible to reduce the chances of the feedback control coefficient FAF reaching the allowable limit of fluctuation and then being maintained at the allowable limit of fluctuation.

As shown in FIG. 18, in the second embodiment, the upper limit tK1 and the lower limit tK2 of the second set range are calculated from the amount of purge Q per unit time. This amount of purge Q is calculated by multiplying the duty ratio DPG of the purge control valve 17 with the full open purge amount PGQ. That is, as shown by the solid line in FIG. 20A, the full open purge amount PGQ becomes a function of the absolute pressure PM in the surge tank 5. The full open purge amount PGQ when the purge control valve 17 is fully opened increases the smaller the absolute pressure PM in the surge tank 5.

The absolute pressure PM in the surge tank 5 however is a function of the engine load QA/N (amount of intake air QA/engine speed N) and the engine speed N. Therefore, the full open purge amount PGQ becomes a function of the engine load QA and the engine speed N. In the second embodiment, the full open purge amount PGQ is stored in advance in the ROM 22 in the form of the map shown in FIG. 20B. The full open purge amount PGQ is calculated from the map. Next, the duty ratio DPG is multiplied with the full open purge rate PGQ to calculate the purge amount Q. Note that in FIG. 20A, the broken line shows the amount of purge Q when the duty ratio DPG is 40 percent.

Figure 21:
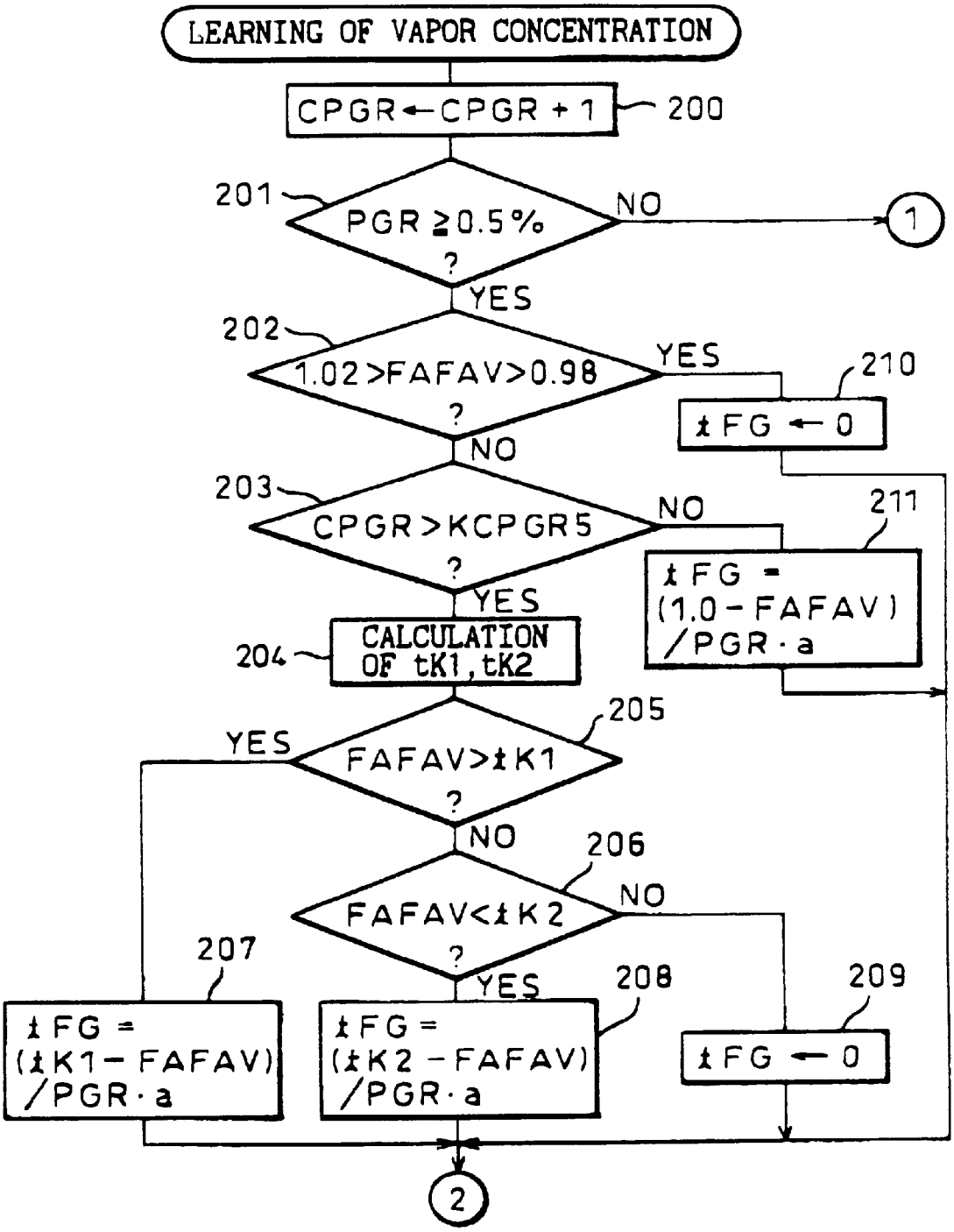
FIGS. 21 and 22 are flow charts of the learning of the vapor concentration used in a second embodiment.
Figure 22:
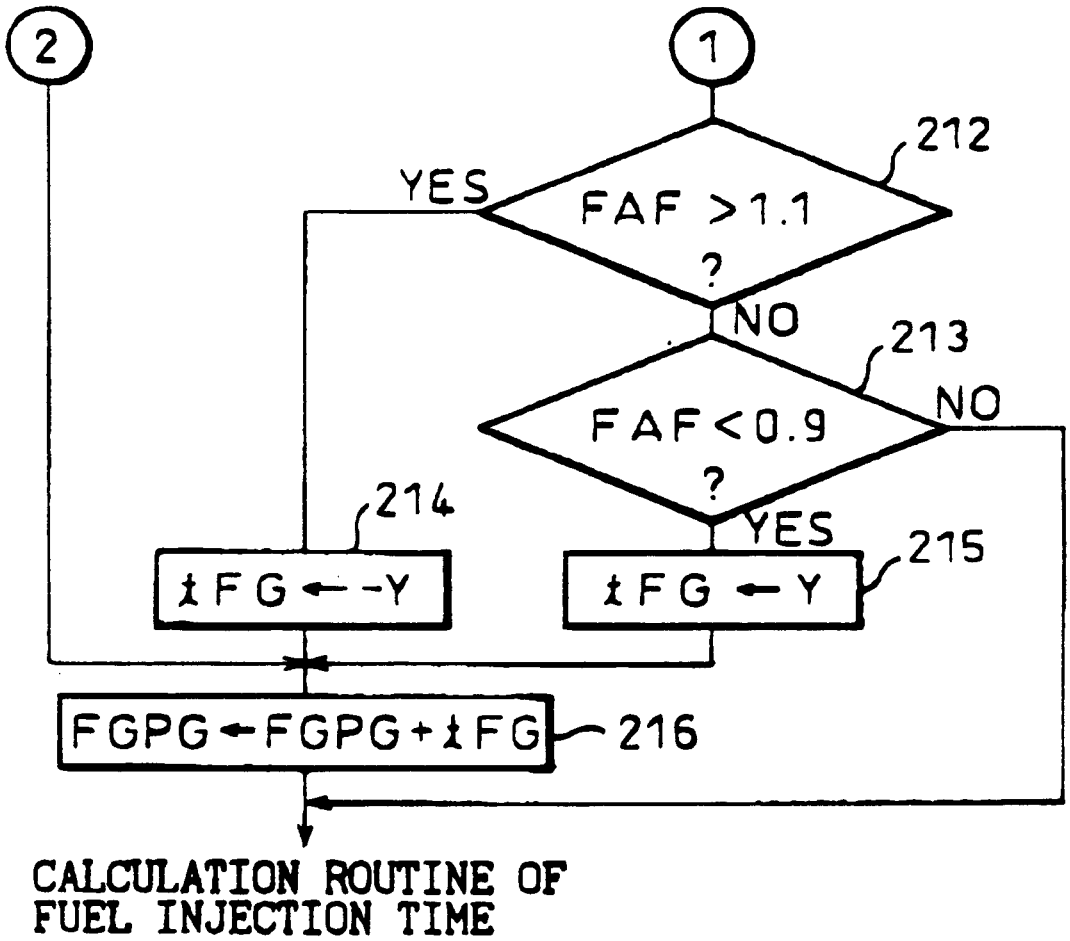

FIG. 21 and FIG. 22 show the routine for learning the vapor concentration for executing the second embodiment. Note that outside of the routine for learning the vapor concentration, the routines used in the first embodiment are used as they are.

Referring to FIG. 21 and FIG. 22, first, at step 200, the count CPGR of the purge execution time is incremented by 1. As explained above, the count CPGR of the purge execution time shows the cumulative time during which the purge operation was performed after the startup of the engine.

Next, at step 201, it is judged if the purge rate PGR is larger than 0.5 percent or not. When PGR≧0.5 percent, that is, other than when the purge rate PGR is extremely small, the routine proceeds to step 202, where it is judged if the average value FAFAV of the feedback control coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 210, where the update value tFG of the vapor concentration FGPG per unit purge rate is made zero, then the routine proceeds to step 216. Therefore, at this time, the vapor concentration FGPG is not updated.

On the other hand, when it is judged at step 202 that the average value FAFAV of the feedback control coefficient is outside of the first set range, that is, when FAFAV≧1.02 or FAFAV≦0.98, the routine proceeds to step 203, where it is judged if the count CPGR of the purge execution time is larger than the predetermined set value KCPGR5 or not. This set value KCPGR5 corresponds to about 5 minutes. Therefore, at stop 203, it is judged if the purge execution time has exceeded about 5 minutes. The region I shown in FIG. 3 is considered about 5 minutes. Therefore, at step 203, it is judged if the region is the region I or the region II of FIG. 3.

When CPGR≦KCPGR5, that is, when the region I of FIG. 3, the routine proceeds to step 211, where the update value t.FG of the vapor concentration FGPG is calculated based on the following equation:

$$tFG=(1.0-FAFAV)/PGR\cdot a$$

Here, a, as explained above, is 2. That is, in the region I of FIG. 3, when the average value FAFAV of the feedback control coefficient is outside of the first set range (between 0.98 and 1.02), half of the deviation of the FAFAV with respect to 1.0 is made the update value tFG. At this time, FAFAV is gradually returned to the first set range as shown in FIG. 4.

Figure 19:
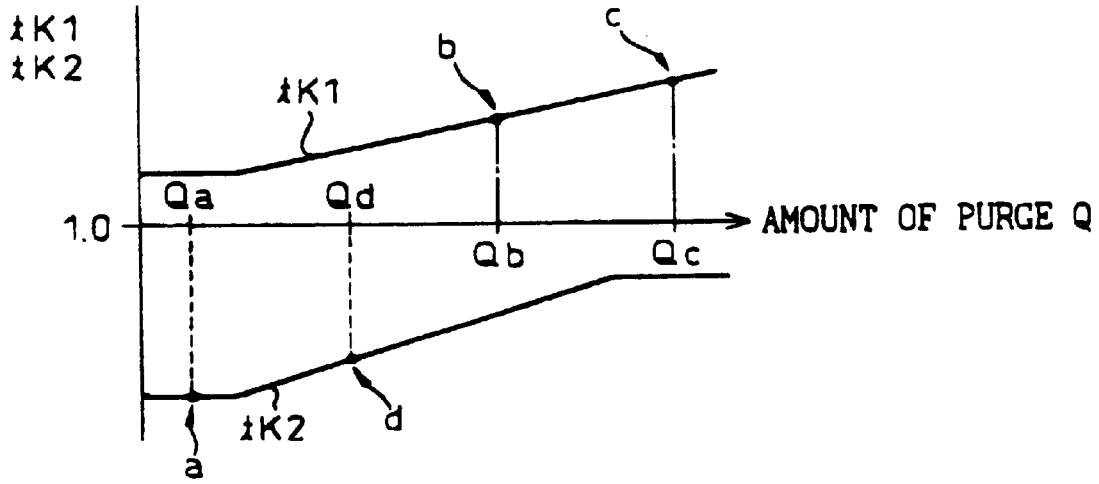
FIG. 19 is a view explaining the behavior of the feedback control coefficient FAF.
Figure 20A:
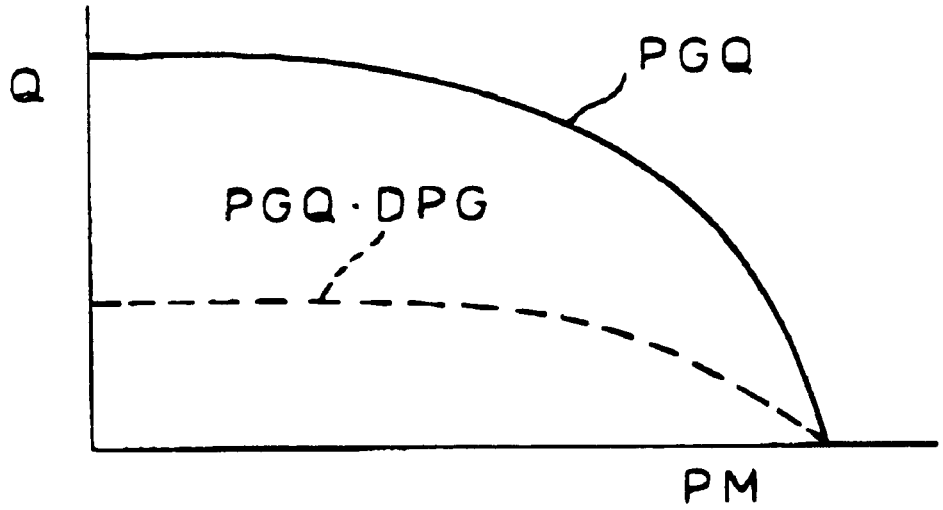
FIGS. 20A and 20B are views of the amount of purge.
Figure 20B:
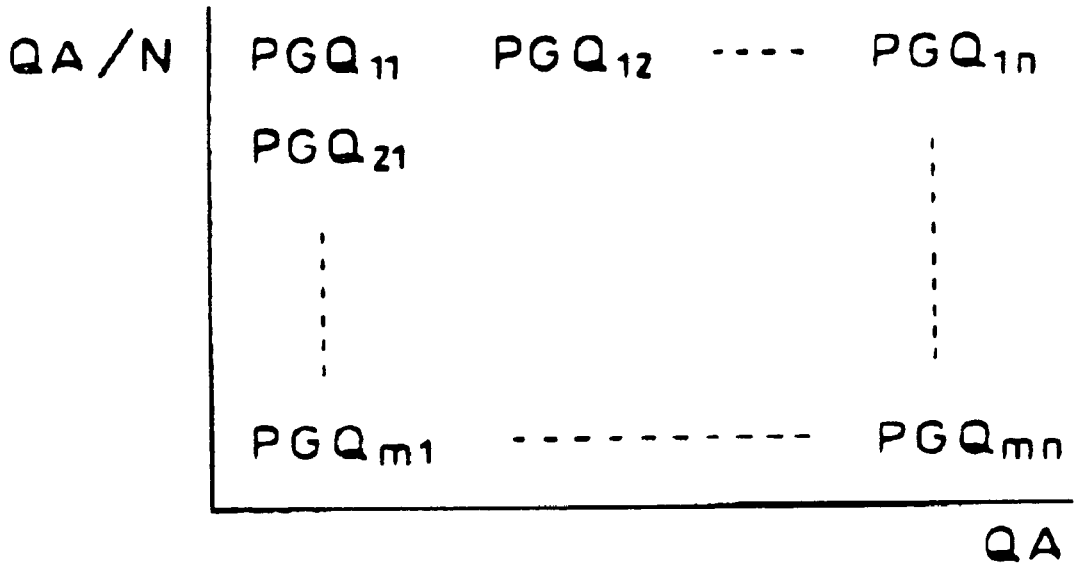

On the other hand, when it is judged at step 202 that CPGR>KCPGR5, that is, when the region is the region II of FIG. 3, the routine proceeds to step 204, where the amount of purge Q is calculated from the map shown in FIG. 20? and the duty ratio DPG and then the upper limit tK1 and the lower limit tK2 of the second set range according to the amount of purge Q are calculated based on the relation shown in FIG. 19. Next, from step 205 to step 209, when the average value FAFAV of the feedback control coefficient is outside the second range (between tK1 and tK2), half of the amount by which the second set range is exceeded is made the update value tFG of the vapor concentration FGPG.

That is, at step 205, it is judged if the average value FAFAV of the feedback control coefficient is smaller than the lower limit tK2 of the second set range. When FAFAV>tK1, the routine proceeds to step 208, where the update value tFG is calculated based on the following equation $$tFG=(tK1-FAFAV)/PGR\cdot a$$

Here, a is for example 2. That is, when FAFAV exceeds the upper value tK1 of the second set range, half of the difference of the upper limit tK1 and FAFAV is made the update value tFG. At this time, FAPAV is gradually returned to the upper limit tK1 of the second set range.

On the other hand, when it is judged at step 205 that FAFAV≦tK1, the routine proceeds to step 206, where it is judged if the average value FAFAV of the feedback control coefficient is smaller than the lower limit tK2 of the second set range shown in FIG. 18. When FAFAV<tK2, the routine proceeds to step 208, where the update value tFG is calculated based on the following formula.

$$tFG=(tK2-FAFAV)/PGR\cdot a$$

Here, a is for example 2. That is, when FAFAV becomes smaller than the lower value tK2 of the second set range, half of the difference of the lower limit tK2 and FAFAV is made the update value tFG. At this time, FAFAV is gradually returned to the lower limit tK2 of the second set range.

On the other hand, when it is judged at step 206 that FAFAV≧tK2, that is, when the average value FAFAV of the feedback control coefficient is in the second set range, the routine proceeds to step 209, where the update value tFG is made zero. Therefore, when FAFAV is in the second set range, the vapor concentration FGPG is not updated.

If the update value tFG is calculated at step 207, 208, 209, 210, or 211, the routine proceeds to step 216, where the update value tFG is added to the vapor concentration FGPG. Next, the routine proceeds to the routine for calculation of the fuel injection time shown in FIG. 17.

On the other hand, when it is judged at step 201 that PGR<0.5 percent, the routine proceeds to step 212, where it is judged if the feedback control coefficient FAF is larger than 1.1. When FAF>1.1, the routine proceeds to step 214, where the update value tFG is made the constant value −Y, then the routine proceeds to step 216. On the other hand, when it is judged at step 212 that FAF≦1.1, the routine proceeds to step 213, where it is judged if the feedback control coefficient FAF is smaller than 0.9 or not. When FAF<0.9, the routine proceeds to step 215, where the update value tFG is made the constant value Y, then the routine proceeds to step 216. When it is judged at stop 213 that FAF≧0.9, the routine proceeds to the routine for calculation of the fuel injection time shown in FIG. 17.

Figure 23:
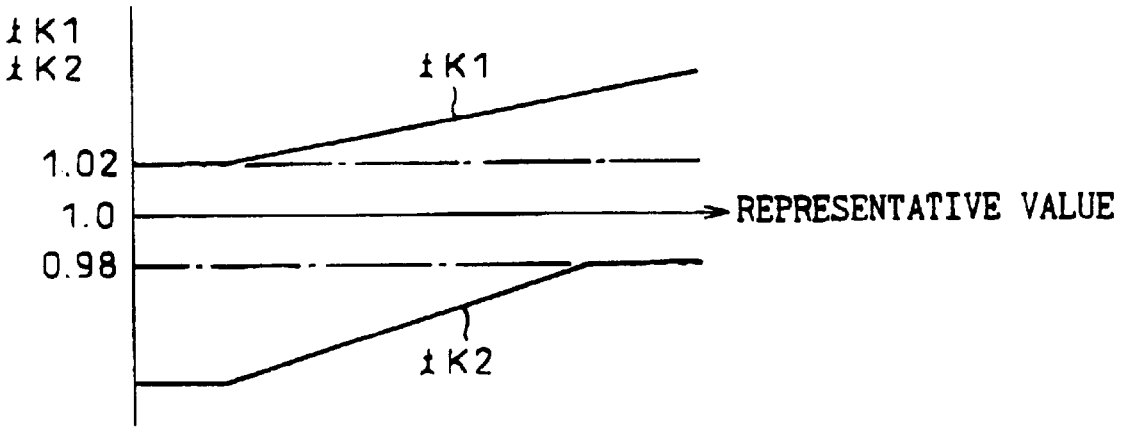
FIG. 23 is a view of an upper limit tK1 and a lower limit tX2 of a second set range.

In the embodiment shown in FIG. 18, the upper limit tK1 and the lower limit tX2 of the second set range is changed in accordance with the amount of purge Q. In this case, an shown in FIG. 23, it is possible to use a representative value representing the amount of purge Q instead of the amount of purge Q. In this case, as shown in FIG. 23, the upper limit tK1 of the second set range becomes larger the larger the representative value with respect to the upper limit 1.02 of the first set range, while the lower limit tK2 of the second set range becomes smaller the smaller the representative value with respect to the lower limit 0.98 of the first set range.

As a representative value of the amount of purge Q. use may be made of at least one of the amount of intake air, the absolute pressure in the surge tank 5, the duty ratio of the purge control valve 17, the amount of fuel injection, and the opening degree of the throttle valve 9.

Figure 24:
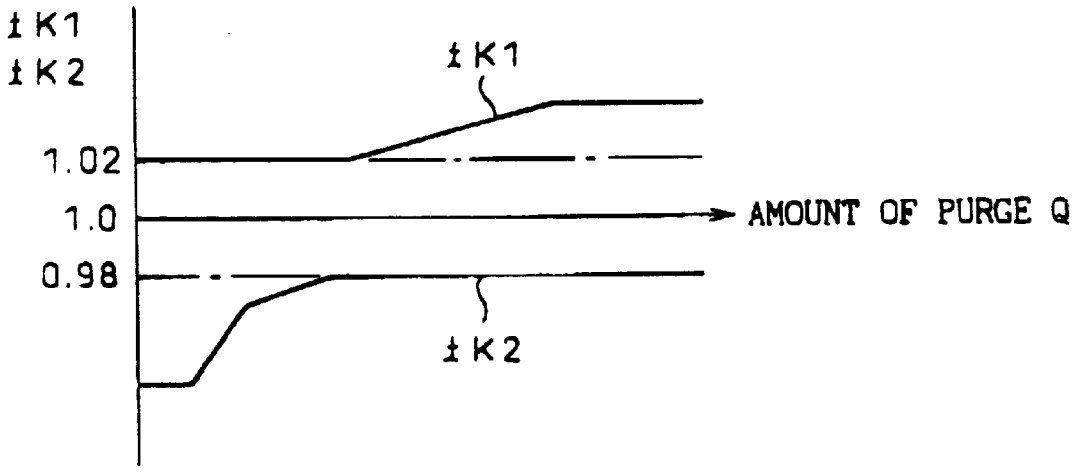
FIG. 24 is a view of an upper limit tK1 and a lower limit tK2 of a second set range.
Figure 25:
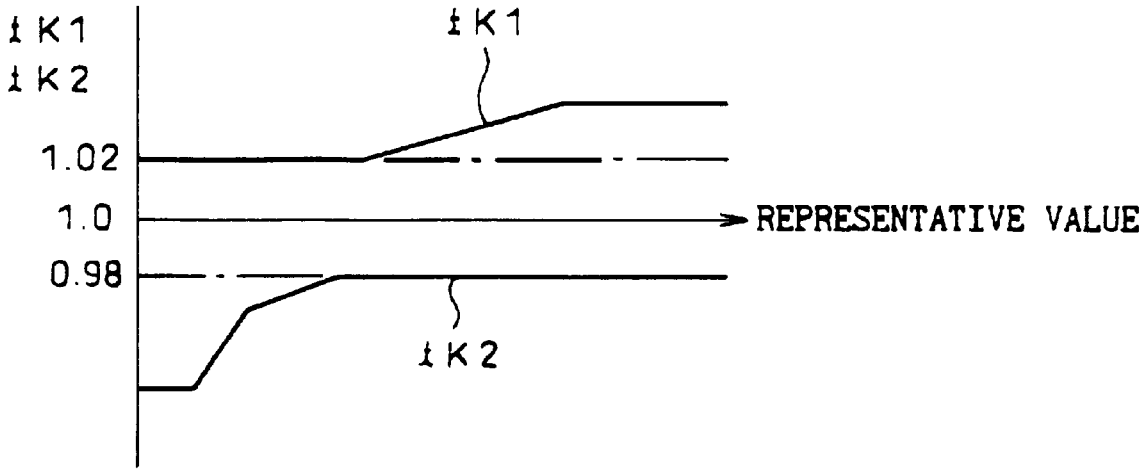
FIG. 25 is a view of an upper limit tK1 and a lower limit tK2 of a second set range.

FIG. 24 shows an example of the changing the method of change of the upper limit tK1 and the lower limit tK2 of the second set range with respect to the amount of purges Q. FIG. 25 shows the case of use of the representative value in place of the amount of purge Q of FIG. 24. As the representative value, use may be made of at least one of the amount of intake air, the absolute pressure in the surge tank 5, the duty ratio of the purge control valve 17, the amount of fuel injection, and the opening degree of the throttle valve 9.

Figure 26:
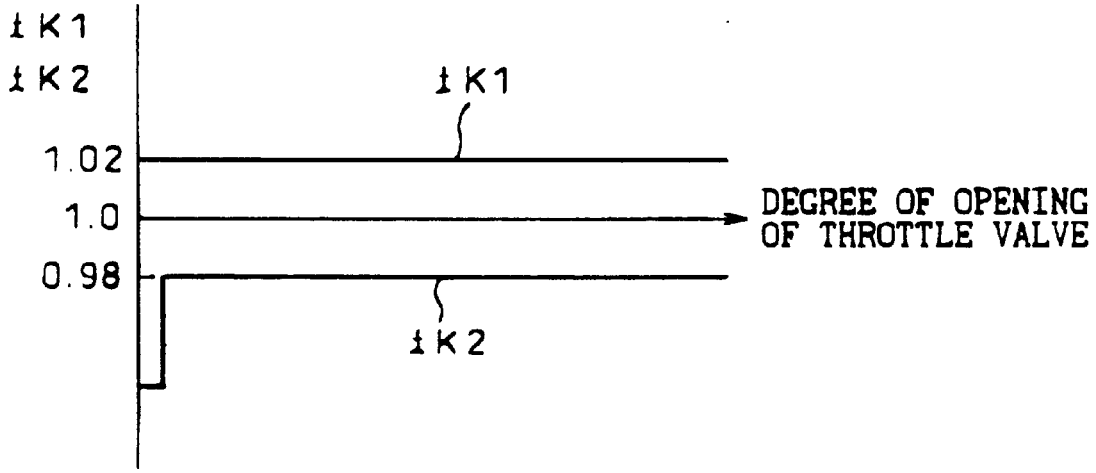
FIG. 26 is a view of an upper limit tK1 and a lower limit tX2 of a second set range.

FIG. 26 shows a special example where the lower limit tK2 is made smaller than the lower limit of the first set range only when the throttle valve 9 is in the idling position.

Next, an explanation will be made of a third embodiment where it is judged if the region is the region I or the region II shown in FIG. 3 from the number of times of the updating action of the purge A/? correction coefficient FPG. That is, when the purge action is started after the engine startup, the updating action of the purge A/F correction coefficient FPG, that is, the updating action of the vapor concentration FGPG, is performed. In this case, when the number of times of the updating action of the vapor concentration FGPG exceeds a substantially constant number, there has been a shift from the region I shown in FIG. 3 to the region II. Therefore, in the third embodiment, the count CFGPG of the number of updates is incremented each time the updating action of the vapor concentration FGPG is performed. When the count CFCPG of the number of updates exceeds the predetermined value KCFGPG, it is judged that there has been a shift from the region I shown in FIG. 3 to the region II.

Figure 27:
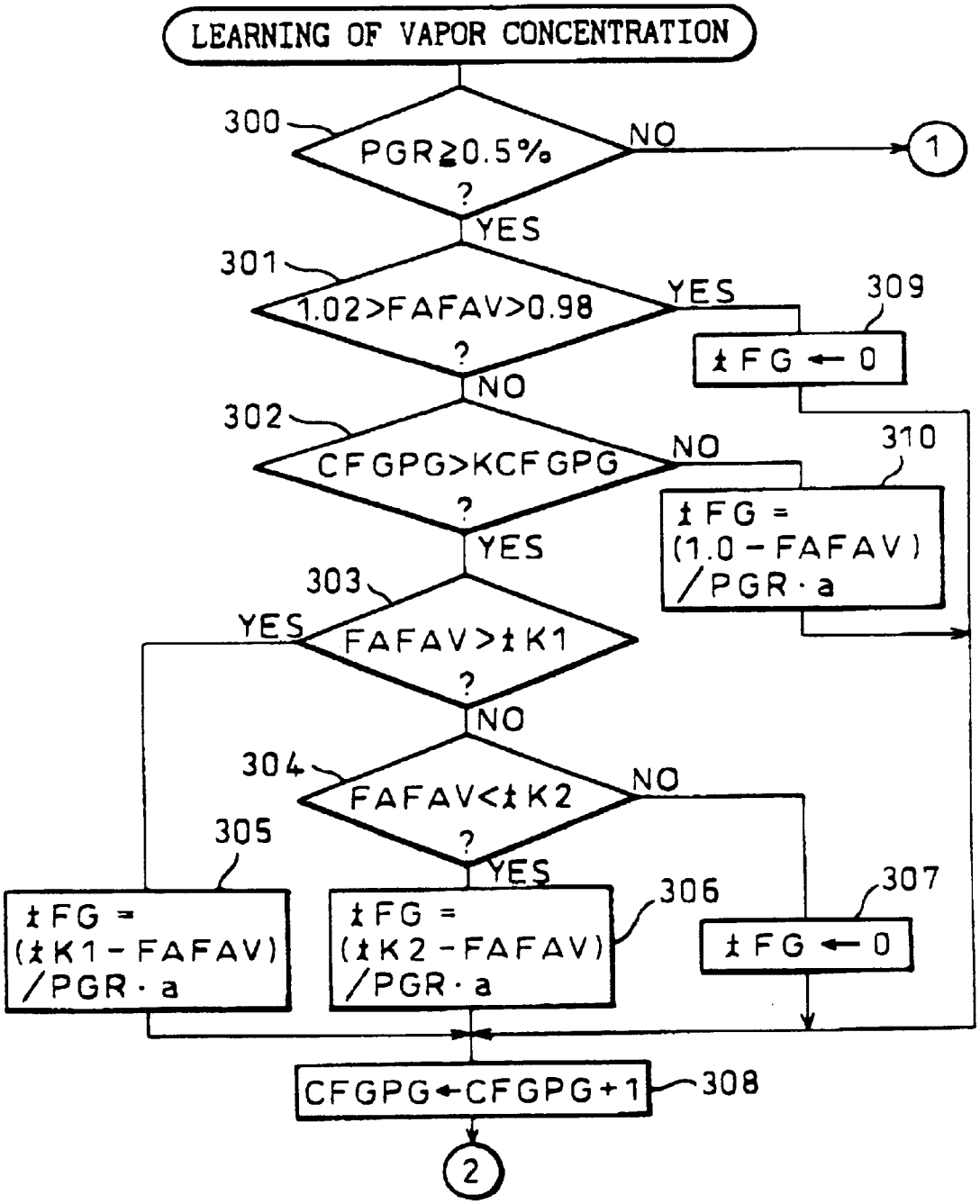
FIGS. 27 and 28 are flow charts of the learning of the vapor concentration used in a third embodiment.
Figure 28:
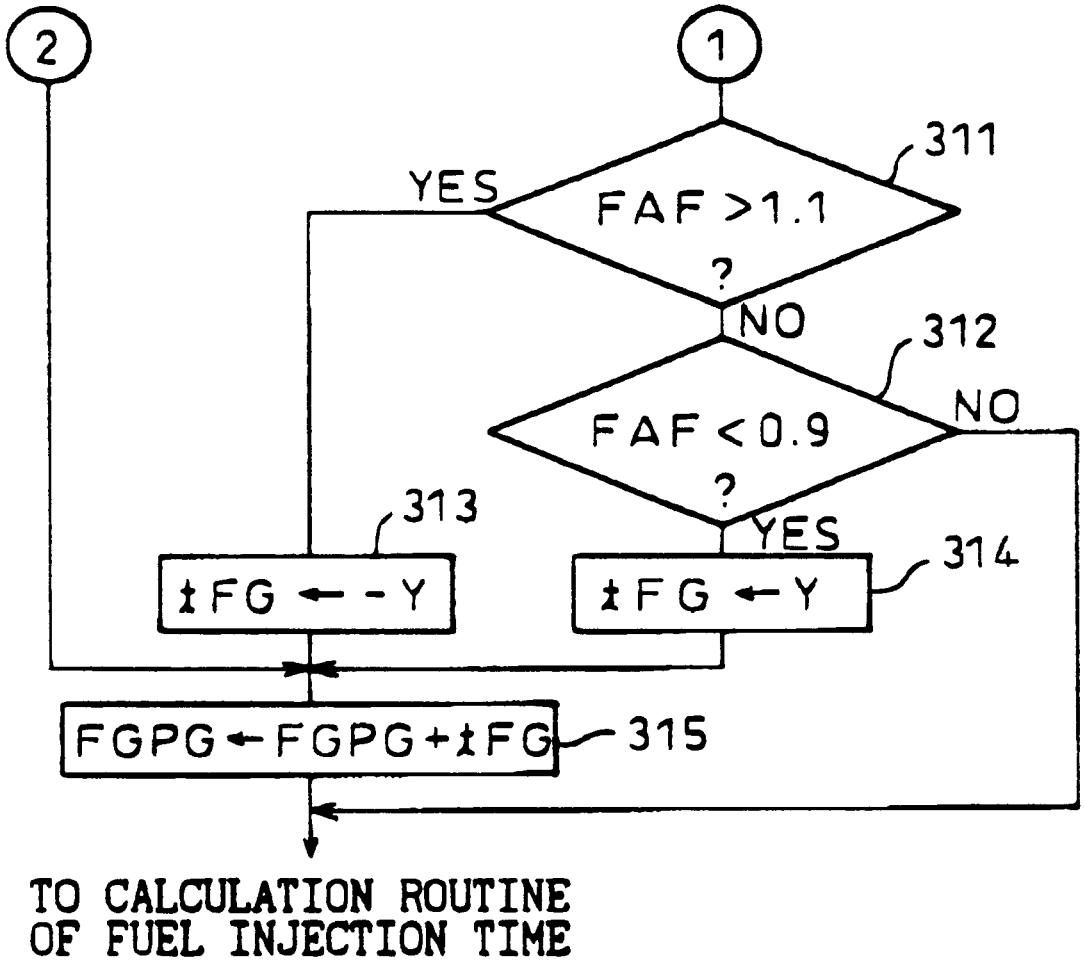

FIG. 27 and FIG. 28 show a routine for learning of a vapor concentration for working this third embodiment. Note that the routines other than the routine for learning of the vapor concentration are the game routines used in the first embodiment.

Figure 29:
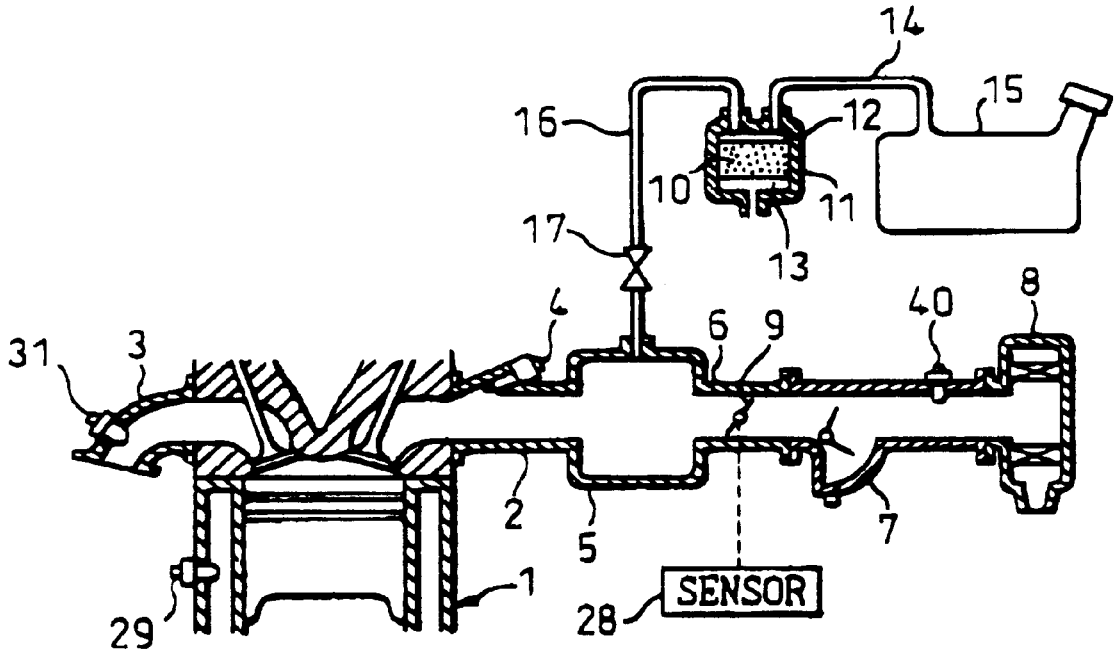
FIG. 29 is an overview of an internal combustion engine used in the third embodiment.

Referring to FIG. 27 and FIG. 29, first, at step 300, it is judged if the purge rate PGR is larger than 0.5 percent or not. When PGR≧0.5 percent, that is, except when the purge rate PGR is extremely small, the routine proceeds to step 301, where it is judged if the average value FAFAV of the feedback control coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 309, where the update value tFG of the vapor concentration FGPG per unit purge rate is made zero, then the routine proceeds to step 308. Therefore, at this time, the vapor concentration FGPG is not updated.

On the other hand, when it is judged at step 301 that the average value FAFAV of the feedback control coefficient is outside of the first set range, that is, when FAFAV≧1.02 or FAFAV≦0.98, the routine proceeds to step 302, where it is judged if the count CPGR of number of updates is larger than the predetermined value KCFGPG or not. When CPGR≦KCFGPG, that is, when the region I of FIG. 3, the routine proceeds to step 310, where the update value tFG of the vapor concentration FGPG is calculated based on the following equation:

$$tFG=(1.0-FAFAV)/PGR\cdot a$$

Here, a, as explained above, is 2. That is, in the region I of FIG. 3, when the average value FAFAV of the feedback control coefficient is outside of the first set range (between 0.98 and 1.02), half of the deviation of the FAFAV with respect to 1.0 is made the update value tFG. At this time, FAFAV is gradually returned to the first set range as shown in FIG. 4.

On the other hand, when it is judged at step 302 that CPGR>KCPGR5, that is, when the region is the region II of FIG. 3, the routine proceeds to step 303. From step 303 to step 307, when the average value FAFAV of the feedback control coefficient is outside the second range (between tK1 and tK2), half of the amount by which the second set range is exceeded is made the update value tFG of the vapor concentration FGPG.

That is, at step 303, it is judged if the average value FAFAV of the feedback control coefficient is larger than the upper limit tK1 of the second set range. When FAFAV>tK1, the routine proceeds to step 305, where the update value tFG is calculated based on the following equation:

$$tFG=(tK1-FAFAV)/PGR\cdot a$$

Here, a is for example 2. That is, when FAFAV exceeds the upper value tK1 of the second set range, half of the difference of the upper limit tK1 and FAFAV is made the update value tFG. At this time, FAFAV is gradually returned to the upper limit tK1 of the second set range.

On the other hand, when it is judged at step 303 that FAFAV≦tK1, the routine proceeds to step 304, where it is judged if the average value FAFAV of the feedback control coefficient is smaller than the lower limit tK2 of the second set range. When FAFAV<tK2, the routine proceeds to stop 306, where the update value tPG is calculated based on the following formula.

$$tFG=(tK2-FAFAV)/PGR\cdot a$$

Here, a is for example 2. That is, when FAFAV becomes smaller than the lower value tK2 of the second set range, half of the difference of the lower limit tK2 and FAFAV is made the update value tFG. At this time, FAFAV is gradually returned to the lower limit tK2 of the second set range.

On the other hand, when it is judged at step 304 that FAFAV≧tK2, that is, when the average value FAFAV of the feedback control coefficient is in the second set range, the routine proceeds to step 307, where the update value tFG is made zero. Therefore, when FAFAV is in the second set range, the vapor concentration FGPG is not updated.

If the update value tFG is calculated at step 305, 306, 307, 309, or 310, the routine proceeds to step 308, where the count CFGPG of the number of updates is incremented by 1. Next, at step 315, the update value tFG is added to the vapor concentration FGPG. Next, the routine proceeds to the routine for calculation of the fuel injection time shown in FIG. 17.

On the other hand, when it is judged at step 300 that PGR<0.5 percent, the routine proceeds to step 311, where it is judged if the feedback control coefficient FAF is larger than 1.1. When FAF>1.1, the routine proceeds to step 313, where the update value tFG is made the constant value −Y, then the routine proceeds to step 315. On the other hand, when it is judged at step 311 that FAF≦1.1, the routine proceeds to step 312, where it is judged if the feedback control coefficient FAF is smaller than 0.9 or not. When FAF<0.9, the routine proceeds to step 314, where the update value tFG is made the constant value Y, then the routine proceeds to step 315. When it is judged at step 312 that FAF≧0.9, the routine proceeds to the routine for calculation of the fuel injection time shown in FIG. 17.

Next, an explanation will be made of a fourth embodiment in which the timing for changing from the first set range to the second set range is changed according to the atmospheric temperature with reference to FIG. 29 and FIG. 30. When the atmospheric temperature becomes higher, the time until a large amount of evaporated fuel is produced in the fuel tank 15 after engine startup becomes shorter, therefore, the higher the atmospheric temperature becomes, the faster the timing for changing from the first set range to the second set range must be made. Therefore, in the fourth embodiment, an intake air temperature sensor 40 is provided in the intake passage as shown in FIG. 29 so as to detect the atmospheric temperature, that is, the intake air temperature, and the first set range is switched to the second set range when the count CPGR of the purge execution time exceeds a set value tKC comprised of a function of the intake air temperature.

Figure 30:
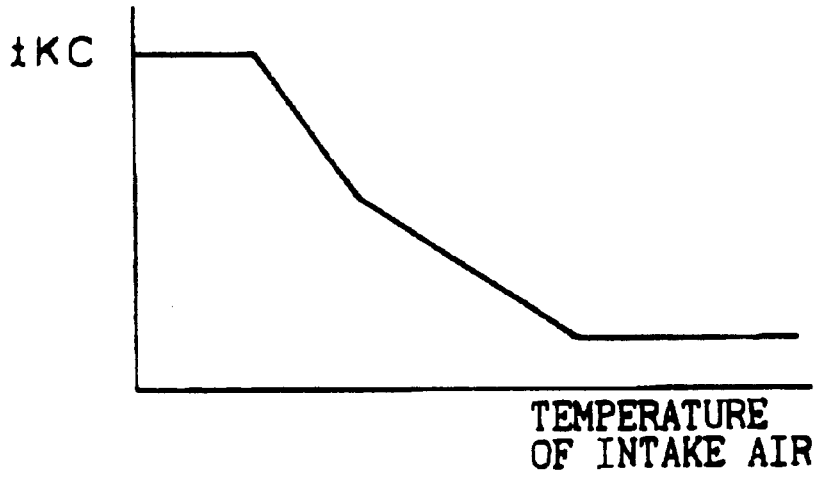
FIG. 30 is a view of the set value tKC.

The set value tKV becomes smaller the higher the intake air temperature as shown in FIG. 30. Therefore, the higher the intake air temperature, the earlier the timing of changing from the first set range to the second set range.

Figure 31:
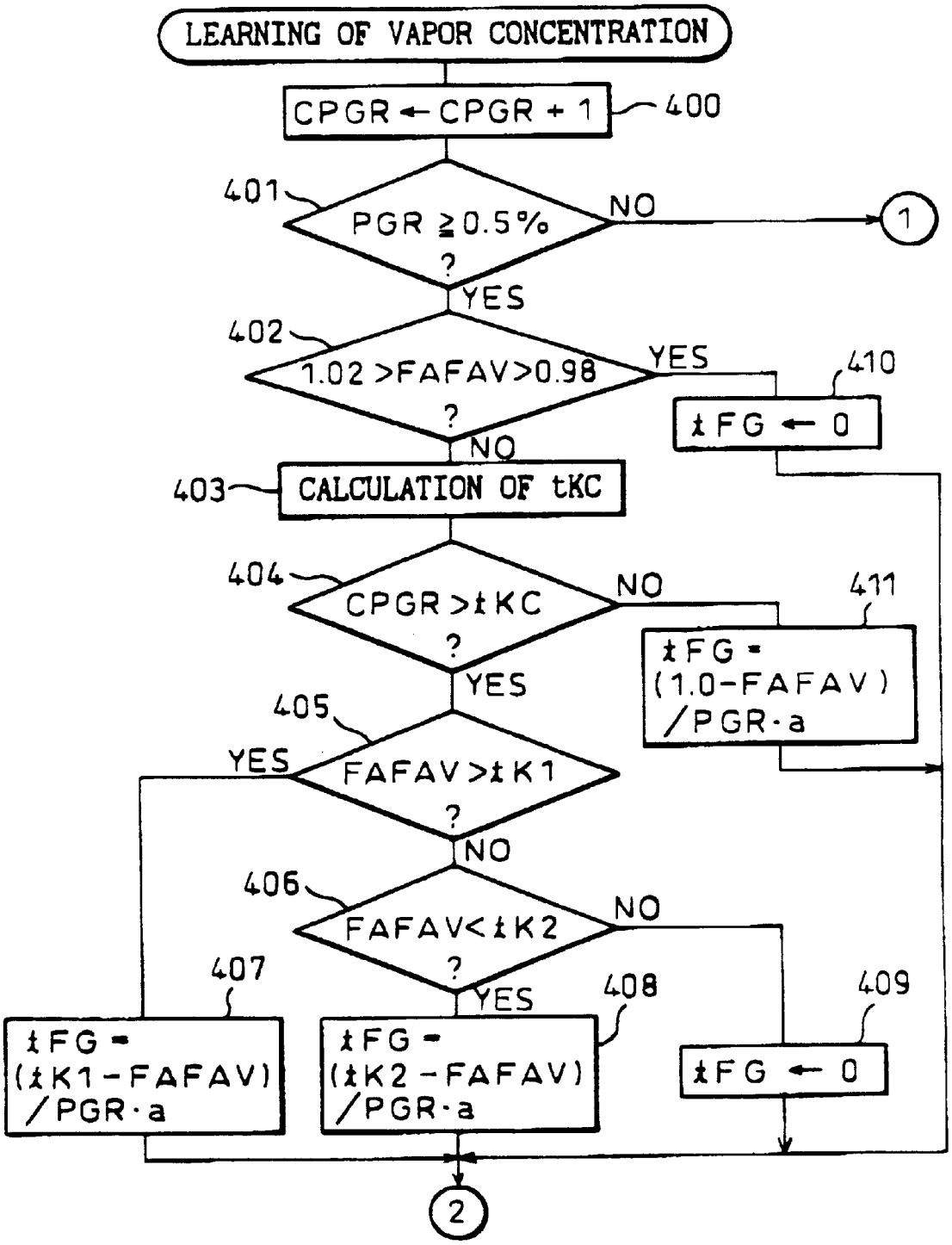
FIGS. 31 and 32 are flow charts of the learning of the vapor concentration used in a fourth embodiment.
Figure 32:
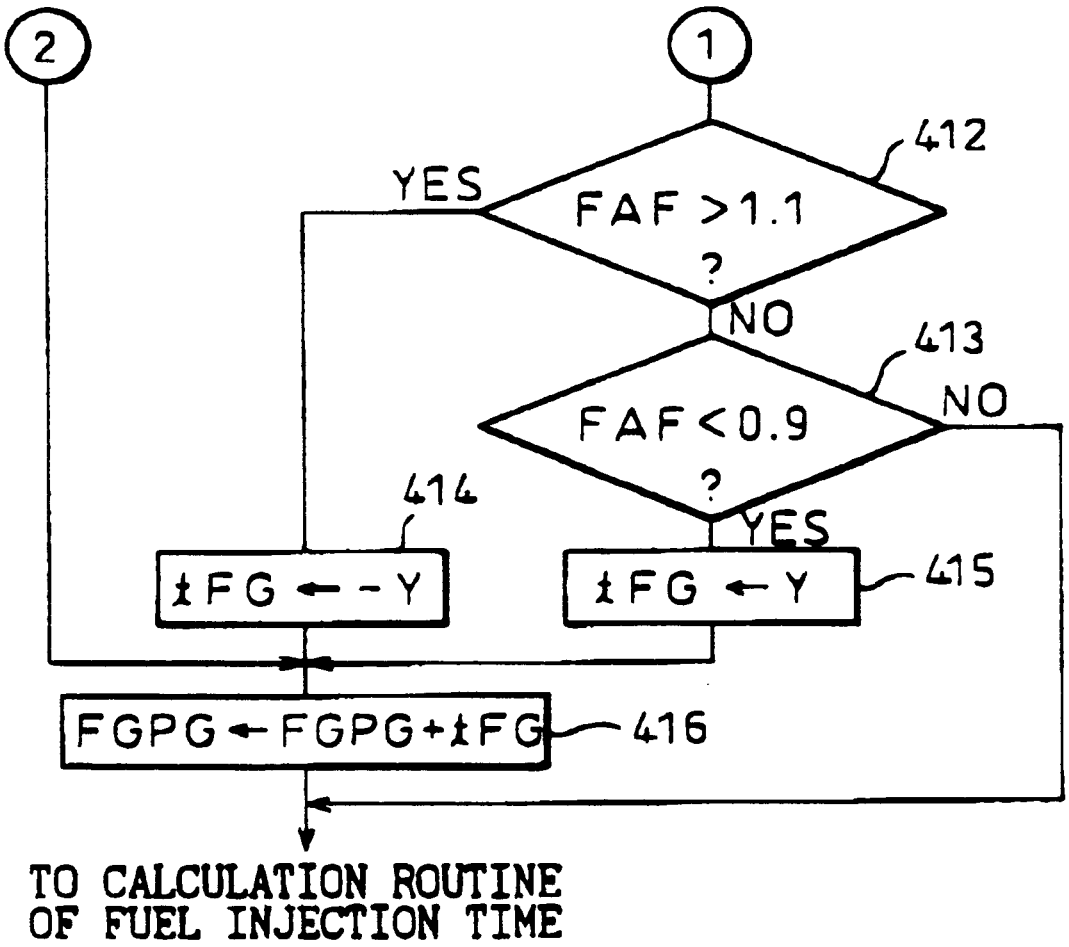

FIG. 31 and FIG. 32 show the routine for learning of the vapor concentration for working the fourth embodiment. Note that the routines other than the routine for learning of the vapor concentration are the same as those used in the first embodiment.

Referring to FIG. 31 and FIG. 32, first, at step 400, the count CPGR of the purge execution time is incremented by 1. As explained above, the count CPGR of the purge execution time shows the cumulative time during which the purse action was performed after engine startup.

Next, at step 401, it is judged if the purge rate PGR is larger than 0.5 percent or not. When FGR a 0.5 percent, that is, except when the purge rate PGR is extremely small, the routine proceeds to step 402, where it is judged if the average value FAFAV of the feedback control coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 410, where the update value tFG of the vapor concentration FGPG per unit purge rate is made zero, then the routine proceeds to step 416. Therefore, at this time, the vapor concentration FGPG is not updated.

On the other hand, when it is judged at step 402 that the average value FAFAV of the feedback control coefficient is outside of the first set range, that is, when FAFAV≧1.02 or FAFAV≦0.98, the routine proceeds to step 403, where the set value tKC based on the intake air temperature is calculated from the relationship shown in FIG. 30. Next, at step 404, it is judged if the count CPGR of the purge execution time is larger than the set value tKC or not. When CPGR≦tKC, that is, when the region I of FIG. 3, the routine proceeds to step 411, where the update value tFG of the vapor concentration FGPG is calculated based on the following equation:

$$tFG=(1.0-FAFAV)/PGR\cdot a$$

Here, a, as explained above, is 2. That is, in the region I of FIG. 3, when the average value FAFAV of the feedback control coefficient is outside of the first set range (between 0.98 and 1.02), half of the deviation of the FAFAV with respect to 1.0 is made the update value tFG. At this time, FAFAV is gradually returned to the first Bet range as shown in FIG. 4.

On the other hand, when it is judged at step 404 that CPGR>tKC, that is, when the region is the region II of FIG. 3, the routine proceeds to step 405. From step 405 to step 439, when the average value FAFAV of the feedback control coefficient is outside the second range (between tK1 and tK2), half of the amount by which the second set range is exceeded is made the update value tFG of the vapor concentration FGPG.

That is, at step 405, it is judged if the average value FAFAV of the feedback control coefficient is larger than the upper limit tKl of the second set range. When FAFAV>tK1, the routine proceeds to step 407, where the update value tFG is calculated based on the following equation:

$$tFG=(tK1-FAFAV)/PGR\cdot a$$

Here, a is for example 2. That is, when FAFAV exceeds the upper value tK1 of the second set range, half of the difference of the upper limit tK1 and FAFAV is made the update value tFG. At this time, FAFAV is gradually returned to the upper limit tK1 of the second set range.

On the other hand, when it is judged at step 405 that FAFAV≦tK1, the routine proceeds to step 406, where it is judged if the average value FAFAV of the feedback control coefficient is smaller than the lower limit tK2 of the second set range. When FAFAV<tK2, the routine proceeds to step 408, where the update value tFG is calculated based on the following formula.

$$tFG=(tK2-FAFAV)/PGR\cdot a$$

Here, a is for example 2. That is, when FAFAV becomes smaller than the lower value tK2 of the second set range, half of the difference of the lower limit tK2 and FAFAV is made the update value tFG. At this time, FAFAV is gradually returned to the lower limit tK2 of the second set range.

On the other hand, when it is judged at step 406 that FAFAV≧tK2, that is, when the average value FAFAV of the feedback control coefficient is in the second set range, the routine proceeds to step 409, where the update value tFG is made zero. Therefore, when FAFAV is in the second set range, the vapor concentration FGPG is not updated.

If the update value tFG is calculated at step 407, 408, 409, 410, or 411, the routine proceeds to step 416, where the update value tFG is added to the vapor concentration FGPG. Next, the routine proceeds to the routine for calculation of the fuel injection time shown in FIG. 17.

On the other hand, when it is judged at step 401 that PGR<0.5 percent, the routine proceeds to step 412, where it is judged if the feedback control coefficient FAF is larger than 1.1. When FAF>1.1, the routine proceeds to step 414, where the update value tFG is made the constant value −Y, then the routine proceeds to step 416. On the other hand, when it is judged at step 412 that FAF≦1.1, the routine proceeds to step 413, where it is judged if the feedback control coefficient FAF is smaller than 0.9 or not. When FAF<0.9, the routine proceeds to step 415, where the update value tFG is made the constant value Y, then the routine proceeds to step 416. When it is judged at step 413 that FAF≧0.9, the routine proceeds to the routine for calculation of the fuel injection time shown in FIG. 17.

Next, an explanation will be made of a fifth embodiment where the first set range is changed to the second set range when the fact that the concentration of fuel vapor has exceeded a predetermined constant concentration is actually detected. When the feedback control coefficient FAF is maintained in the first set range such as in the region I shown in FIG. 3, if a large amount of evaporated fuel is produced in the fuel tank 15, when the throttle valve 9 is closed and the amount of intake air is reduced, the feedback control coefficient FAF will fall widely from the reference value, that is, 1.0. On the other hand, when the throttle valve 9 is opened wide from the closed state and the amount of intake air increases, the feedback control coefficient FAF will increase widely from the reference value, that is, 1.0. That is, when the throttle valve 9 is in the idling position, the feedback control coefficient FAF will fall widely from the reference value, while when the throttle valve 9 opens, the feedback control coefficient FAF will increase widely from the reference value. At these times, a large amount of evaporated fuel will be produced in the fuel tank 15.

Therefore, in the fifth embodiment, it is judged that a large amount of evaporated fuel has been produced in the fuel tank 5 when the average value FAFAV of the feedback control coefficient has become smaller than a set value, for example, 0.9, when the throttle valve 9 is in the idling position, and when the average value FAFAV of the feedback control coefficient has become larger than a set value, for example, 1.1, when the throttle valve 9 is opened. At this time, the first set range is changed to the second set range.

Figure 33:
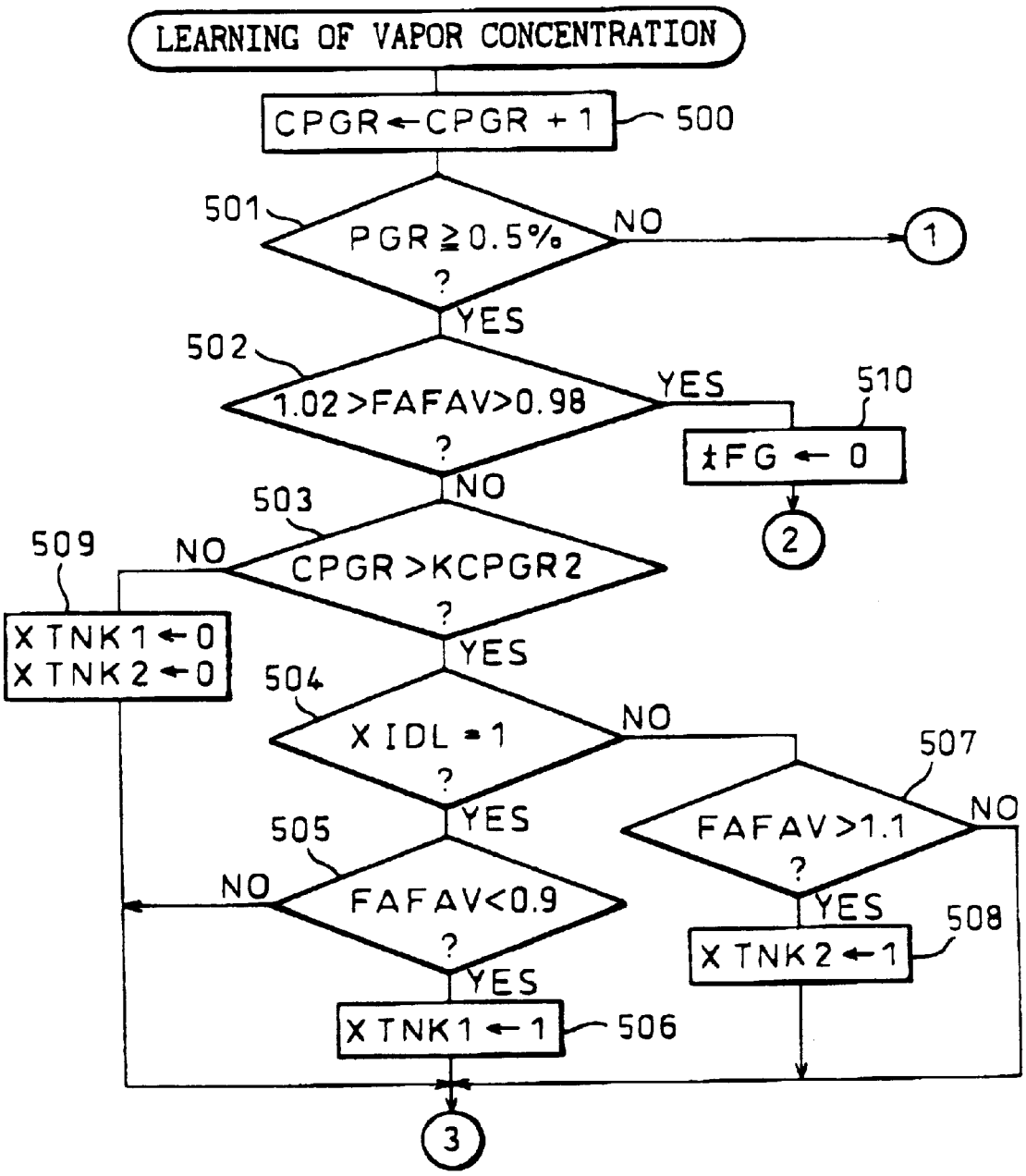
FIGS. 33 to 35 are flow charts of the learning of the vapor concentration used in a fifth embodiment.
Figure 34:
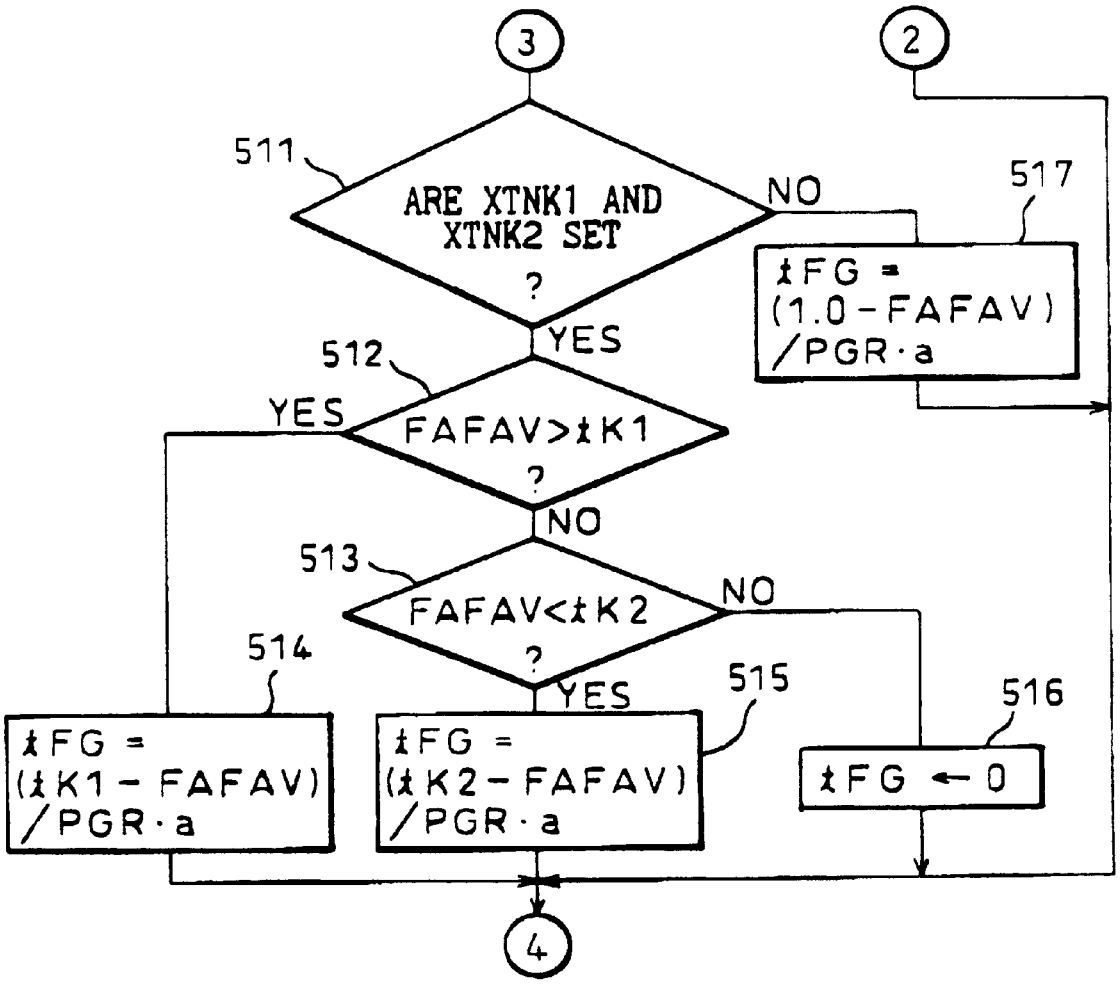
Figure 35:
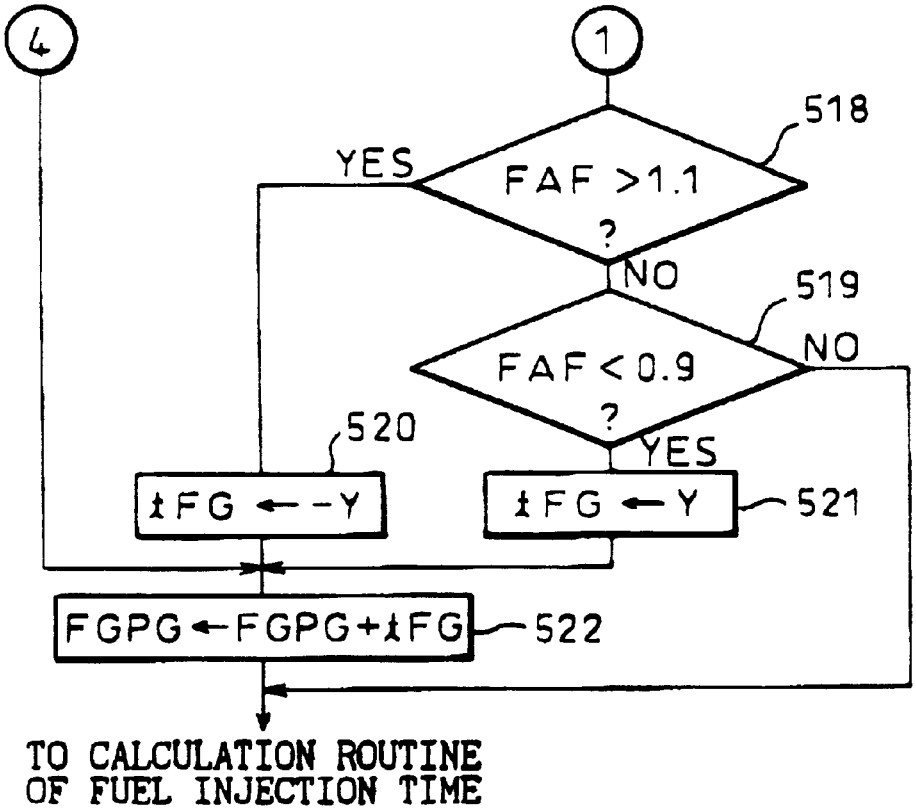

FIG. 33 to FIG. 35 show the routine for learning of the vapor concentration for working the fifth embodiment. Note that the routines other than the routine is for learning of the vapor concentration are the same as those used in the first embodiment.

Referring to FIG. 33 to FIG. 35, first, at step 500, the count CPGR of purge execution time is incremented by exactly 1. As explained above, the count CPGR of the purge execution time shows the cumulative time over which the purge action is performed after the engine startup.

Next, at step 501, it is judged if the purge rate PGR is larger than 0.5 percent or not. When PGR≧0.5 percent, that is, except when the purge rate PGR is extremely small, the routine proceeds to step 502, where it is judged if the average value FAFAV of the feedback control coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 510, where the update value tFG of the vapor concentration FGPG per unit purge rate is made zero, then the routine proceeds to step 522. Therefore, at this time, the vapor concentration FGPG is not updated.

On the other hand, when it is judged at step 502 that the average value FAFAV of the feedback control coefficient is outside of the first set range, that is, when FAFAV≧1.02 or FAFAV≦0.98, the routine proceeds to step 503, where it is judged if the count CPGR of the purge execution time is larger than the predetermined set value KCPGR2 or not. This set value KCPGR2 corresponds to about 2 minutes. Therefore, at step 503, it is judged if the purge execution time has exceeded about 2 minutes. When CPGR≦KCPGR2, that is, when the purge execution time is within about 2 minutes, the routine proceeds to step 509, where the flags XTNK1 and XTNK2 are reset, then the routine proceeds to step 511.

On the other hand, when it is judged at step 503 that CPGR>KCPGR2, that is, when the purge execution time is over about 2 minutes, the routine proceeds to step 504, where it is judged if the idling flag XIDL which is set at the time of idling operation is set (XIDL=1) or not. When the idling flag XIDL is set (XIDL=1), that is, at the time of idling operation, the routine proceeds to step 505, where it is judged if the average value FAFAV of the feedback control coefficient is smaller than 0.9 or not. When FAFAV≧0.9, the routine jumps to step 511. As opposed to this, when FAFAV<0.9, the routine proceeds to step 506, where the flag XTNK1 is set (XTNK1=1) and then the routine proceeds to step 511.

As opposed to this, when it is judged at step 504 that the idling flag XIDL is reset (XIDL=0), that is, when not an idling operation, the routine proceeds to step 507, where it is judged if the average value FAFAV of the feedback correction coefficient is larger than 1.1 or not. When FAFAV≦1.1, the routine jumps to step 511. As opposed to this, when FAFAV>1.1, the routine proceeds to stop 508, where the flag XTNK2 is set (XTNK2=1), then the routine proceeds to step 511.

At step 511, it is judged if both of the flag XTNK1 and the flag XTNK2 have been set or not, that is, if FAFAV<0.9 during an idling operation and FAFAV>1.1 other than during an idling operation. In other words, it is judged if a large amount of evaporated fuel is produced in the fuel tank 15 or not. When the flag XTNX1 and the flag XTNK2 are not both set, that is, when a large amount of evaporated fuel is not being produced in the fuel tank 15, the routine proceeds to step 517, where the update value tFG of the vapor concentration FGPG is calculated based on the following equation:

$$tFG=(1.0-FAFAV)/PGR\cdot a$$

Here, a is, for example, 2. At this time, if the average value FAFAV of the feedback correction coefficient exceeds the first set range (between 0.98 and 1.02), half of the deviation of the FAFAV with respect to 1.0 is made the update value tFG. Therefore, at this time, FAFAV is gradually returned to the first set range as shown In FIG. 4.

On the other hand, when it is judged at step 511 that both of the flag XTNK1 and the flag XTNK2 are set, that is, when a large amount of evaporated fuel is being produced in the fuel tank 15, the routine proceeds to step 512. Front step 512 to step 516, when the average value FAFAV of the feedback control coefficient is outside the second range (between tK1 and tK2), half of the amount by which the second set range is exceeded is made the update value tFG of the vapor concentration FGPG.

That is, at step 512, it is judged if the average value FAFAV of the feedback control coefficient is larger than the upper limit tK1 of the second set range. When FAFAV>tK1, the routine proceeds to step 514, where the update value tFG is calculated based on the following equation:

$$tFG-(tK1-FAFAV)/PGR\cdot a$$

Here, a is for example 2. That is, when FAFAV exceeds the upper value tK1 of the second set range, half of the difference of the upper limit tK1 and FAFAV is made the update value tFG. At this time, FAFAV is gradually returned to the upper limit tK1 of the second set range.

On the other hand, when it is judged at step 512 that FAFAV≦tK1, the routine proceeds to step 513, where it is judged if the average value FAFAV of the feedback control coefficient is smaller than the lower limit tK2 of the second fret range. When FAFAV<tK2, the routine proceeds to step 515, where the update value tFG is calculated based on the following formula.

$$tFG=(tK2-FAFAV)/PGR\cdot a$$

Here, a is for example 2. That is, when FAFAV becomes smaller than the lower value tK2 of the second set range, half of the difference of the lower limit tK2 and FAFAV is made the update value tFG. At this time, FAFAV is gradually returned to the lower limit tK2 of the second set range.

On the other hand, when it is judged at step 513 that FAFAV≧tK2, that is, when the average value FAFAV of the feedback control coefficient is in the second set range, the routine proceeds to step 516, where the update value tFG is made zero. Therefore, when FAFAV is in the second set range, the vapor concentration FGPG is not updated.

If the update value tFG is calculated at step 510, 514, 515, 516,, or 517, the routine proceeds to step 522, where the update value tFG is added to the vapor concentration FGPG. Next, the routine proceeds to the routine for calculation of the fuel injection time shown in FIG. 17.

On the other hand, when it is judged at step 501 that PGR<0.5 percent, the routine proceeds to step 518, where it is judged if the feedback control coefficient FAT is larger than 1.1. When FAF>1.1, the routine proceeds to step 520, where the update value tFG is made the constant value −Y, then the routine proceeds to step 522. On the other hand, when it is judged at step 518 that FAF≦1.1, the routine proceeds to step 519, where it is judged if the feedback control coefficient FAF is smaller than 0.9 or not. When FAF<0.9, the routine proceeds to step 521, where the update value tFG is made the constant value Y, then the routine proceeds to step 522. When it is judged at step 519 that FAF≧0.9, the routine proceeds to the routine for calculation of the fuel injection time shown in FIG. 17.

Next, an explanation will be made of a sixth embodiment in which it is judged if a large amount of evaporated fuel is being produced in the fuel tank 15 by actually measuring the pressure in the canister 11.

Figure 36:
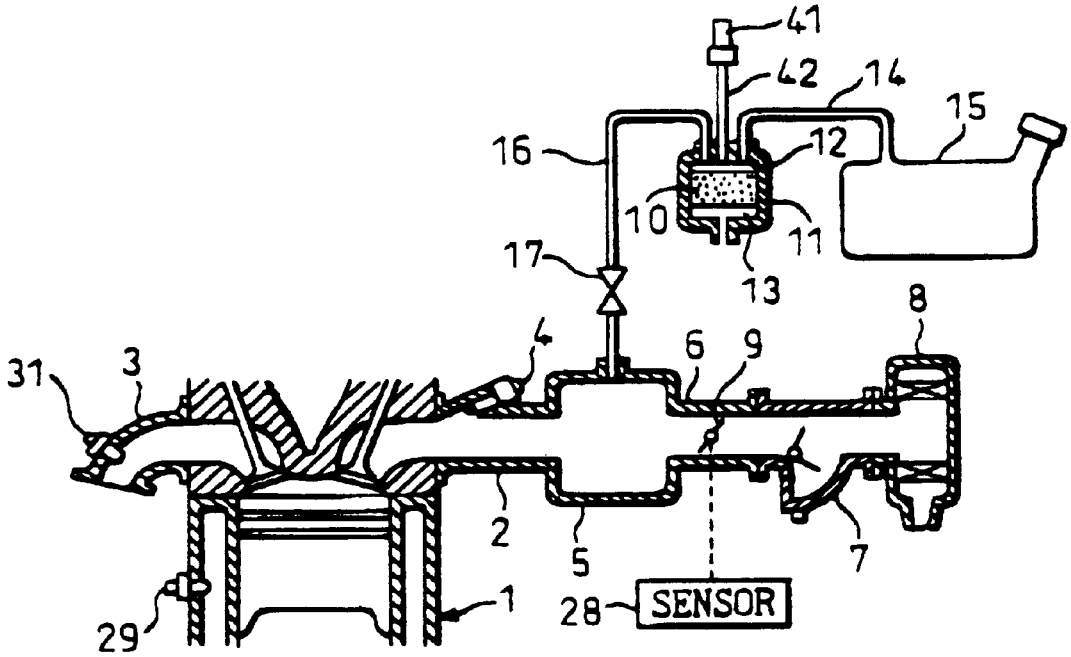
FIG. 36 is an overview of an internal combustion engine used in a sixth embodiment.

In the sixth embodiment, as shown in FIG. 36, a pressure sensor 41 is provided for detecting the pressure in the canister 11. The pressure sensor 41 detects the pressure in the fuel combustion chamber 12 through the conduit 42. In this case, if a large amount of evaporated fuel is being produced in the fuel tank 15, the pressure in the fuel vapor chamber 12 will rise, so it is possible to judge if a large amount of evaporated fuel is being produced in the fuel tank 15 from the pressure in the fuel vapor chamber 12. Therefore, in this embodiment of the present invention, when it is judged from the pressure in the fuel vapor chamber 12 that a large amount of evaporated fuel is being produced in the fuel tank 15, the large vapor production flag XPCN is set. When the large vapor production flag XPCN is set, the first set range is changed to the second set range.

Even when a large amount of evaporated fuel is being produced in the fuel tank 15, however, the pressure inside the fuel vapor chamber 12 differs between when the purge action is stopped and when the purge action is on going. Therefore, in this embodiment of the present invention, it is separately judged if a large amount of evaporated fuel is being produced in the fuel tank 15 between when the purge action is stopped and the purge action is on. going. Therefore, first, the method of judgement when the purge action is on going will be explained with reference to FIG. 37 and FIG. 38.

Figure 37:
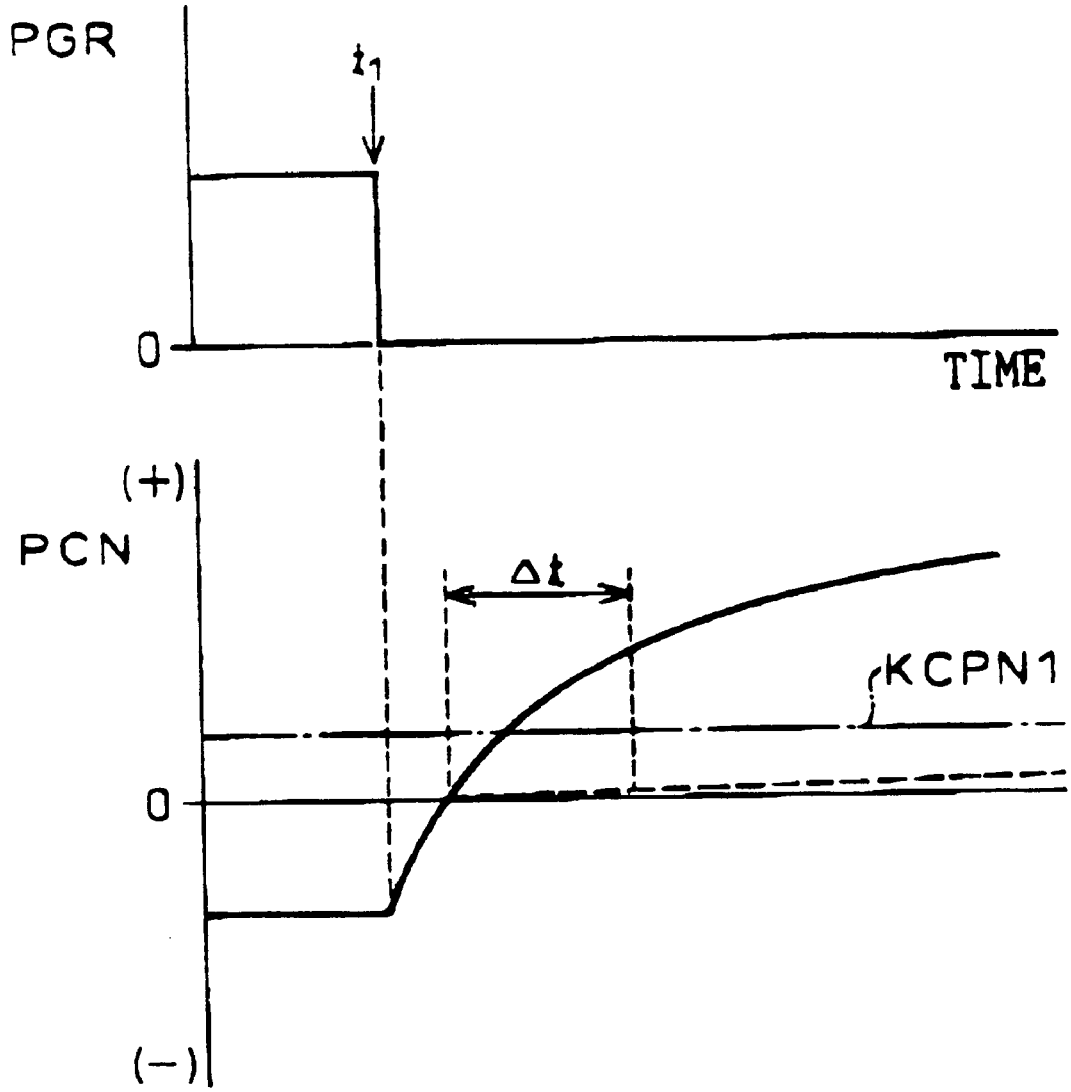
FIG. 37 is a view of changes in the pressure PCN in a fuel vapor chamber of a canister.

At FIG. 37, the purge action is being performed before the time tl. At this time, the pressure PCN in the fuel vapor chamber 12 is a vacuum. Next, at the time t1, when the purge rate PGR becomes zero, that is, when the purge action is stopped, the pressure PCN gradually rises. At this time, when a large amount of evaporated fuel is not being produced in the fuel tank 15, the pressure PCN is maintained at substantially atmospheric pressure as shown by the broken line in FIG. 37. As opposed to this, when a large amount of evaporated fuel is being produced in the fuel tank 15, the pressure PCN becomes positive and continues to rise as shown by the solid line and becomes higher than even the set value KCPN1. In this case, it is considered that the pressure PCN becomes stable when a predetermined time Δt passes from when the pressure PCN became positive. Therefore, in this embodiment of the present invention, after the predetermined time Δt passes from when the pressure PCN becomes positive, if the pressure PCN is higher than the set value KCPD1, it is judged that a large amount of evaporated fusel is being produced in the fuel tank 15 and the large vapor production flag XPCN1 is set.

Figure 38:
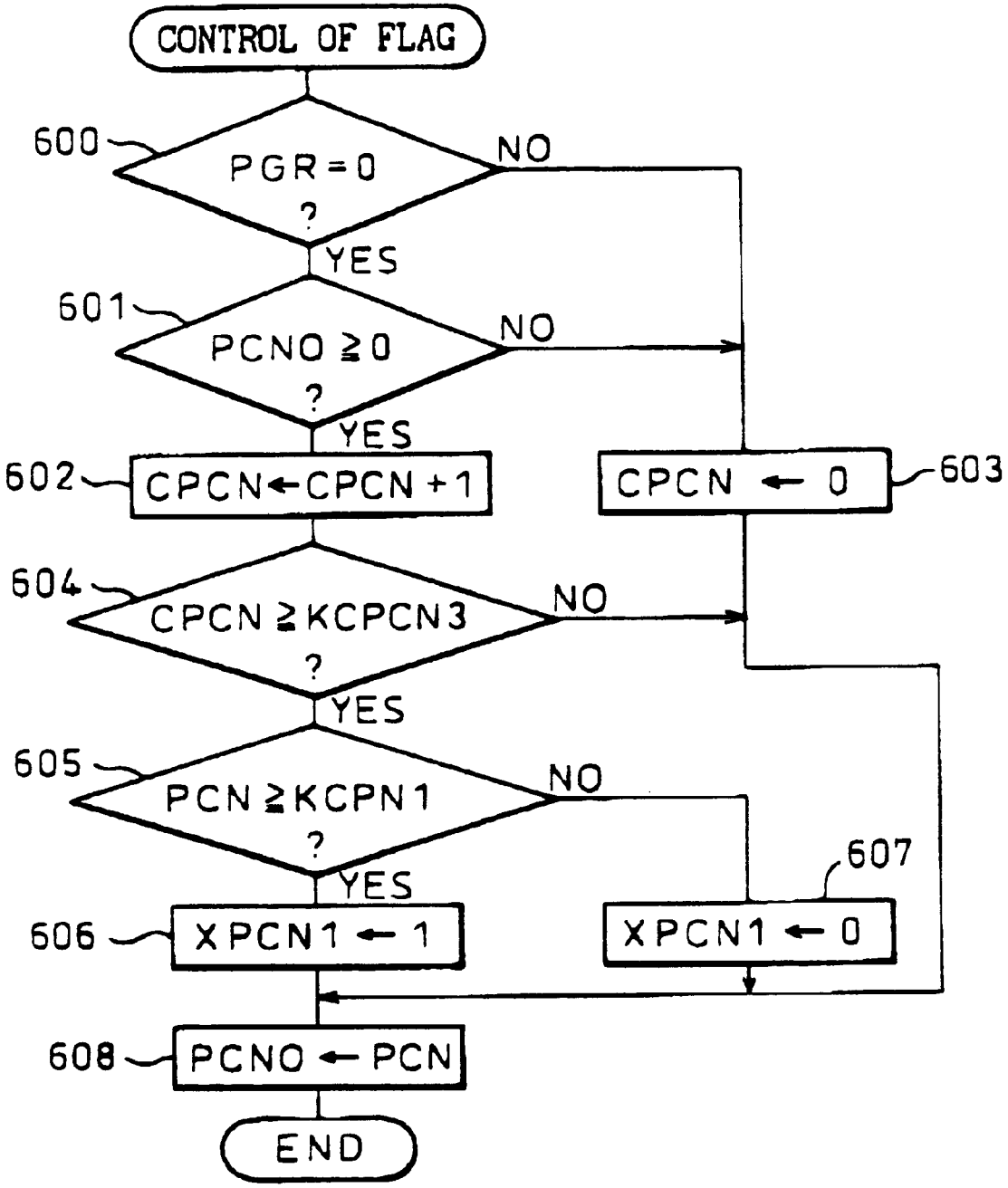
FIG. 38 is a flow chart of the control of a large vapor production flag.

FIG. 38 shows the routine for control of the large vapor production flag when the purge action is ongoing. This routine is executed by interruption at predetermined intervals.

Referring to FIG. 38, first, at step 600, it is judged if the purge rate PGR is zero or not, that is if the purge action has been stopped. If the purge rate PGR is not zero, that is, if the purge action is ongoing, the routine proceeds to step 603, where the count CPCN of the waiting time is made zero. Next, the routine proceeds to step 608, where the pressure PCN in the fuel vapor chamber 12 detected by the pressure sensor 41 is made PCN0. On the other hand, when the purge rate PGR is zero, that is, when the purge action is stopped, the routine proceeds to step 601, where it is judged if the pressure PCN0 in the fuel vapor chamber 12 at the time of the previous interruption was larger than zero. When PCN0<0, the routine proceeds to step 603, while when PCN0≧0, the routine proceeds to step 602.

At step 602, the count CPCN of the waiting time is incremented by 1, then at step 604, it is judged if the count CPCN of the waiting time is over the predetermined value KCPCN3 corresponding to the time 4t of FIG. 37. When CPCN<KCPCN3, the routine jumps to step 608, while when CPCN≧KCPCN3, the routine proceeds to step 605. At step 605, it is judged if the pressure PCN in the fuel vapor chamber 12 is higher than the set value KCPN1 shown in FIG. 37. When PCN<KCPN1, the routine proceeds to step 607, where the large vapor production flag XPCN1 is reset (XPCN1=0). As opposed to this, when PCN a KCPN1, the routine proceeds to step 606, where the large vapor production flag XPCN1 is set (XPCN1=1).

Next, an explanation will be made of the method of judgement when a purge action is ongoing referring to FIG. 39 and FIG. 40

Figure 39:
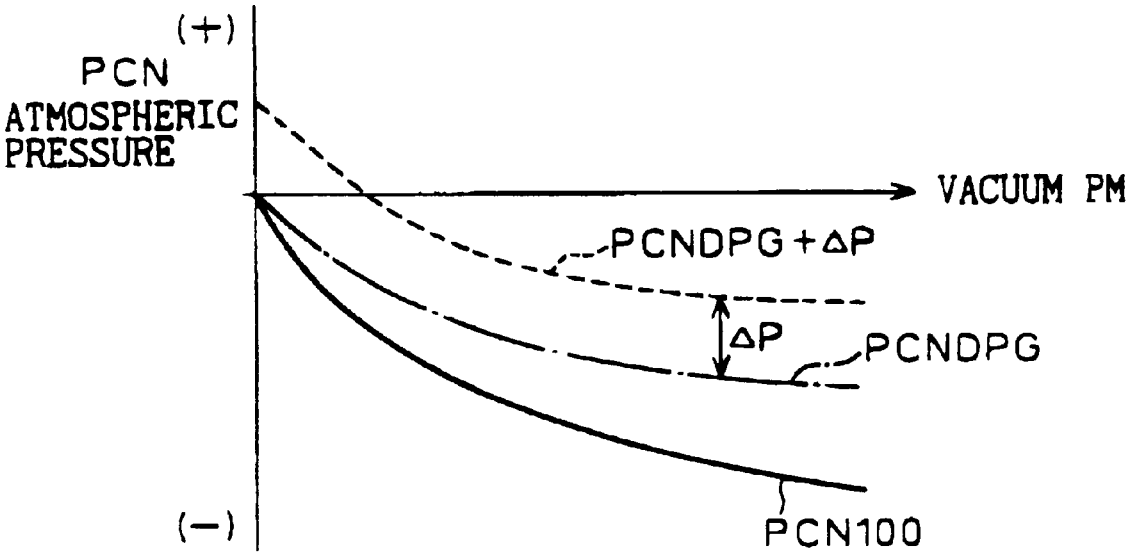
FIG. 39 is a view of changes in the pressure PCN in the fuel vapor chamber of a canister.

The vertical axis in FIG. 39 shows the pressure PCN in the fuel vapor chamber 12. The horizontal axis shows the vacuum PM in the surge tank S. Further, in FIG. 39, the solid line PCN100 shows the relationship between the pressure PCN in the fuel vapor chamber 12 and the vacuum Pa in the surge tank 5 when the duty ratio DPG of the purge control valve 17 is 100 percent, that is, when the purge control valve 17 is fully open. This PCN100 becomes the atmospheric pressure when the vacuum PM becomes zero as shown in FIG. 39. As the vacuum PM becomes larger, it gradually falls. The relationship between the PCN100 and the vacuum PM is stored in advance in the ROM 22. Therefore, if the vacuum PM is known, it is possible to find the PCN100. The vacuum PM can be directly detected using a pressure sensor.

Alternatively, it is possible to find the vacuum PM in advance as a function of the engine load Q/N and the engine speed N and find the vacuum PM from the engine load Q/N and the engine speed N.

On the other hand, the pressure PCNDPG in the fuel vapor chamber 12 when the duty ratio DPG of the purge control valve 17 is not 100 percent is obtained by multiplying the PCN100 with the duty ratio DPG at that time. This pressure PCNDPG (=PCN100·DPG/100) is shown by the broken line in FIG. 39. The pressure PCN in the fuel vapor chamber 12 when a large amount of evaporated fuel is not produced in the fuel tank 15 substantially matches the PCNDPG. If Ha large amount of evaporated fuel is generated in this fuel tank 15, however, the pressure PCN in the fuel vapor chamber 12 rises compared with the PCNDPG. Therefore, in this embodiment of the present invention, when the pressure PCS in the fuel vapor chamber 12 becomes larger than the PCNDPG plus a predetermined value ΔP (PCNDPG+ΔP shown by broken line in FIG. 39), it is judged that a large amount of evaporated fuel is being produced in the fuel tank 15 and the purge over generation flag XPCN2 is set.

Figure 40:
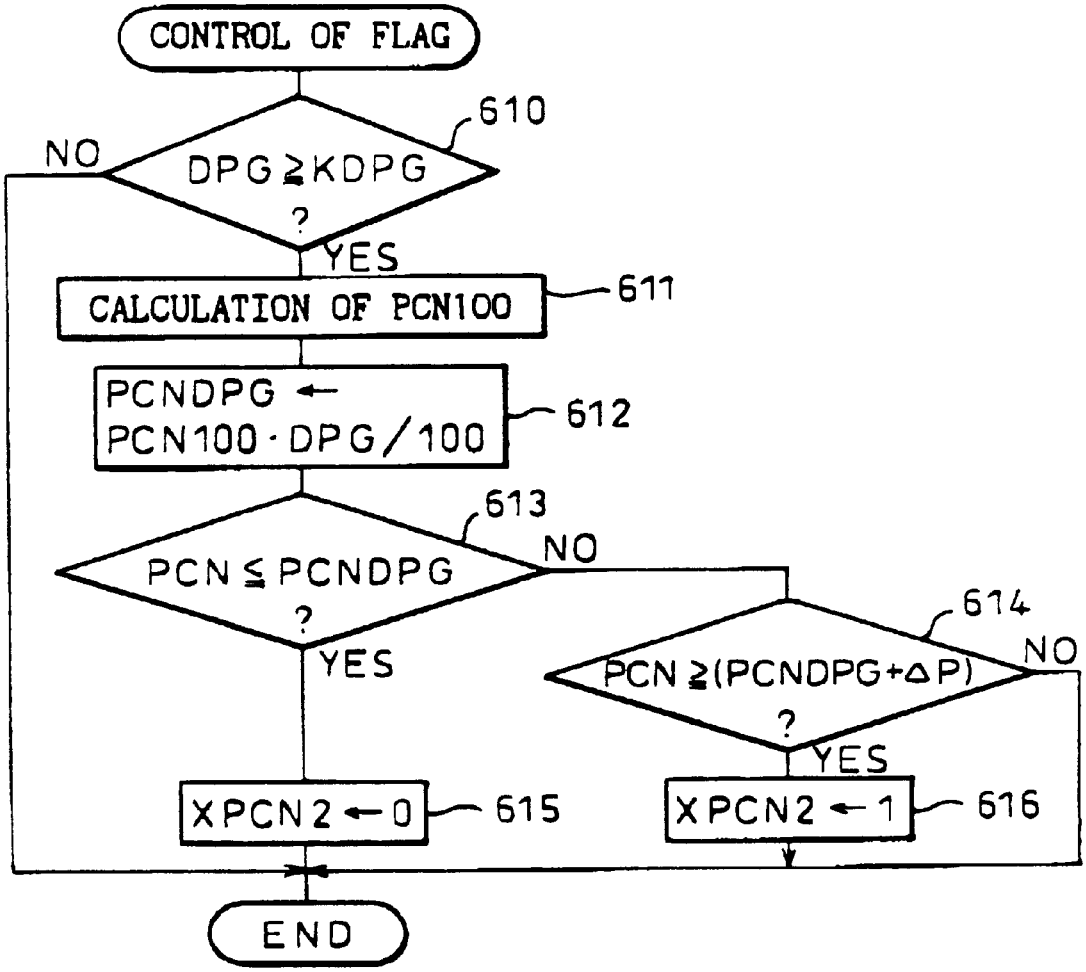
FIG. 40 is a flow chart of the control of a large vapor production flag.

FIG. 40 shows the routine for control of the purge over generation flag while the purge action is ongoing. This routine is executed by interruption at predetermined intervals.

Referring to FIG. 40, first, at step 610, it is judged if the duty ratio DPG is higher than a predetermined duty ratio, that is, a predetermined duty ratio KDPG wheic the amount of purge is stable. When DPG<KDPG, the processing cycle is ended. As opposed to this, when DPG≧KDPG, the routine proceeds to step 611, where the pressure PCN100 when the duty ratio DPG shown in FIG. 39 is 100 percent is calculated. Next, at step 612, the pressure PCNDPG (=PCN100·PGR/100) based on the duty ratio DPG is calculated. Next, at step 613, it is judged if the Pressure PCN in the fuel vapor chamber 12 is lower than PCNDPG or not. When PCN≦PCNDPG, the routine proceeds to step 615, where the large vapor production flag XPCN2 is reset (XPCN2=0). On the other hand, when PCN>PCNDPG, the routine proceeds to step 614, where it is judged if the pressure PCN is higher than (PCNDPG+ΔP) shown by the broken line in FIG. 39. At this time, if PCN≧PCNDPG+ΔP, the large vapor production flag XPCN2 is set (XPCN2=1).

Figure 41:
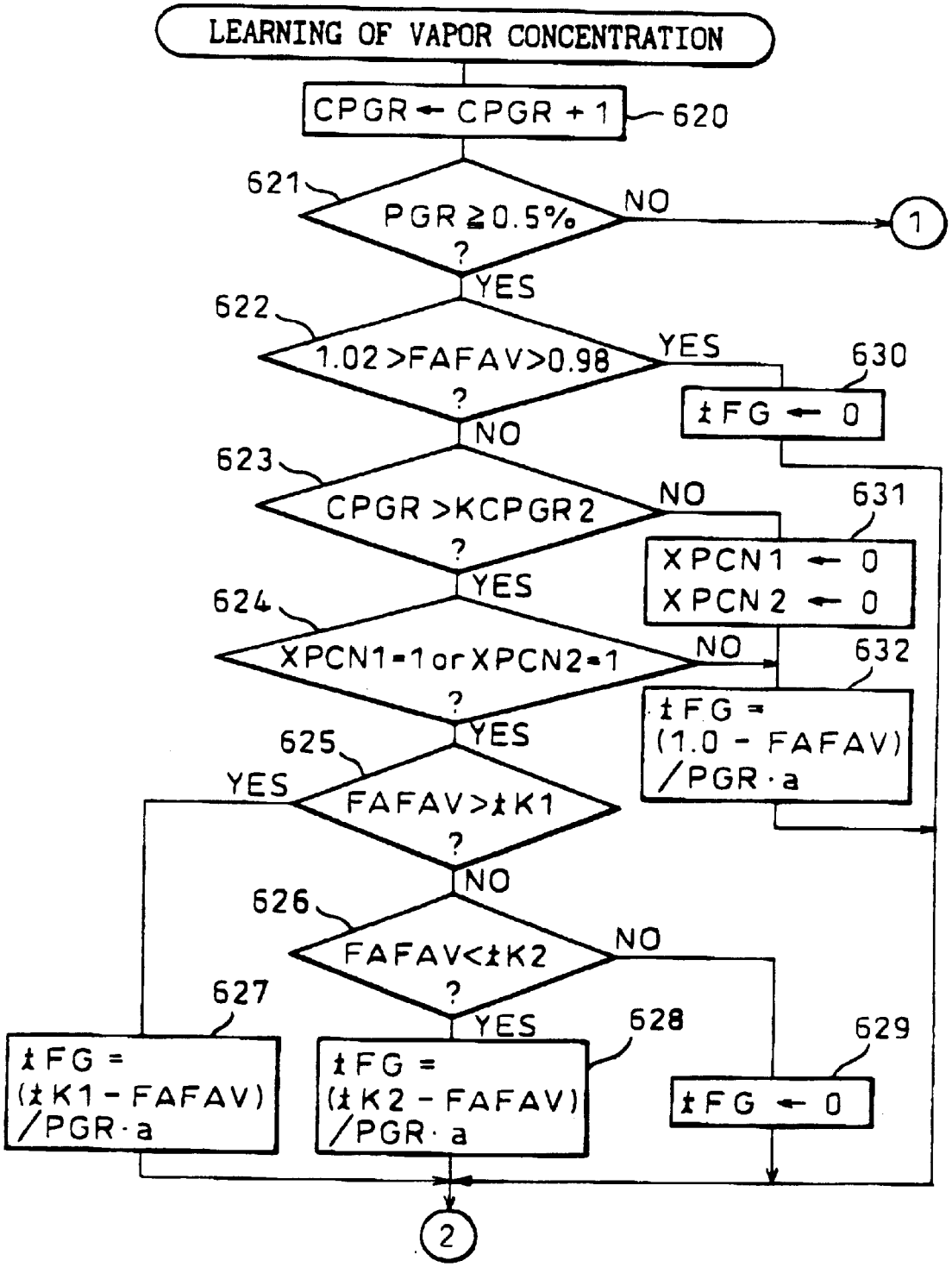
FIGS. 41 and 42 are flow charts of the learning of the vapor concentration used in the sixth embodiment.
Figure 42:
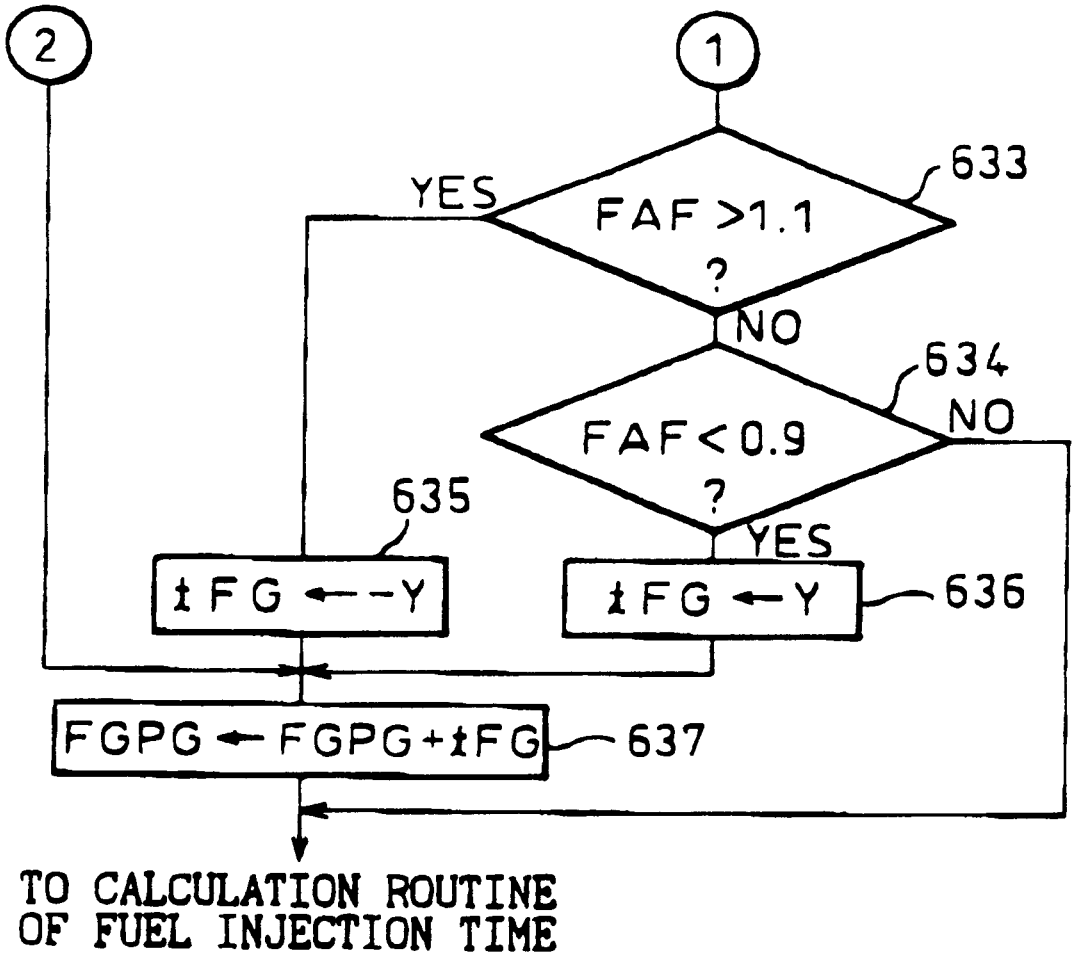

FIG. 41 and FIG. 42 show the routine for learning of the vapor concentration for working the sixth embodiment. Note that outside of the routine for learning the vapor concentration, the routines used in the first embodiment are used as they are.

Referring to the routine for learning the vapor concentration shown in FIG. 41 and FIG. 42, first, at step 620, the count CPGR of the purge execution time is incremented by 1. As explained above, the count CPGR of the purge execution time shows the cumulative time during which the purge operation was performed after the startup of the engine.

Next, at step 621, it is judged if the purge rate PGR is larger than 0.5 percent or not. When PGR≧0.5 percent, that is, other than when the purge rate PGR is extremely small, the routine proceeds to step 622, where it is judged if the average value FAFAV of the feedback control coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 630, where the update value tFG of the vapor concentration FGPG per unit purge rate is made zero, then the routine proceeds to step 637. Therefore, at this time, the vapor concentration FGPG is not updated.

On the other hand, when it is judged at step 623 that the average value FAFAV of the feedback control coefficient is outside of the first set range, that is, when FAFAV≧1.02 or FAFAV≦0.98, the routine proceeds to step 623, where it is judged if the count CPGR of the purge execution time is larger than the predetermined set value KCPGR2 or not. This set value KCPGR2 corresponds to about 2 minutes. Therefore, at step 623, it is judged if the purge execution time has exceeded about 2 minutes. When CPGR≦KCPGR2, the routine proceeds to step 631, where the large vapor production flags XPCN1 and XPCN2 are both reset (XPCN1=1, XPCN2=0). Next, at step 632, the update value tFG of the vapor concentration FGPG is calculated based on the following equation:

$$tFG=(1.0-FAFAV)/PGR\cdot a$$

Here, a, as explained above, is 2. At this time, when the average value FAFAV of the feedback control coefficient is outside of the first set range (between 0.98 and 1.02), half of the deviation of the FAFAV with respect to 1.0 is made the update value tFG. Therefore, FAFAV is gradually returned to the first set range as shown in FIG. 4.

On the other hand, when it is judged at step 623 that CPGR>KCPGR2, the routine proceeds to step 624, where it is judged if one of the large vapor production flag XPCN1 and XPCN2 is set or not. When neither of the large vapor production flags XPCN1 and XPCN2 are set, the routine proceeds to step 632. As opposed to this, when one of the large vapor production flags XPCN1 and XPCN2 is set, the routine proceeds to step 625. From step 625 to step 629, when the average value FAFAV of the feedback correction coefficient exceeds the second set range (between tK1 and tK2), half of the amount by which the second set range is exceeded is made the update value tFG of the vapor concentration FGPG.

That is, at step 625, it is judged if the average value FAFAV of the feedback control coefficient is smaller than the lower limit tK2 of the second set range.

When FAFAV>tK1, the routine proceeds to step 627, where the update value tFG is calculated based on the following equation:

$$tFG=(tK1-FAFAV)/PGR\cdot a$$

Here, a is for example 2. That is, when FAFAV exceeds the upper value tK1 of the second set range, half of the difference of the upper limit tK1 and FAFAV is made the update value tFG. At this time, FAPAV is gradually returned to the upper limit tK1 of the second set range.

On the other hand, when it is judged at step 625 that FAFAV≦tK1, the routine proceeds to step 626, where it is judged if the average value FAFAV of the feedback control coefficient is smaller than the lower limit tK2 of the second set range. When FAFAV<tK2, the routine proceeds to step 628, where the update value tFG is calculated based on the following formula.

$$tFG=(tK2-FAFAV)/PGR\cdot a$$

Here too, a is for example 2. That is, when FAFAV becomes smaller than the lower value tK2 of the second set range, half of the difference of the lower limit tK2 and FAFAV is made the update value tFG. At this time, FAFAV is gradually returned to the lower limit tK2 of the second set range.

On the other hand, when it is judged at step 626 that FAFAV≧tK2, that is, when the average value FAFAV of the feedback control coefficient is in the second set range, the routine proceeds to step 629, where the update value tFG is made zero. Therefore, when FAFAV is in the second set range, the vapor concentration FGPG is not updated.

If the update value tFG is calculated at step 627, 628, 629, 630,, or 632, the routine proceeds to step 637, where the update value tFG is added to the vapor concentration FGPG. Next, the routine proceeds to the routine for calculation of the fuel injection time shown in FIG. 17.

On the other hand, when it is judged at step 621 that PGR<0.5 percent, the routine proceeds to step 633, where it is judged if the feedback control coefficient FAF is larger than 1.1. When FAF>1.1, the routine proceeds to step 635, where the update value tFG is made the constant value −Y, then the routine proceeds to step 637. On the other hand, when it is judged at step 633 that FAF≦1.1, the routine proceeds to step 634, where it is judged if the feedback control coefficient FAF is smaller than 0.9 or not. When FAF<0.9, the routine proceeds to step 636, where the update value tFG is made the constant value Y, then the routine proceeds to step 637. When it is judged at step 634 that FAF≧0.9, the routine proceeds to the routine for calculation of the fuel injection time shown in FIG. 17.

Next, an explanation will be given of a seventh embodiment in which the upper limit tK1 and the lower limit tK2 of the second set range are changed in is accordance with the vapor concentration FGPG.

That is, assuming that a large amount of evaporated fuel is produced in the fuel tank 15 and that as a result a thick fuel vapor is supplied from the fuel tank 15, if a thick fuel vapor is supplied from the canister 11 as well at this time, the vapor concentration FGPG in the intake air will not change much at all regardless of the amount of purge. Therefore, at this time, the air-fuel ratio will not fluctuate much at all even if the operating state of the engine changes.

As opposed to this, when a thick fuel vapor is being supplied from the fuel tank 15 and a thin fuel vapor is being supplied from the canister 11, if the amount of purge changes, the vapor concentration FGPG will change considerably. For example, if the amount of intake air becomes greater, the amount of purge of the thick fuel vapor from the fuel tank 15 will not change, but the amount of purge of the thin fuel vapor from the canister 11 will become greater in proportion to the amount of intake air. Therefore, if the amount of intake air increases, the vapor concentration FGPG will fall and therefore the air-fuel ratio will widely fluctuate.

Therefore, in the seventh embodiment, when a thick fuel vapor is being supplied from the canister 11, since the air-fuel ratio will not change that much even if the amount of purge changes, the second set range is made narrow so as to accurately find the vapor concentration FGPG at this time. As opposed to this, when a thin fuel vapor is being supplied from the canister 11, if the amount of purges changes, for example, if the amount of intake air changes, the air-fuel ratio will widely fluctuate, so at this time the second set range is enlarged so as to prevent the air-fuel ratio from becoming extremely lean or rich.

In engine operating states other than idling, however, the fuel vapor from the fuel tank 15 has almost no effect on the vapor concentration FGPG. The vapor concentration FGPG is strongly affected by the fuel vapor from the canister 11. That is, when the fuel vapor from the canister 11 is thick, the vapor concentration FGPG becomes higher, while when the fuel vapor from the canister is 11, the vapor concentration FGPG becomes lower. Therefore, in the seventh embodiment, in operating states other than idling, if the vapor concentration FGPG is high, the second set range is made narrower, while if the vapor concentration FGPG is low, the second set range is made wider.

Figure 43:
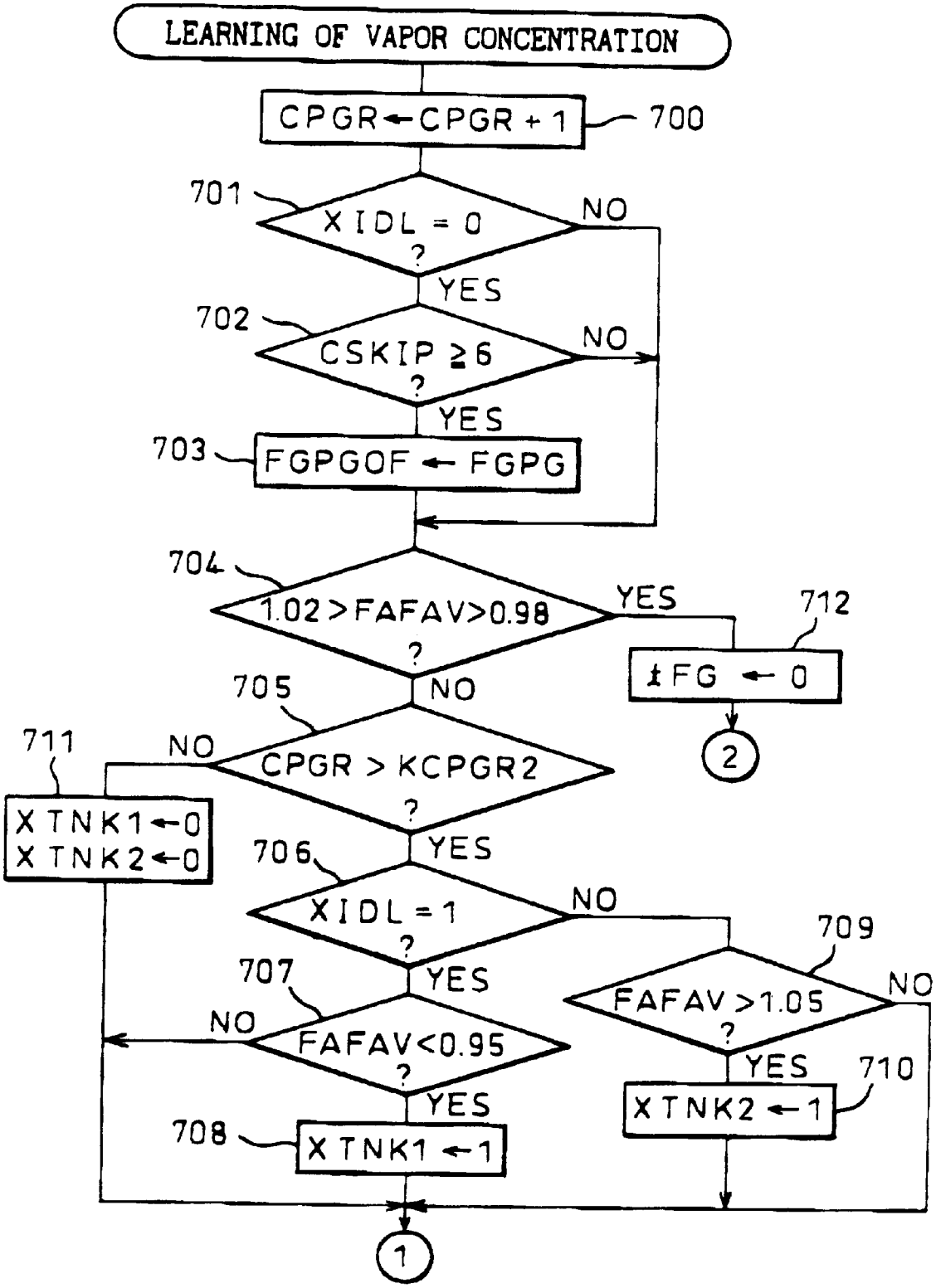
FIGS. 43 and 44 are flow charts of the learning of the vapor concentration used in a seventh embodiment.
Figure 44:
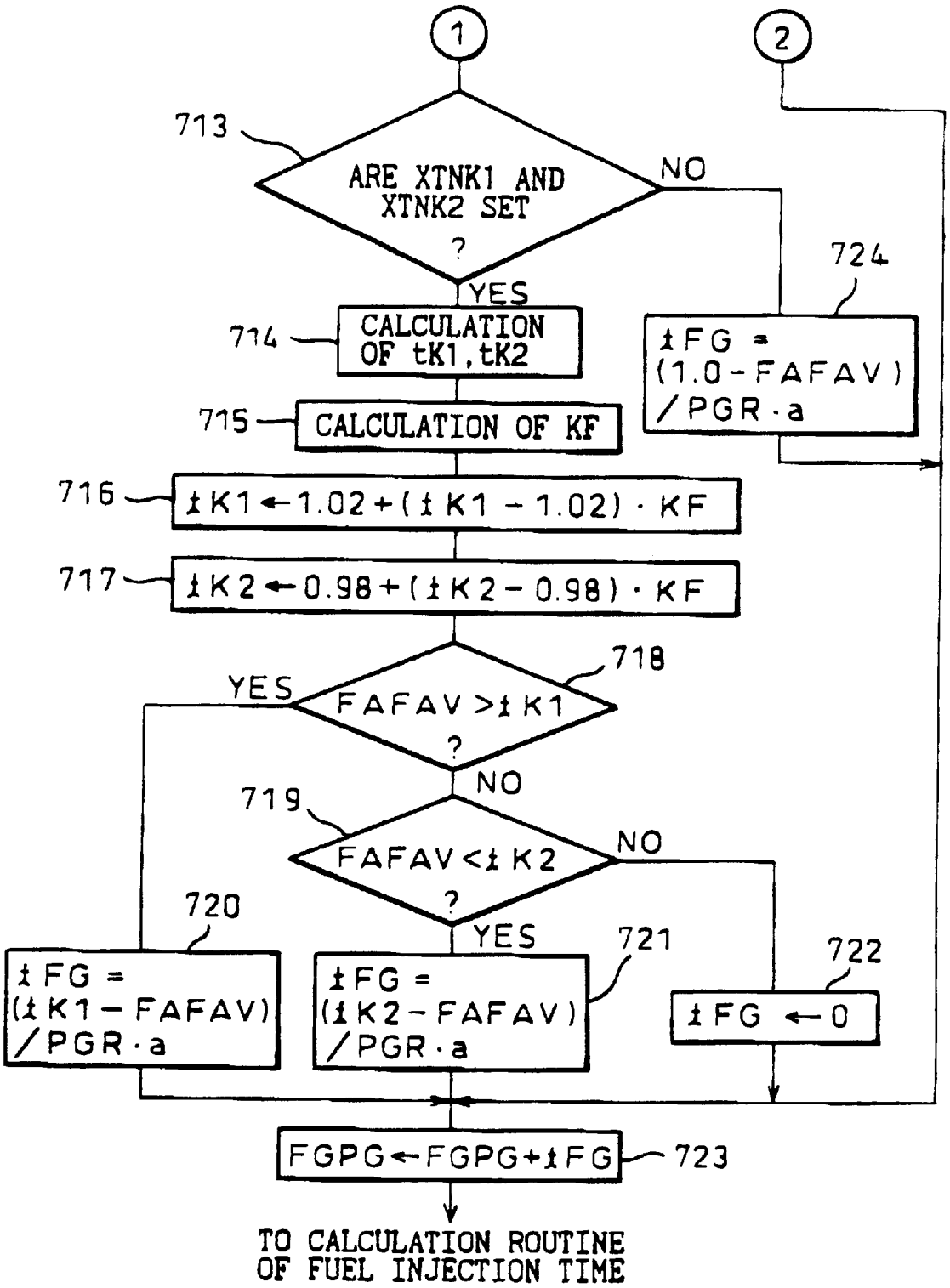

FIG. 43 and FIG. 44 show the routine for learning of the vapor concentration for working the seventh embodiment. Note that the routines other than the routine for learning of the vapor concentration are the same as those used in the first embodiment.

Referring to FIG. 43 and FIG. 44, first, at step 700, the count CPGR of the purge execution time is incremented by 1. An explained above, the count CPGR of the purge execution time shows the cumulative time during which the purge operation was performed after the startup of the engine.

Next, at step 701, it is judged if the idling flag XIDL which is set during idling operation has been reset or not. When the idling flag XIDL is set (XIDL=1), the routine jumps to step 704. As opposed to this, when the idling flag XIDL is set (XIDL=0), that is, when the engine is operating at other than idling, the routine proceeds to step 702, where it is judged if the number of skips CSKIP of the feedback control coefficient from when XIDL became 0 has exceeded a predetermined number, for example, six times. When CSKIP<6, the routine jumps to step 704, while when CSKIP≧6, the routine proceeds to step 703, where the vapor concentration FGPG is made FGPGOF. That is, in an operating state other than idling, when CSKIP≧6, that is, when the learning of the vapor concentration FGPG is ended, the latest vapor concentration FGPG is made FGPGOF. Next, the routine proceeds to step 704.

At step 704, it is judged if the average value FAFAV of the feedback correction coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 712, where the update value tFG of the vapor concentration FGPG per unit purge rate is made zero, then the routine proceeds to step 723. Therefore, at this time, the vapor concentration FGPG is not updated.

On the other hand, when it is judged at step 704 that the average value FAFAV of the feedback control coefficient is outside of the first set range, that is, when FAFAV≧1.02 or FAFAV≦0.98, the routine proceeds to step 705, there it is judged if the count CPGR of the purge execution time is larger than the predetermined set value KCPGR2 or not. This set value KCPGR2 corresponds to about 2 minutes. Therefore, at step 705, it is judged if the purge execution time has exceeded about 2 minutes. When CPGR≦KCPGR2, that is, when the purge execution time is less than about 2 minutes, the routine proceeds to step 711, where the flags XTNK1 and XTNK2 are both reset, then the routine proceeds to step 713.

On the other hand, when it is judged at step 705 that CPGR>KCPGR2, that is, when the purge execution time is over about 2 minutes, the routine proceeds to step 706, where it is judged if the idling flag XIDL which is set at the time of idling operation has been set (XIDL=1) or not. When the idling flag XIDL has been set (XIDL=1), that is, when during idling operation, the routine proceeds to step 707, where it is judged if the average value FAFAV of the feedback correction coefficient is smaller than 0.95 or not. When FAFAV<0.95, the routine proceeds to step 708, where the flag DXTNK1 is set (XTNK1=1), then the routine proceeds to step 713.

As opposed to this, when it is judged at step 706 that the idling flag XIDL has been reset (XIDL=0), that is, when not during an idling operation, the routine proceeds to step 709, where it is judged if the average value FAFAV of the feedback correction coefficient is larger than 1.05 or not. When FAFAV≦1.05, the routine jumps to step 713. As opposed to this, when FAFAV>1.05, the routine proceeds to step 710, where the flag XTNK2 is set (XTNK2=1) and then the routine proceeds to step 713.

At step 713, it is judged if both of the flag XTNK1 and the flag XTNX2 have been set or not, that is, if FAFAV<0.95 during an idling operation and FAFAV>1.05 other than during an idling operation. In other words, it is judged if a large amount of evaporated fuel is produced in the fuel tank 15 or not. When the flag XTNK1 and the flag XTNK2 are not both set, that is, when a large amount of evaporated fuel is not being produced in the fuel tank 15, the routine proceeds to step 724, where the update value tFG of the vapor concentration FGPG is calculated based on the following equation:

$$tFG=(1.0-FAFAV)/PGR\cdot a$$

Here, a is, for example, 2. At this time, if the average value FAFAV of the feedback correction coefficient exceeds the first set range (between 0.98 and 1.02), half of the deviation of the FAFAV with respect to 1.0 is made the update value tFG. Therefore, at this time, FAFAV is gradually returned to the first set range as shown in FIG. 4.

Figure 45:
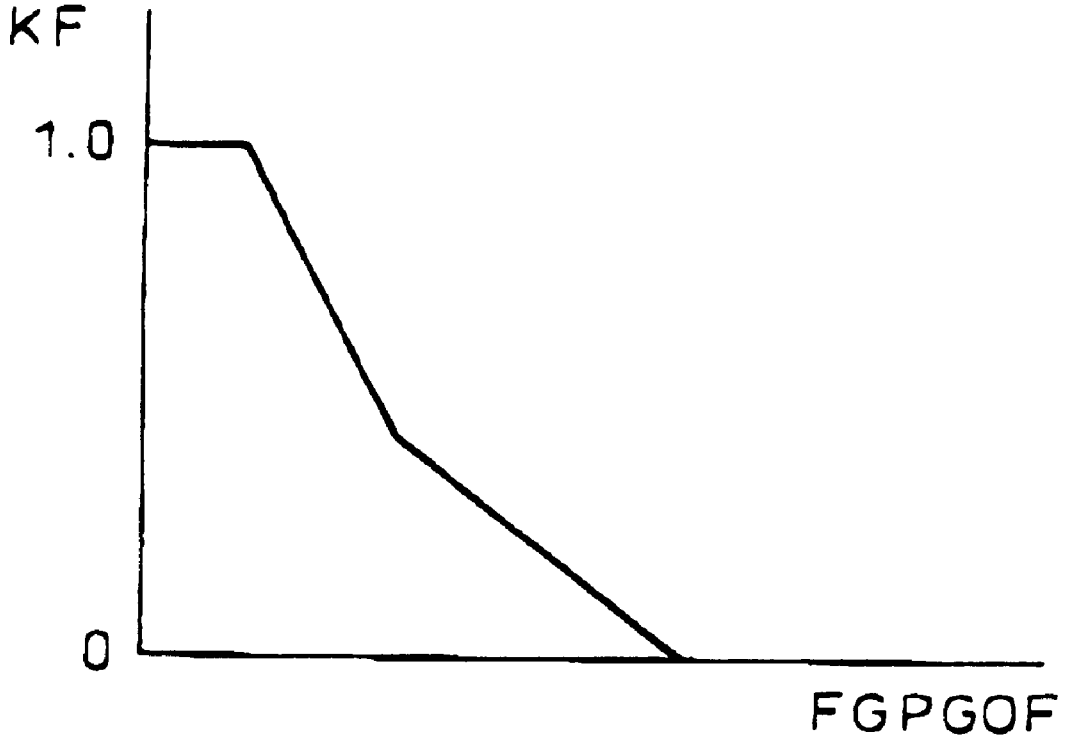
FIG. 45 is a view of a correction value KF.

On the other hand, when it is judged at step 713 that both of the flag XTNK1 and the flag XTNK2 are set, that is, when a large amount of evaporated fuel is being produced in the fuel tank 15, the routine proceeds to step 714, where the upper limit tK1 and the lower limit tK2 of the second set range shown in FIG. 18 are calculated. Next, at step 715, the correction value KF shown in FIG. 45 is calculated based on the FGPGOF found at step 703. As will be understood from FIG. 45, the correction value KF becomes larger the smaller the vapor concentration FGPGOF. Next, at stop 716 and step 717, the final upper limit tK1 and lower limit tK2 of the second set range are calculated based on the following equations:

$$tK1=1.02+(tK1=1.02)\cdot KF$$

$$tK2=0.98+(tK1=0.98)\cdot KF$$

That is, when the vapor concentration FGPGOF is high, KF=0, therefore tK1=1.02 and tK2=0.98. As opposed to this, when the vapor concentration FGPGOF is low, KF=1.0 and tK1=tK1 and tK2=tK2. Therefore, as the vapor concentration FGPGO becomes lower, tK1 gradually becomes larger from 1.02 and tK2 gradually becomes smaller from 0.98.

Next, from step 718 to step 722, when the average value FAFAV of the feedback correction coefficient exceeds the second set range (between tK1 and tK2), half of the amount by which the second set range is exceeded is made the update value tFG of the vapor concentration FGPG.

That in, at step 718, it is judged if the average value FAFAV of the feedback control coefficient is larger than the upper limit tK1 of the second set range. When FAFAV>tK1, the routine proceeds to step 720, where the update value tFG is calculated based on the following equation:

$$tFG=(tK1-FAFAV)/PGR\cdot a$$

Here, a is for example 2. That is, when FAFAV exceeds the upper value tK1 of the second set range, half of the difference of the upper limit tK1 and FAFAV is made the update value tFG. At this time, FAFAV is gradually returned to the upper limit tK1 of the second set range.

On the other hand, when it is judged at step 718 that FAFAV≦tK1, the routine proceeds to step 719, where it is judged if the average value FAFAV of the feedback control coefficient is smaller than the lower limit tK2 of the second set range. When FAFAV<tK2, the routine proceeds to step 721, where the update value tFG is calculated based on the following formula.

$$tFG=(tK2-FAFAV)/PGR\cdot a$$

Here too, a is for example 2. That is, when FAFAV becomes smaller than the lower value tX2 of the second set range, half of the difference of the lower limit tK2 and FAFAV is made the update value tFG. At this time, FAFAV is gradually returned to the lower limit tK2 of the second set range.

On the other hand, when it is judged at step 719 that FAFAV≧tK2, that is, when the average value FAFAV of the feedback control coefficient is in the second set range, the routine proceeds to step 722, where the update value tFG is made zero. Therefore, when FAFAV is in the second set range, the vapor concentration FGPG is not updated.

If the update value tFG is calculated at step 712, 720, 721, 722,, or 724, the routine proceeds to step 723, where the update value tFG is added to the vapor concentration FGPG. Next, the routine proceeds to the routine for calculation of the fuel injection time shown in FIG. 17.

Next, an explanation will be made of an eighth embodiment shown in FIG. 46.

As explained above, in the embodiment shown in FIG. 9, if the amount of intake air was increased widely when a large amount of evaporated fuel was being produced in the fuel tank 15, the feedback control coefficient FAF would increased from the lower limit tK2 to close to the upper limit tK1. When the amount of intake air was widely reduced, the feedback control coefficient FAF would fall from near the upper limit tK1 to the lower limit tK2. At this time, if the feedback control coefficient is made to change based on just the air-fuel ratio, the feedback control coefficient FAF would increase or decrease gradually by a predetermined speed determined by the integral constant K (FIG. 2) as shown in FIG. 9.

However, while the feedback control coefficient FAF was increasing or decreasing in this way, the air-fuel ratio would deviate from the stoichiometric air-fuel ratio. That is, while the feedback control coefficient FAF was increasing, the air-fuel ratio would become lean, while when the feedback control coefficient FAF was decreasing, the air-fuel ratio would become rich. Therefore, to shorten the time during which the air-fuel ratio became lean or rich in this way, it is necessary to change the feedback control coefficient FAF as quickly as possible from the lower limit tK2 to the upper limit tK1 or from the upper limit tK1 to the lower limit tK2.

Figure 46:
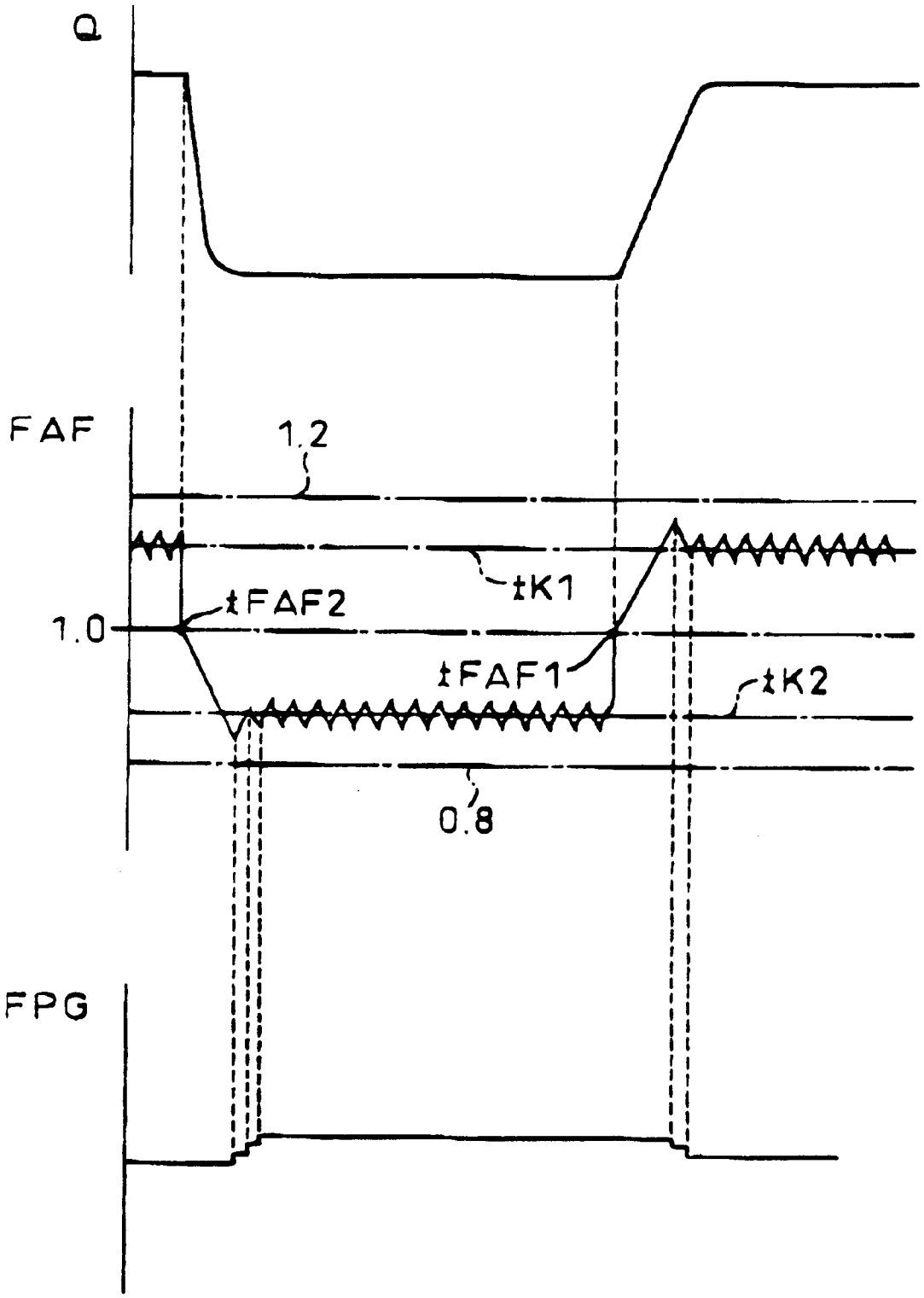
FIG. 46 is a view of changes in the feedback control coefficient FAF etc. in the present invention.

Therefore, in the eighth embodiment of the present invention, as shown in FIG. 46, when the amount of intake air increases widely, the feedback control coefficient FAF is made the first set value tFAF1 larger than the lower limit tK2 once, then the feedback control coefficient FAF is gradually increased from the first set value tFAF1, while when the amount of intake air is widely reduced, the feedback control coefficient FAF is first made the second set value tFAF2 smaller than the upper limit tK1, then the feedback control coefficient FAF is gradually reduced from the second set value tFAF2. As clear from FIG. 46, by doing this, the time during which the air-fuel ratio becomes lean and the time during which the air-fuel ratio becomes rich can be shortened. Note that in the eighth embodiment shown in FIG. 46, the first set value tFAF1 and the second set value tFAF2 are both made the reference value, that is, 1.0.

Figure 47:
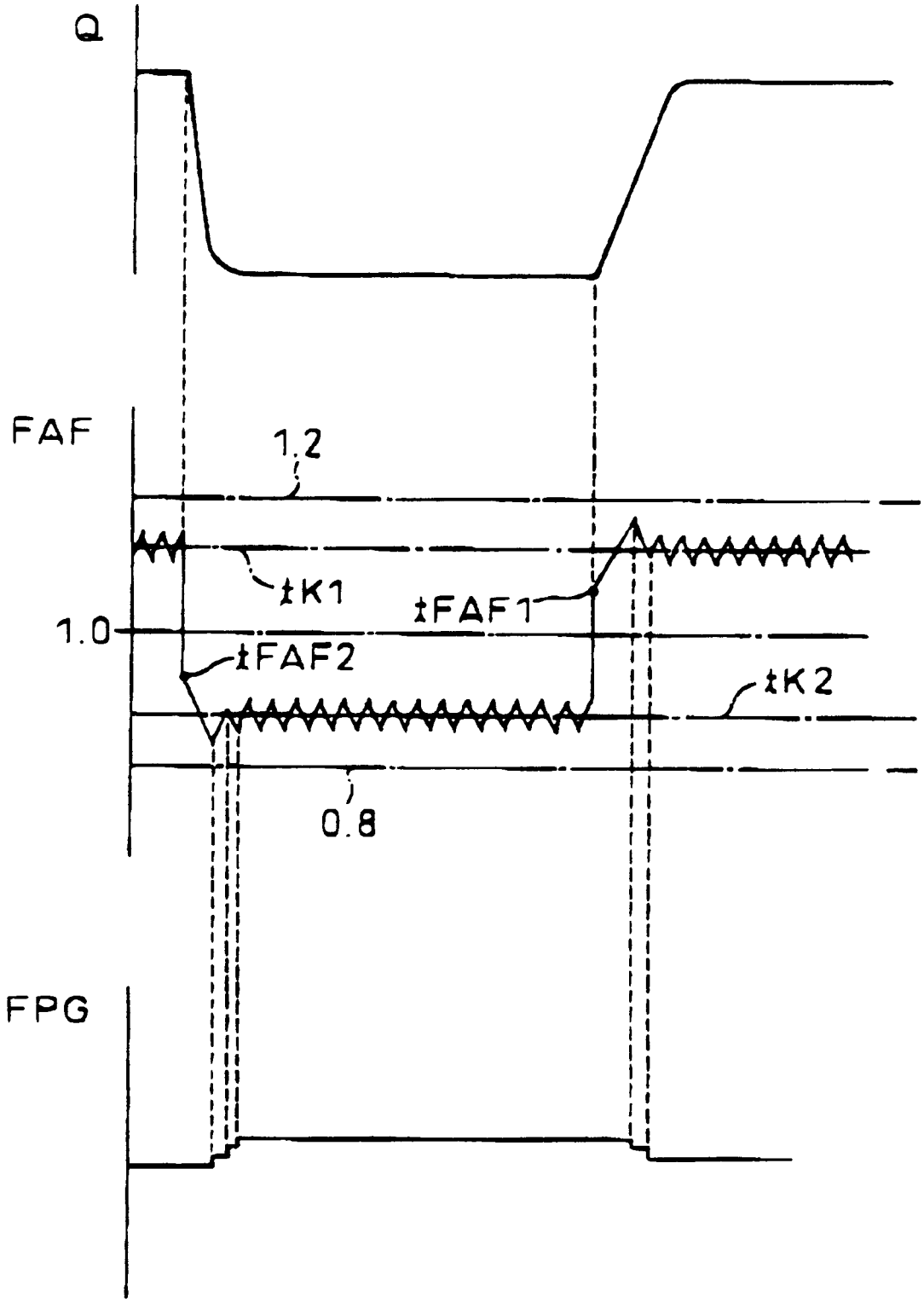
FIG. 47 is a view of changes in the feedback control coefficient FAF etc. in the present invention.

FIG. 47 shows a ninth embodiment. In this embodiment, the first set value tFAF1 is made a value between the reference value 1.0 and the upper limit tK1, while the second set value tFAF2 is made a value between the reference value 1.0 and the lower limit tK2. As will be understood by comparing FIG. 46 and FIG. 47, in the ninth embodiment, compared with the eighth embodiment, the term during which the air-fuel ratio becomes lean and the term during which the air-fuel ratio becomes rich can be made further shorter.

Figure 48:
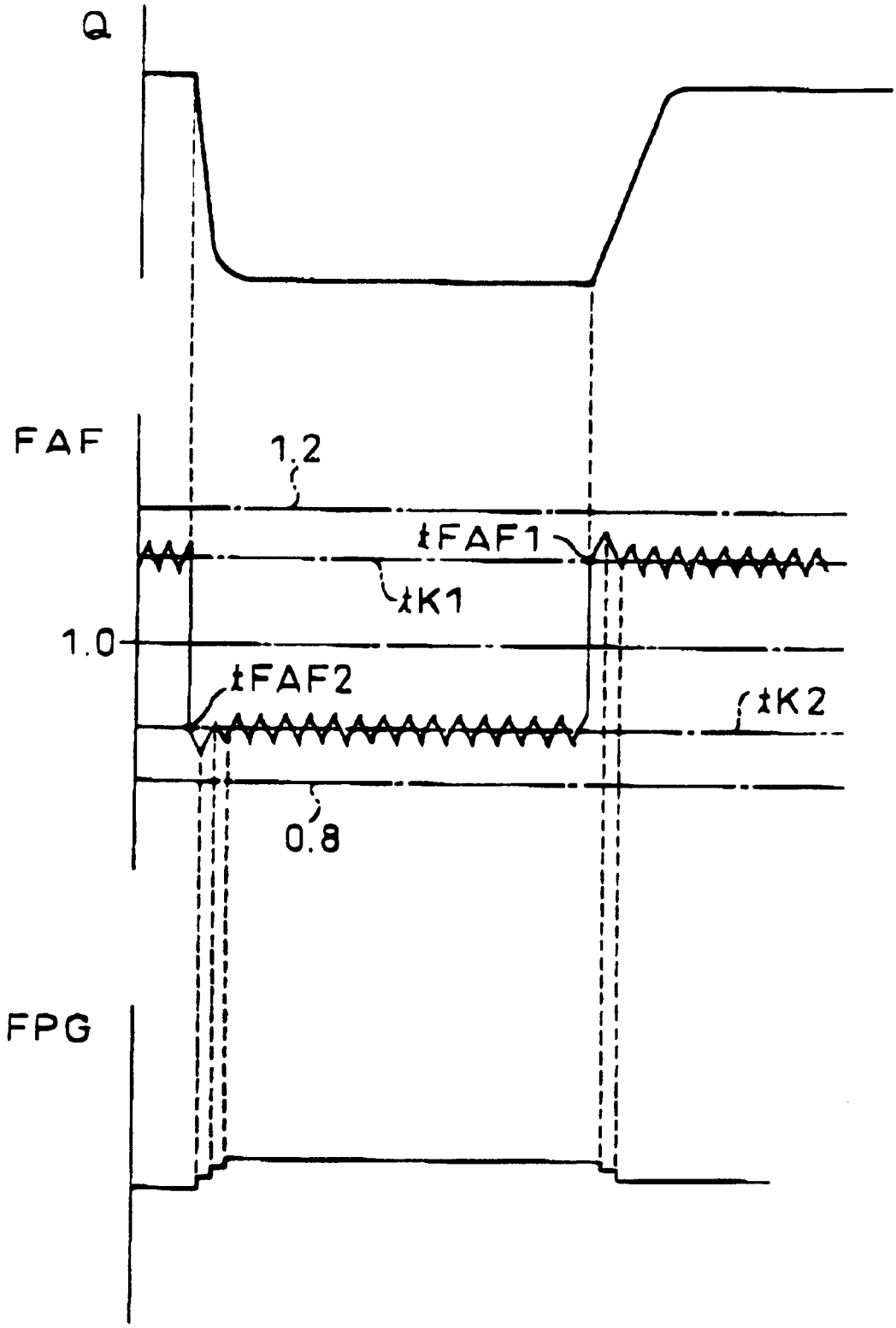
FIG. 48 is a view of changes in the feedback control coefficient FAF etc. in the present invention.

FIG. 48 shows a 10th embodiment. In this embodiment, the first set value tFAF1 is made the upper limit tK1 and the second set value tFAF2 is made the lower limit tK2. As will be understood from FIG. 48, in this embodiment, the term during which the air-fuel ratio becomes lean and the term during which the air-fuel ratio become rich can be made almost zero.

Note that in these embodiments, when the operating state of the engine changes from the idling operating state to a non-idling operating state, it is judged that the amount of intake air has been widely increased. At this time, the feedback control coefficient FAF is made the first set value tFAF1. Further, when the engine operating state changes from a non-idling operating state to an idling operating state, it is judged that the amount of intake air has widely decreased. At this time, the feedback control coefficient FAF is made the second set value tFAF2. Further, in these embodiments, when the throttle valve 9 is in the idling position, when the feedback control coefficient FAF becomes smaller than a set value, for example, 0.9, it is judged that a large amount of evaporated fuel is being produced in the fuel tank 15. At this time, the first set range is changed to the second set range.

Figure 49:
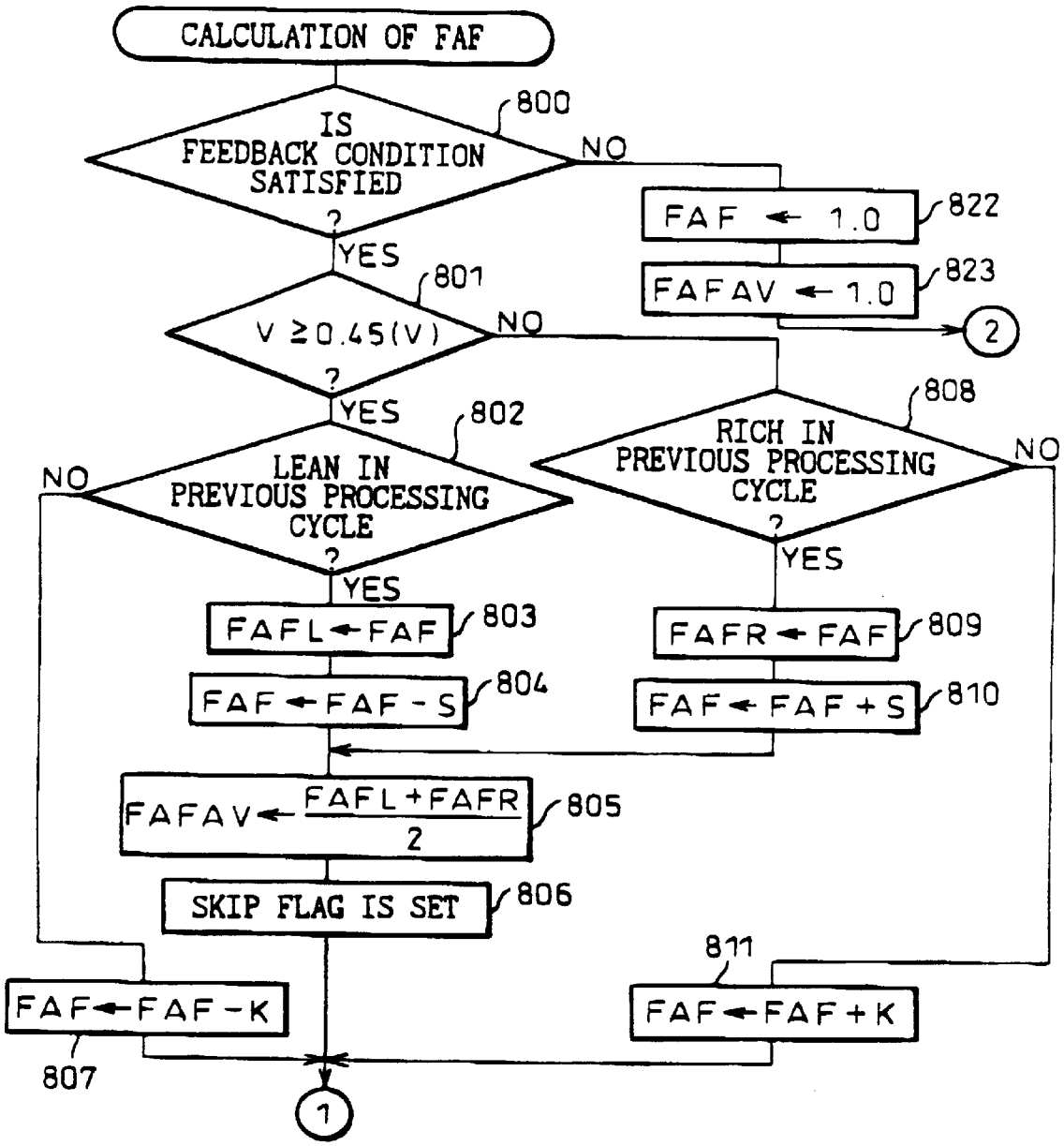
FIGS. 49 and 50 are flow charts of the calculation of the feedback control coefficient FAF.
Figure 50:
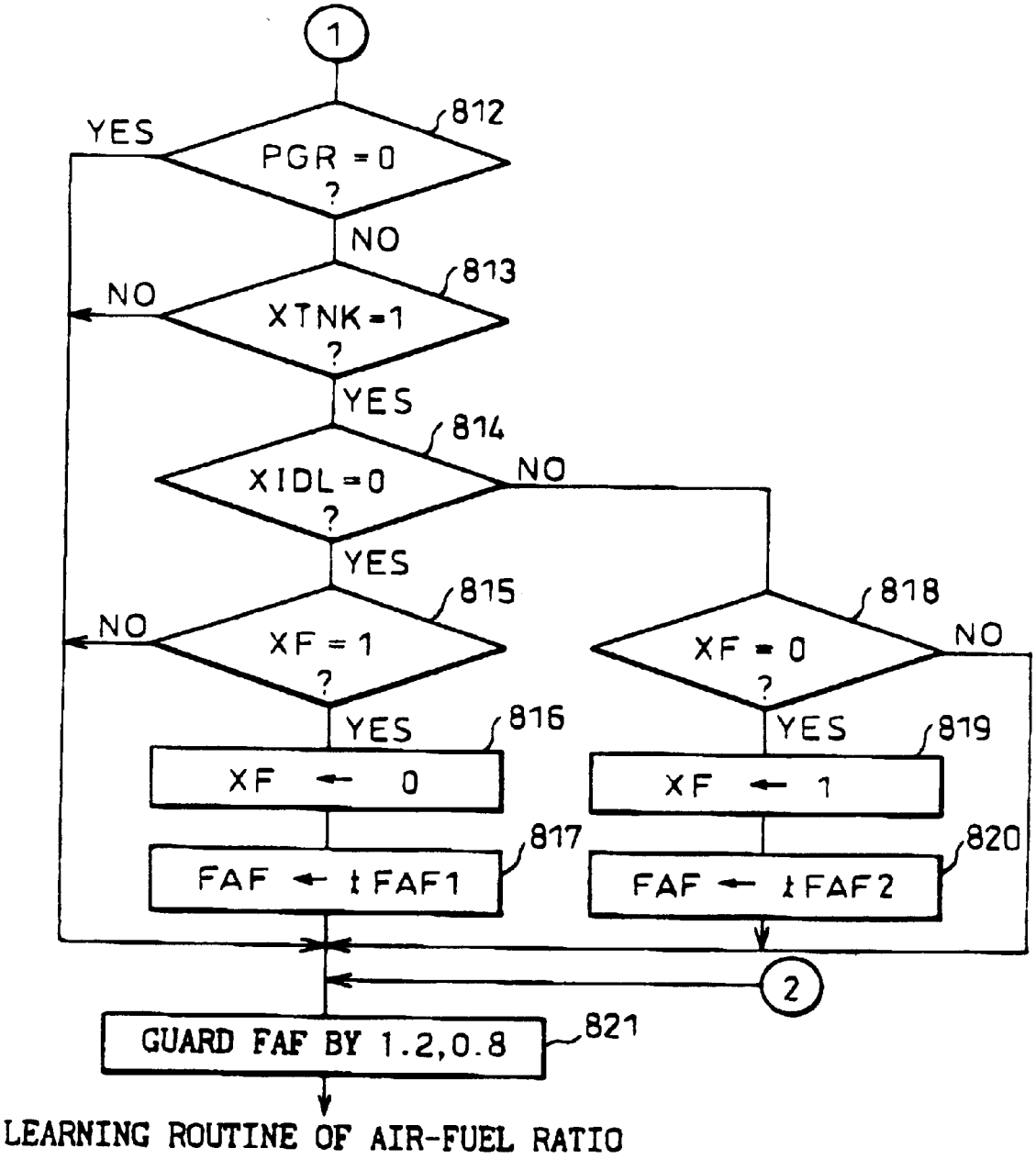
Figure 51:
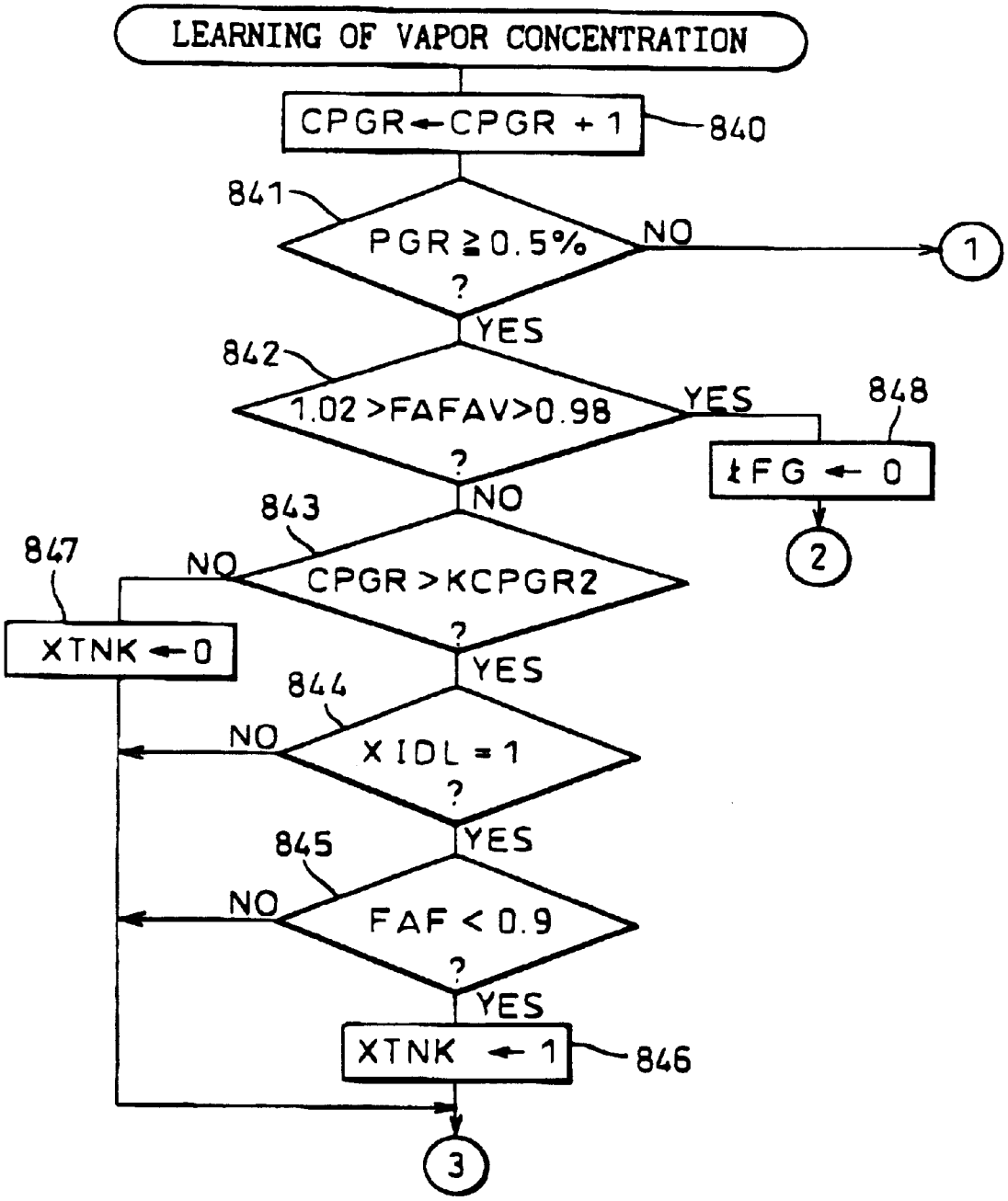
FIGS. 51 to 53 are flow charts of the learning of the vapor concentration.
Figure 52:
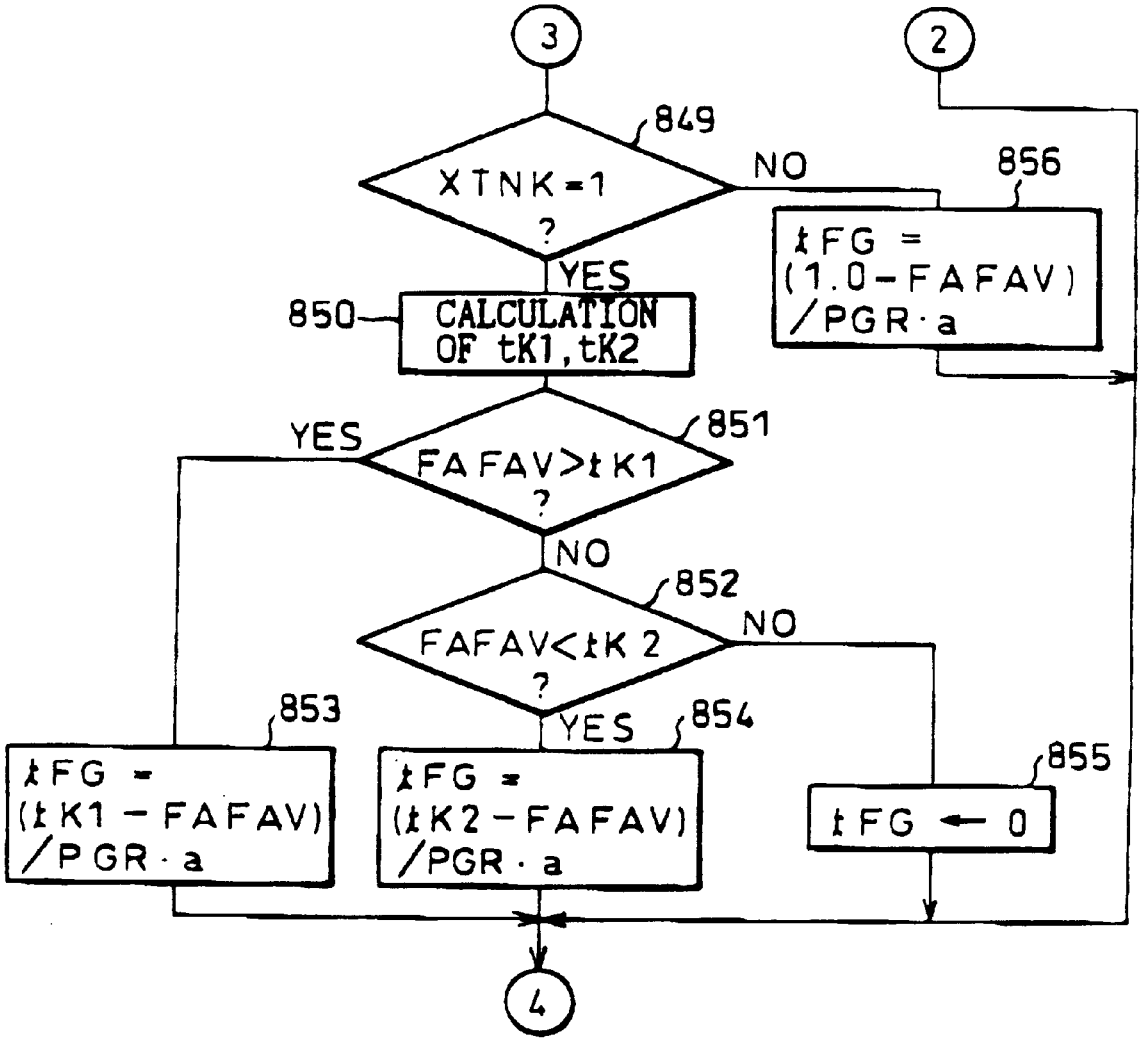
Figure 53:
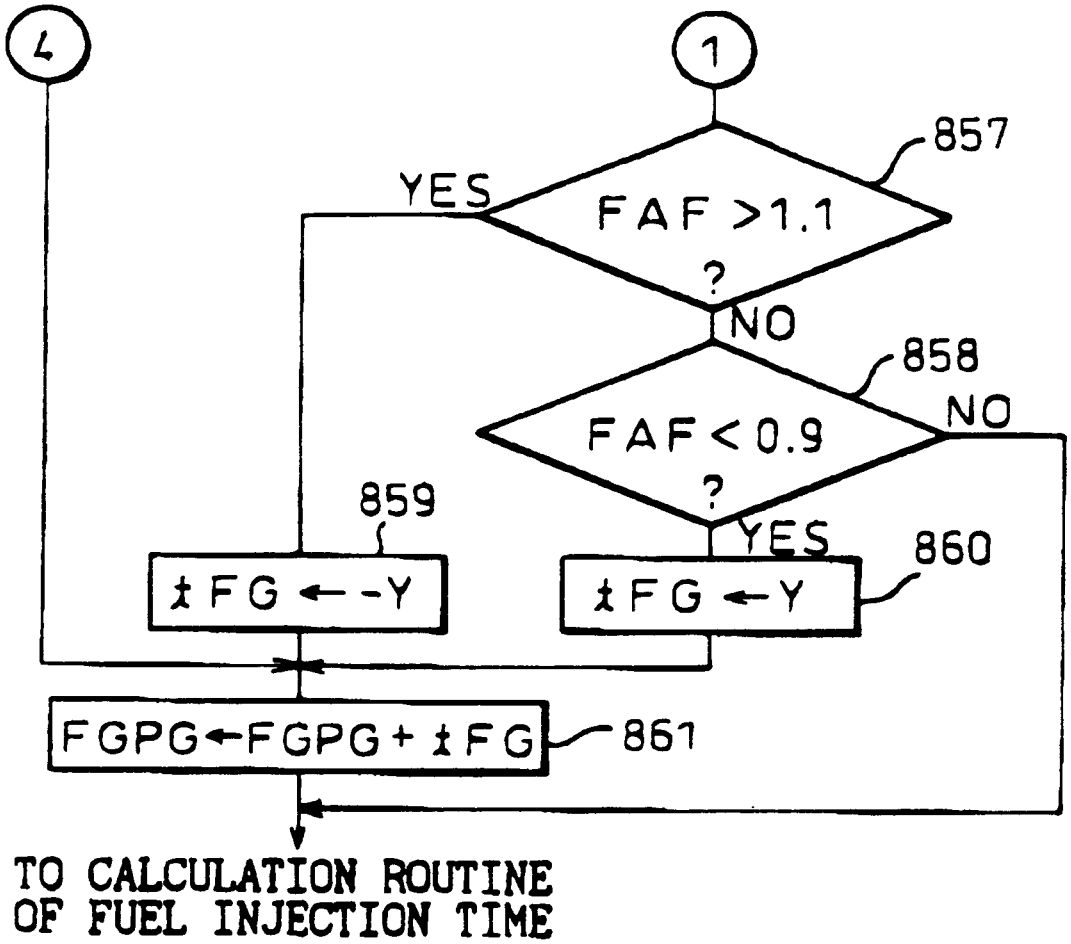

FIG. 49 and FIG. 50 show a routine for calculation of the feedback control coefficient FAF for working the eighth embodiment to the 10th embodiment. FIG. 51 to FIG. 53 show the routine for learning of the vapor concentration for working the eighth embodiment to the 10th embodiment. Note that the routines other than these routines are the same as those used in the first embodiment.

The routine for calculation of the feedback control coefficient FAF shown in FIG. 49 and FIG. 50 is executed by interruption every predetermined time interval for example.

Referring to FIG. 49 and FIG. 50, first, at step 800, it is judged if the feedback control conditions of the air-fuel ratio are satisfied or not. When the feedback control conditions are not satisfied, the routine proceeds to step 822, where the feedback control coefficient FAF is fixed to 1.0, then at step 823, the average value FAFAV of the feedback control coefficient is fixed to 1.0. Next, the routine proceeds to step 821. As opposed to this, when the feedback control conditions are satisfied, the routine proceeds to step 801.

At step 1301, it is judged whether the output voltage of the $O_2$ sensor 31 is higher than 0.45V or not, that is, whether the air-fuel ratio is rich or not. When V≧0.45V, that is, when the air-fuel ratio is rich, the routine proceeds to step 802, where it is judged if the air-fuel ration was lean at the time of the previous processing cycle or not. When it was lean at the time of the previous processing cycle, that is, when it has changed from lean to rich, the routine proceeds to step 803, where the feedback control coefficient FAF is made FAFL and the routine proceeds to step 804. At step 804, a skip value S is subtracted from the feedback control coefficient FAF, therefore, as shown in FIG. 2, the feedback control coefficient FAF is rapidly reduced by the skip value S. Next, at step 80S, the average value FAFAV of the FAFL and FAFR is calculated. Next, at step 806, the skip flag is set. Next, the routine proceeds to step 812. On the other hand, when it is judged at step 802 that the air-fuel ratio was rich at the time of the previous processing cycle, the routine proceeds to step 807, where the integral value K (K<<S) is subtracted from the feedback control coefficient FAF, then the routine proceeds to step 812. Therefore, as shown in FIG. 2, the feedback control coefficient FAF is gradually reduced.

On the other hand, when it is judged at step 801 that V<0.45V, that is, when the air-fuel ratio is lean, the routine proceeds to step 308, where it is judged if the air-fuel ratio was rich at the time of the previous processing cycle. When it was rich at the time of the previous processing cycle, that is, when it changed from rich to lean, the routine proceeds to step 809, where the feedback control coefficient FAF is made FAFR and the routine proceeds to step 810. At step 810, the skip value S is added to the feedback control coefficient FAF, therefore, as shown in FIG. 2, the feedback control coefficient FAF is rapidly increased by exactly the skip value S. Next, at step 805, the average value FAFAV of the FAFL and FAFR is calculated. On the other hand, when it was judged at step 808 that the air-fuel ratio was lean at the time of the previous processing cycle, the routine proceeds to step 811, where the integral value K is added to the feedback control coefficient FAF. Therefore, as shown in FIG. 2, the feedback control coefficient FAF is gradually increased.

At step 312, it is judged if the purge rate PGR is zero or not. When the purge rate is zero, that is, when the purge action is not being performed, the routine jumps to step 821, while when the purge rate PGR is not zero, that is, when the purge action is being performed, the routine proceeds to step 813. At step 813, it is judged if a judgement flag XTNK showing that a large amount of evaporated fuel is being produced in the fuel tank 5 has been set or not. WHEN the judgement flag XTNK is reset (XTNK=0), the routine jumps to step 821, while when the judgement flag XTNK is set (XTNK=1), the routine proceeds to step 814. Therefore, step 814 is proceeded to when the purge action is being performed and a large amount of evaporated fuel is being produced in the fuel tank 15, that is, when the vapor concentration in the amount of intake air changes more than a predetermined concentration in accordance with the amount of intake air.

At step 814, it is judged if a flag set when the engine load is lower than a predetermined set load, for example, the idling flag XIDL set when the engine is idling, is set or not. When the idling flag XIDL is reset (XIDL=0), that is, when not during an idling operation, the routine proceeds to step 815, where it is judged if the set flag XF is set or not. Right after changing from the idling operating state to a non-idling operating state, the set flag XF is set (XF=1). At this time, the routine proceEld to step 816, where the set flag XF is reset (XF<–0). Next, at step 817, the feedback control coefficient FAF is made the first set value tFAF1. As this first set value tFAF1, one of the predetermined first set values tFAF1 shown in FIG. 46 to FIG. 48 is used. Next, the routine proceeds to step 121.

In the next processing cycle, the routine jumps from step 815 to step 821. Therefore, the feedback control coefficient FAF is made the first set value tFAF1 right after the change from the idling operating state to the non-idling operating state. Next, it is updated from step 801 to step 811.

On the other hand, when it is judged at step 814 that the idling flag XIDL is set (XIDL=1), that is, during an idling operation, the routine proceeds to step 818, where it is judged if the set flag XF is reset or not. Right after the change from the non-idling operating state to the idling operating state, the set flag XF is reset. At this time, the routine proceeds to step 819, where the set flag XF is set.

Next, at step 820, the feedback control coefficient FAF is made the second set value tFAF2. As the second set value tFAF2, any one of the predetermined second set values tFAF2 shown in FIG. 46 to FIG. 48 may be used. Next, the routine proceeds to step 821.

At the next processing cycle, the routine jumps from step 818 to step 821. Therefore, the feedback control coefficient FAF is made the first set value tFAF2 right after the charge from the non-idling operating state to the idling operating state. Next, it is updated from step 801 to step 811.

At step 821, the feedback control coefficient FAF is guarded by the upper limit 1.2 and the lower limit 0.8 of the allowable range of fluctuation. That is, the FAF is guarded from becoming larger than 1.2 or becoming smaller than 0.8.

When the routine for calculation of the feedback control coefficient shown in FIG. 50 and FIG. 51 is completed, the routine for learning the air-fuel ratio shown in FIG. 14 is entered.

Next, an explanation will be given of the routine for learning the vapor concentration shown from FIG. 51 to FIG. 53.

Referring to FIG. 51 to FIG. 53, first, at step 840, the count CPGR of the purge execution time is incremented by 1. An explained above, the count CPGR of the purge execution times shows the cumulative time over which the purge action is performed after the engine startup.

Next, at step 841, it is judged if the purge rate PGR is larger than 0.5 percent or not. When PGR a 0.5 percent, that is, except when the purge rate PGR is extremely small, the routine proceeds to step 842, where it is judged if the average value FAFAV of the feedback control coefficient is in the first set range or not, that is, if 1.02>FAFAV>0.98 or not. When the average value FAFAV of the feedback control coefficient is in the first set range, that is, when 1.02>FAFAV>0.98, the routine proceeds to step 848, where the update value tFG of the vapor concentration FGPG per unit purge rate is made zero, then the routine proceeds to step 861. Therefore, at this time, the vapor concentration FGPG is not updated.

On the other hand, when it is judged at step 842 that the average value FAFAV of the feedback control coefficient is outside of the first set range, that is, when FAFAV≧1.02 or FAFAV≦0.98, the routine proceeds to step 843, where it is judged if the count CPGR of the purge execution time is larger than the predetermined set value KCPGR2 or not. This set value KCPGR2 corresponds to about 2 minutes. Therefore, at step 843, it is judged if the purge execution time has exceeded about 2 minutes. When CPGR≦KCPGR2, that is, when the purge execution time is less than about 2 minutes, the routine proceeds to step 847, where the flag XTNK showing that a large amount of evaporated fuel is being produced in the fuel tank 15 is reset, then the routine proceeds to step 849.

On the other hand, when it is judged at step 843 that CPGR>KCPGR2, that is, when the purge execution time is over about 2 minutes, the routine proceeds to step 8444, where it is judged if the idling flag XIDL which is set at the time of idling operation is set (XIDL=1) or not. When the idling flag XIDL is set (XIDL=1), that is, at the time of idling operation, the routine proceeds to step 845, where it is judged if the average value FAFAV of the feedback control coefficient is smaller than 0.9 or not. When FAFAV≧0.9, the routine jumps to step 849. As opposed to this, when FAFAV<0.9, the routine proceeds to step 846, where the flag XTNK showing that a large amount of evaporated fuel is being produced in the fuel tank 15 is set (XTNK1=1) and then the routine proceeds to step 849.

At step 8419, it is judged if the flag XTNK is set or not, that is, if FAF<0.9 during an idling operation. In other words, it is judged if a large amount of evaporated fuel is being produced in the fuel tank 15. When the flag XTNK is not set, that is, when a large amount of evaporated fuel is not being produced in the fuel tank 15, the routines proceeds to stop 856, where the update value tFG of the vapor concentration FGPG is calculated based on the following equation:

$$tFG=(1.0-FAFAV)/PGR\cdot a$$

Here, a is, for example, 2. At this time, if the average value FAFAV of the feedback correction coefficient exceeds the first set range (between 0.98 and 1.02), half of the deviation of the FAFAV with respect to 1.0 is made the update value tFG. Therefore, at this time, FAFAV is gradually returned to the first set range as shown in FIG. 4.

On the other hand, when it is judged at step 149 that the flag XTNK in set, that is, when a large amount of evaporated fuel is being produced in the fuel tank 15, the routine proceeds to step 850, where the upper limit tK1 and the lower limit tX2 of the second set range shown in FIG. 46 to FIG. 48 are calculated. In the embodiment shown in FIG. 46 to FIG. 48, the upper limit tK1 and the lower limit tK2 are constant values. Next, from step 851 to stop 855, when the average value FAFAV of the feedback control coefficient is outside the second range (between tK1 and tX2), half of the amount by which the second set range is exceeded is made the update value tFG of the vapor concentration FGPG.

That is, at stop 851, it is judged if the average value FAFAV of the feedback control coefficient is larger than the upper limit tK1 of the second set range. When FAFAV>tK1, the routine proceeds to step 853, where the update value tFG is calculated based on the following equation:

$$tFG=(tK1-FAFAV)/PCR\cdot a$$

Here, a is for example 2. That is, when FAFAV exceeds the upper value tX1 of the second set range, half of the difference of the upper limit tK1 and FAFAV is made the update value tFG. At this time, FAFAV is gradually returned to the upper limit tK1 of the second set range.

On the other hand, when it is judged at step 851 that FAFAV≦tK1, the routine proceeds to step 852, where it is judged if the average value FAFAV of the feedback control coefficient is smaller than the lower limit tK2 of the second set range. When FAFAV<tX2, the routine proceeds to step 854, where the update value tFG is calculated based on the following formula.

$$tFG=(tK2-FAPAV)/PGR\cdot a$$

Here too, a is for example 2. That is, when FAFAV becomes smaller than the lower value tK2 of the second set range, half of the difference of the lower limit tK2 and FAFAV is made the update value tFG. At this time, FAFAV is gradually returned to the lower limit tK2 of the second set range.

On the other hand, when it is judged at step 852 that FAFAV≧tK2, that is, when the average value FAFAV of the feedback control coefficient is in the second set range, the routine proceeds to step 855, where the update value tFG is made zero. Therefore, when FAFAV is in the second set range, the vapor concentration FGPG is not updated.

If the update value tFG is calculated at step 848, 853, 854, 855, or 856, the routine proceeds to step 861, where the update value tFG is added to the vapor concentration FGPG. Next, the routine proceeds to the routine for calculation of the fuel injection time shown in FIG. 17.

On the other hand, when it is judged at step 841 that PGR<0.5 percent, the routine proceeds to step 857, where it is judged if the feedback control coefficient FAF is larger than 1.1. When FAF>1.1, the routine proceeds to step 859, where the update value tFG is made the constant value −Y, then the routine proceeds to step 861. On the other hand, when it is judged at step 857 that FAF≦1.1, the routine proceeds to step 858, where it is judged if the feedback control coefficient FAF is smaller than 0.9 or not. When FAF<0.9, the routine proceeds to step 860, where the update value tFG is made the constant value Y, then the routine proceeds to step 861. When it is judged at step 858 that FAF≧0.9, the routine proceeds to the routine for calculation of the fuel injection time shown in FIG. 17.

Note that in the eighth embodiment to the 10th embodiment as well, as shown in FIG. 18, the upper limit tK1 and the lower limit tK2 of the second set range may be changed in accordance with the amount of intake air Q.

As explained at the beginning, however, the air-fuel ratio does not only fluctuate due to the effect of the purge action. It also fluctuates when the state of driving of the vehicle changes. That is, the amount of change ΔFAF of the feedback control coefficient FAF in FIG. 4 includes not only the fluctuation of the air-fuel ratio due to the effects of the purge action, but also the fluctuations of the air-fuel ratio due to changes in the state of driving of the vehicle. Therefore, if all of the amount of change ΔFAF of the feedback control coefficient FAF were reflected back into the update value tFG, the vapor concentration FPG would deviate from the actual vapor concentration.

The amount of deviation of the vapor concentration changes due tot the purge rate PGR. As explained at the start, when the purge rate PGR is small, if all of the feedback control coefficient FAF were reflected back into the update value tFG, the vapor concentration FPG would deviate widely from the actual vapor concentration.

Therefore, in the embodiments explained from here, the update value tFG is made smaller when the purge rate PGR is small than when the purge rate PGR is large even when the amount of fluctuation ΔFAF of the feedback control coefficient FAF is the same.

Figure 54:
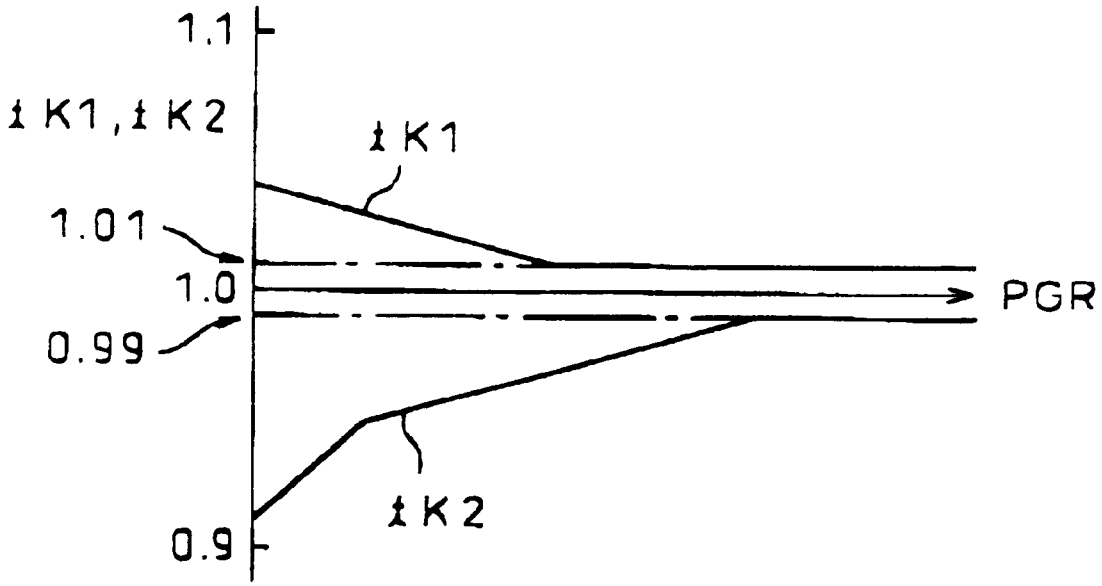
FIG. 54 is a view of an upper limit tK1 and a lower limit tK2 of a set range.

FIG. 54 shows an 11th embodiment where the update value tFG is made smaller when the purge rate PGR is small than when the purge rate PGR is large. That is, in the 11th embodiment, a set range (between tK1 and tK2) centered about the reference value 1.0 of the feedback control coefficient FAF is set for the feedback control coefficient FAF as a function of the purge rate PGR so as to detect the deviation of the air-fuel ratio. The upper limit tK1 of this set range is made larger the smaller the purge rate PGR becomes when the purge rate PGR is less than a predetermined value, while the lower limit tK2 is made smaller the smaller the purge rate PGR when the purge rate PGR is less than a predetermined value.

Further, in the 11th embodiment, when the average value FAFAV of the feedback correction coefficient becomes larger than the upper limit tK1, the amount of deviation (tK1−FAFAV) of the average value FAFAV of the feedback correction coefficient is reflected back into the update value tFG of the vapor concentration. That is, in the 11th embodiment, the update value tFG is expressed by the following equation:

$$tFG-(tK1-FAFAV)/(PGR\cdot a)$$

Here, a is 2.0. Therefore, even when the amount of deviation of the feedback control coefficient FAF with respect to the reference value 1.0 is the same, When the purge rate PGR is small, the update value tFG becomes smaller.

Further, in the 11th embodiment, When the average value FAFAV of the feedback correction coefficient becomes smaller than the lower limit tK2, the amount of deviation (tK2−FAFAV) of the average value FAFAV of the feedback correction coefficient with respect to the lower limit tK2 is reflected into the update value tFG of the vapor concentration. That is, in the 11th embodiment, the update value tFG is expressed by the following equation:

$$tFG=(tK2-FAFAV)/(PGR\cdot a)$$

Here, a is 2.0. Therefore, even when the amount of deviation of the feedback control coefficient FAF with respect to the reference value 1.0 is the same, When the purge rate PGR is small, the update value tFG becomes smaller.

On the other hand, when the amount of deviation of the average value FAFAV of the feedback correction coefficient is between the upper limit tK1 and the lower limit tK2, the update value tFG is made zero. Therefore, at this time, the vapor concentration FGPG is not updated.

In the 11th embodiment, as shown in FIG. 54, the value of (tK1−1.0) when the purge rate PGR is small becomes smaller than the value of (1.0−tK2). The reason is given below. That is, along with the elapse of time after the start of a purge, the actual vapor concentration gradually becomes smaller. If the actual vapor concentration becomes smaller, FAFAV becomes larger. That is, FAFAV>1.0. Therefore, at this time, the value of (tK1−1.0) is made smaller so that the vapor concentration FGPG can track the actual vapor concentration with a good response. On the other hand, when FAFAV<1.0, that is, when the air-fuel ratio temporarily becomes rich, if the vapor concentration FGPG is increased widely, the air-fuel ratio will then become lean and the engine operating efficiency will deteriorate. Therefore, at this time, even it the air-fuel ratio becomes temporarily rich, the value of (1.0−tK2) is made larger so that the vapor concentration FGPG is not widely increased.

Figure 56:
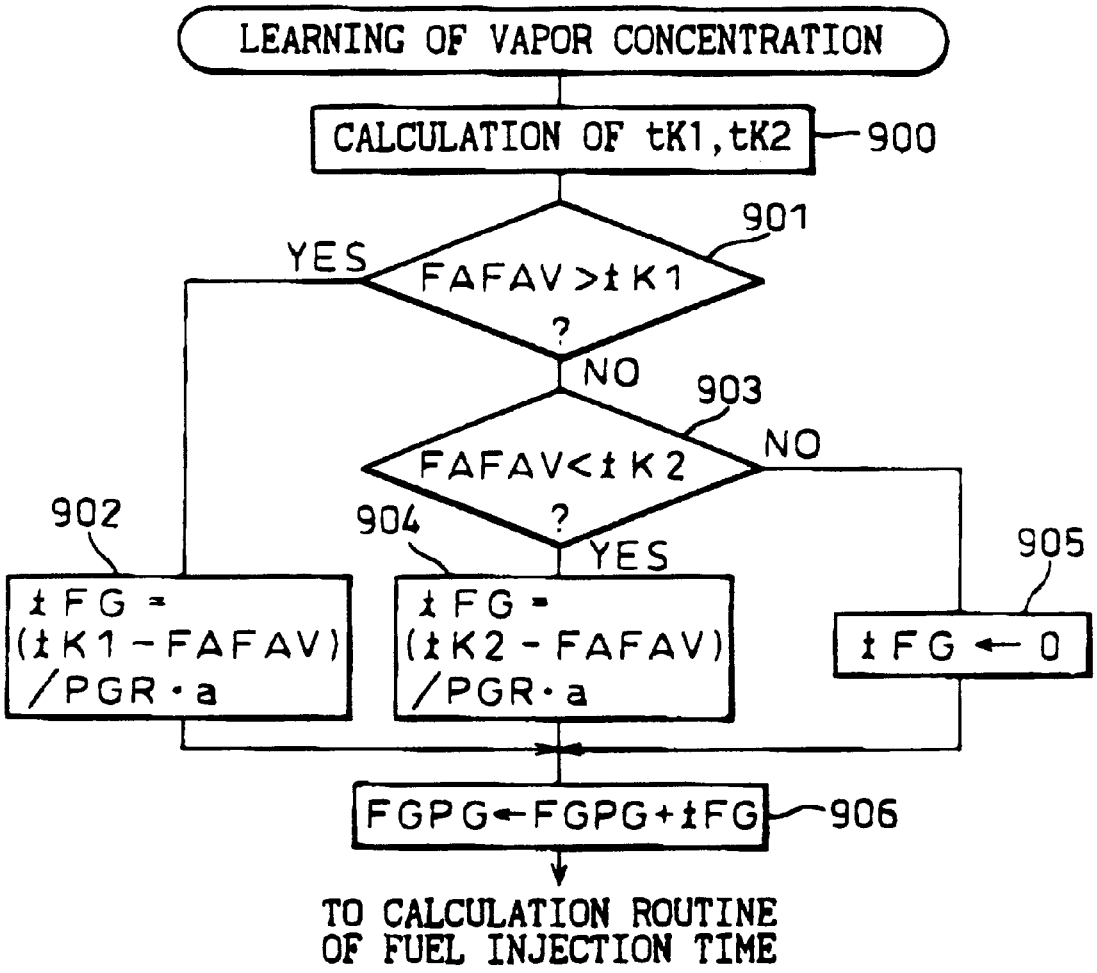
FIG. 56 is a flow chart of the learning of a vapor concentration used in an 11th embodiment.

FIG. 56 shows the routine for learning the vapor concentration for working the 11th embodiment. Note that outside of the routine for learning the vapor concentration, the routines used in the first embodiment are used as they are.

Referring to FIG. 56, first, at step 900, the upper limit tK1 and the lower limit tK2 are calculated based on the purge rate PGR from the relationship shown in FIG. 54. Next, frown step 901 to step 906, when the average value FAFAV of the feedback correction coefficient is outside of a set range (between tK1 and tK2), half of the amount by which the set range is exceeded is made the update value tFG of the vapor concentration FGPG.

That is, at step 901, it is judged if the average value FAFAV of the feedback control coefficient is larger is than the upper limit tK1 of the set range. When FAFAV>tK1, the routine proceeds to step 902, where the update value tFG is calculated based on the following equation:

$$tFG=(tK1-FAFAV)/PGR\cdot a$$

Here, a is for example 2. That is, when FAFAV exceeds the upper value tK1 of the second set range, half of the difference of the upper limit tK1 and FAFAV is made the update value tFG.

On the other hand, when it is judged at step 901 that FAFAV≦tK1, the routine proceeds to stop 903, where it is judged if the average value FAFAV of the feedback control coefficient is smaller than the lower limit tK2 of the set range. When FAFAV<tK2, the routine proceeds to stop 904, where the update value tFG is calculated based on the following formula.

$$tFG=(tK2-FAFAV)/PGR\cdot a$$

Here too, a is for example 2. That is, when FAFAV becomes smaller than the lower value tK2 of the set range, half of the difference of the lower limit tK2 and FAFAV is made the update value tFG.

On the other hand, when it is judged at step 903 that FAFAV≧tK2, that is, when the average value FAFAV of the feedback control coefficient is in the set range, the routine proceeds to step 905, where the update value tFG is made zero. Therefore, when FAFAV is in the set range, the vapor concentration FGPG is not updated.

If the update value tFG is calculated at step 902, S 904, or 905, the routine proceeds to step 906, where the update value tFG is added to the vapor concentration FGPG. Next, the routine proceeds to the routine for calculation of the fuel injection time shown in FIG. 17.

Next, an explanation will be made of a 12th embodiment. When the purge action is started, it is preferable to end the learning of the vapor concentration as fast as possible so as to prevent fluctuation of the air-fuel ratio. Therefore, in the 12th embodiment, the learning of the vapor concentration is avoided as much as is possible and the learning of the vapor concentration is ended as fast as possible by using the upper limit tK3 and the lower limit tK4 shown in FIG. 55 for a certain period after the vapor action is started, then using the upper limit tK1 and the lower limit tK2 shown in FIG. 54 after a predetermined period elapses after the purge action is started.

Figure 55:
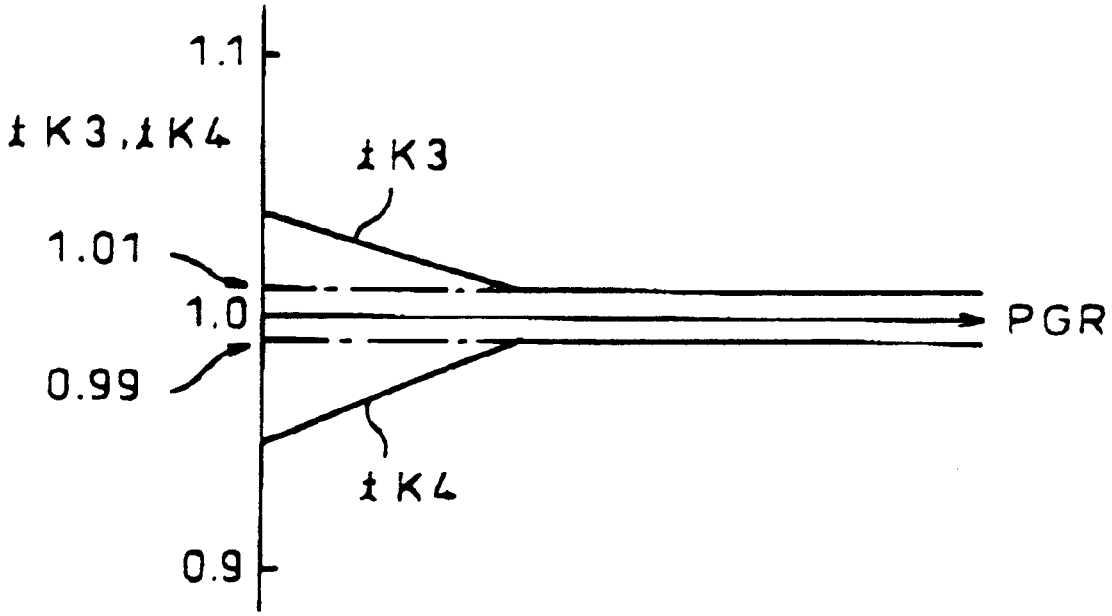
FIG. 55 is a view of an upper limit tX3 and a lower limit tK4 in a set range.

That is, the lower limit tK4 shown in FIG. 55 is made a value larger than the lower value tK2 shown in FIG. 54. Therefore, when the amount of deviation of the feedback control coefficient FAF with respect to the reference value 1.0 is the same, the update value tFG becomes larger in the case shown in FIG. 55 than the case shown in FIG. 54 and therefore it is possible to end the learning of thet vapor concentration earlier.

Figure 57:
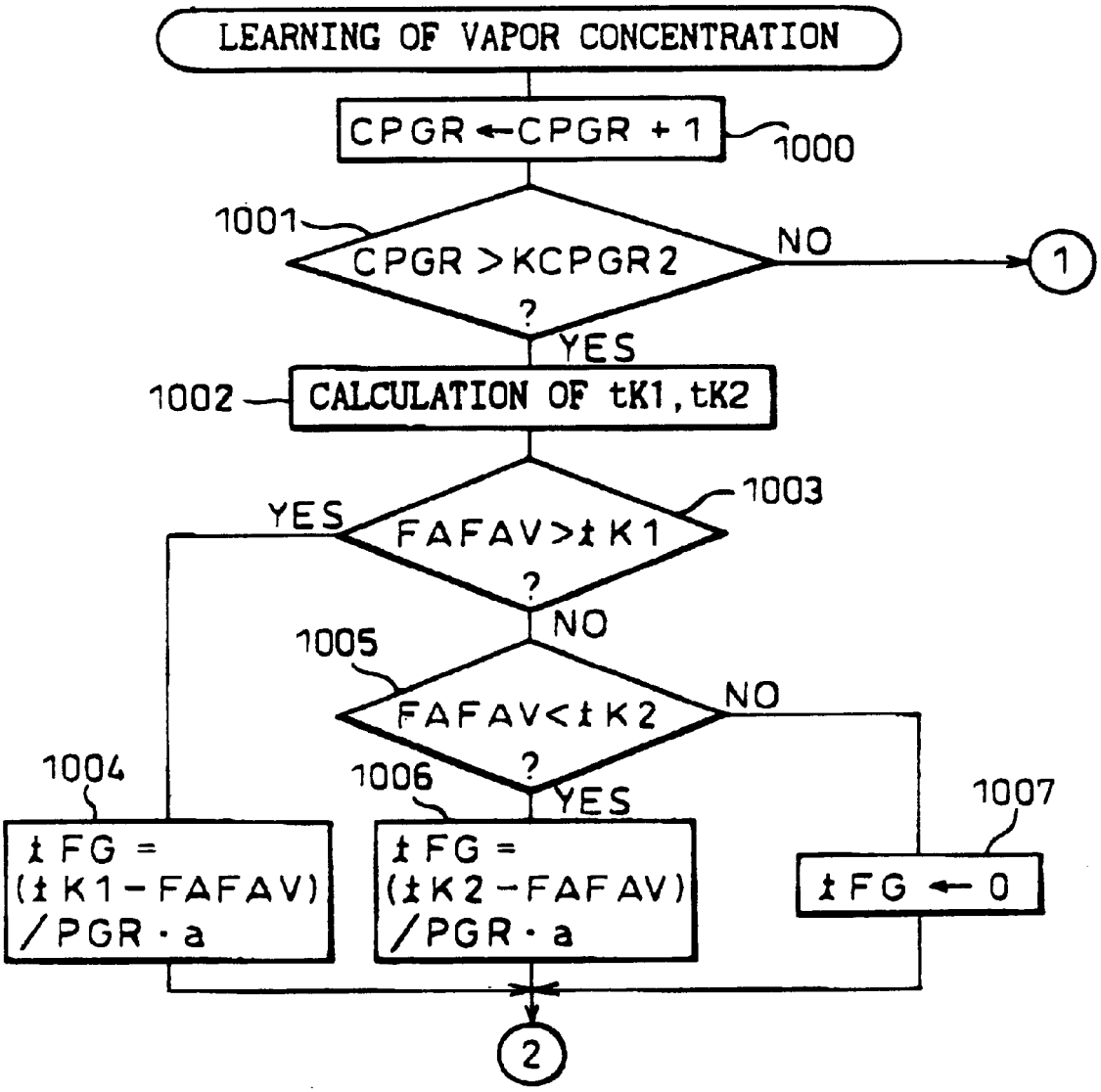
FIGS. 57 and 58 are flow charts of the learning of the vapor concentration used in a 12th embodiment.

FIG. 57 and FIG. 53 show the routine for leaning the vapor concentration for working the 12th embodiment. Note that outside of the routine for learning the vapor concentration, the routines used in the first embodiment are used as they are.

Figure 58:
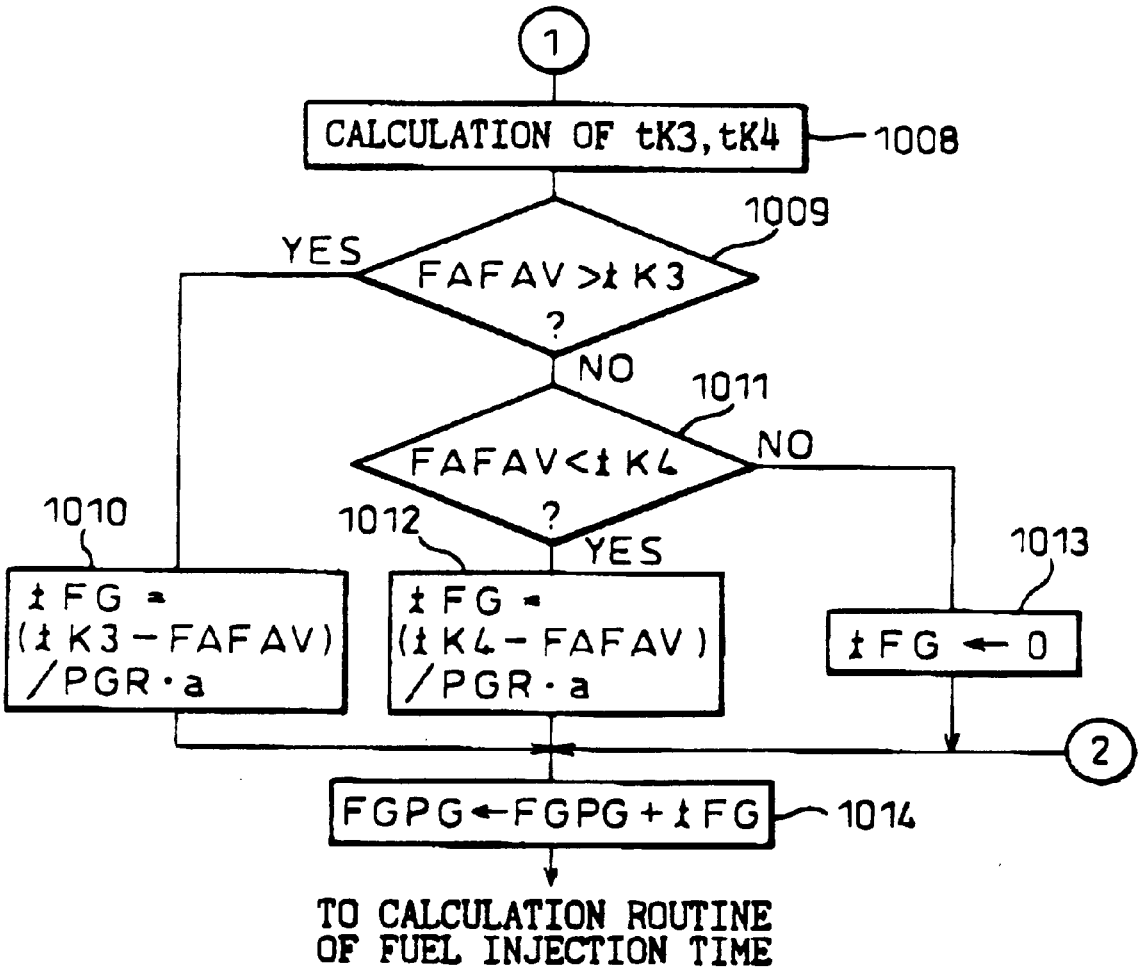

Referring to FIG. 57 and FIG. 58, first, at step 1000, the count. CPGR of the purge execution time is incremented by 1. As explained above, the count CPGR of the purge execution time shows the cumulative time during which the purge operation was performed after the startup of the engine.

Next, at step 1001, it is judged if the count CPGR of the purge execution time is larger than the predetermined set value KCPGR2 or not. This set value KCPGR2 corresponds to about 2 minutes. Therefore, at step 1001, it is judged if the purge execution time has exceeded about 2 minutes. When the purge execution time has exceeded 2 minutes, it is considered that the learning of the vapor concentration has ended. Therefore, at step 1001, it is judged that if the learning of the vapor concentration has ended or not.

When CPGR≦KCPGR2, that is, when 2 minutes have not is elapsed from the start of the purge, the routine proceeds to step 1008, where the upper limit tK3 and the lower limit tK4 are calculated based on the purge rate PGR from the relationship shown in FIG. 55. Next, from step 1009 to step 1013, when the average value FAFAV of the feedback correction coefficient exceeds a set range (between tK3 and tK4), half of the amount by which the set range is exceeded is made the update value tFG of the vapor concentration FGPG.

That is, at step 1009, it is judged if the average value FAFAV of the feedback correction coefficient is larger than the upper limit tK3 of the set range. When FAFAV>tK3, the routine proceeds to step 1010, where the update value tFG is calculated based on the following equation:

$$tFG=(tK3-FAFAV)/PGR\cdot a$$

Here, a is for example 2. That is, when FAFAV exceeds the upper limit tK3 of the set range, half of the difference between the upper limit tK3 and FAFAV is made the update values tFG.

On the other hand, when it is judged at step 1009 that FAFAV≦tK3, the routine proceeds to step 1011, where it is judged if the average value FAFAV of the feedback correction coefficient is smaller than the lower limit tK4 of the set range or not. When FAFAV<tK4, the routine proceedi3 to step 1012, where the update value tFG is calculated based on the following equation:

$$tFG=(tK4-FAFAV)/PGR\cdot a$$

Here too, a is for example 2. That is, when FAFAV becomes smaller than even the lower value tK4 of the set range, half of the difference of the lower limit tK4 and FAFAV is made the update value tFG.

On the other hand, when it is judged at step 1011 that FAFAV≧tK4, that is, when the average value FAFAV of the feedback control coefficient is in the set range, the routine proceeds to step 1013, where the update value tFG is made zero3. Therefore, when FAFAV is in the set range, the vapor concentration FGPG is not updated.

If the update value tFG is calculated at step 1010, 1012, or 1013, the routine proceeds to step 1014, where the update value tFG is added to the vapor concentration FGPG. Next, the routine proceeds to the routine for calculation of the fuel injection time shown in FIG. 17.

On the other hand, when it is judged at step 1001 that CPGR>KCPGR2, that is, when it is judged that the learning of the vapor concentration is completed, the routine proceeds to step 1002, where the upper limit tK1 and the lower limit tK2 are calculated based on the purge rate PGR from the relationship shown in FIG. 54. Next, from step 1004 to step 1007, when the average value FAFAV of the feedback correction coefficient is out of the set range (between tK1 and tK2), half of the amount by which the set range is exceeded is made the update value tFG of the vapor concentration FGPG.

That is, at step 1003, it is judged if the average value FAFAV of the feedback correction coefficient is larger than the upper limit tK1 of the set range or not. When FAFAV>tK1, the routine proceeds to step 1004, where the update value tFG is calculated based on the following equation:

$$tFG-(tK1-FAFAV)/PGR\cdot a$$

Here, a is for example 2. That is, when FAFAV exceeds the upper limit tK1 of the set range, half of the difference between the upper limit tK1 and FAFAV is made the update value tFG.

On the other hand, when it is judged at step 1003 that FAFAV≦tK1, the routine proceeds to step 1005, where it is jucLged if the average value FAFAV of the feedback correction coefficient is smaller than the lower limit tK2 of the set range or not. When FAFAV<tK2, the routine proceeds to step 1006, where the update value tFG is calculated based on the following equation:

$$tFG-(tK2-FAFAV)/PGR\cdot a$$

Here too, a is for example 2. That is, when FAFAV becomes smaller than even the lower value tK2 of the set range, half of the difference of the lower limit tK2 and FAFAV is made the update value tFG.

On the other hand, when it is judged at step 1005 that FAFAV≧tK2, that is, when the average value FAFAV of the feedback control coefficient is in the set range, the routine proceeds to step 1007, where the update value tFG is made zero. Therefore, when FAFAV is in the set range, the vapor concentration FGPG is not updated.

If the update value tFG is calculated at step 1004, 1006, or 1007, the routine proceeds to step 1014, where the update value tFG is added to the vapor concentration FGPG.

Next, a 13th embodiment will be explained. In the 13th embodiment, the updating action of the vapor concentration is stopped when the purge rate PGR falls under a predetermined value, for example, 0.9 percent, after the learning of the vapor concentration is completed.

Figure 59:
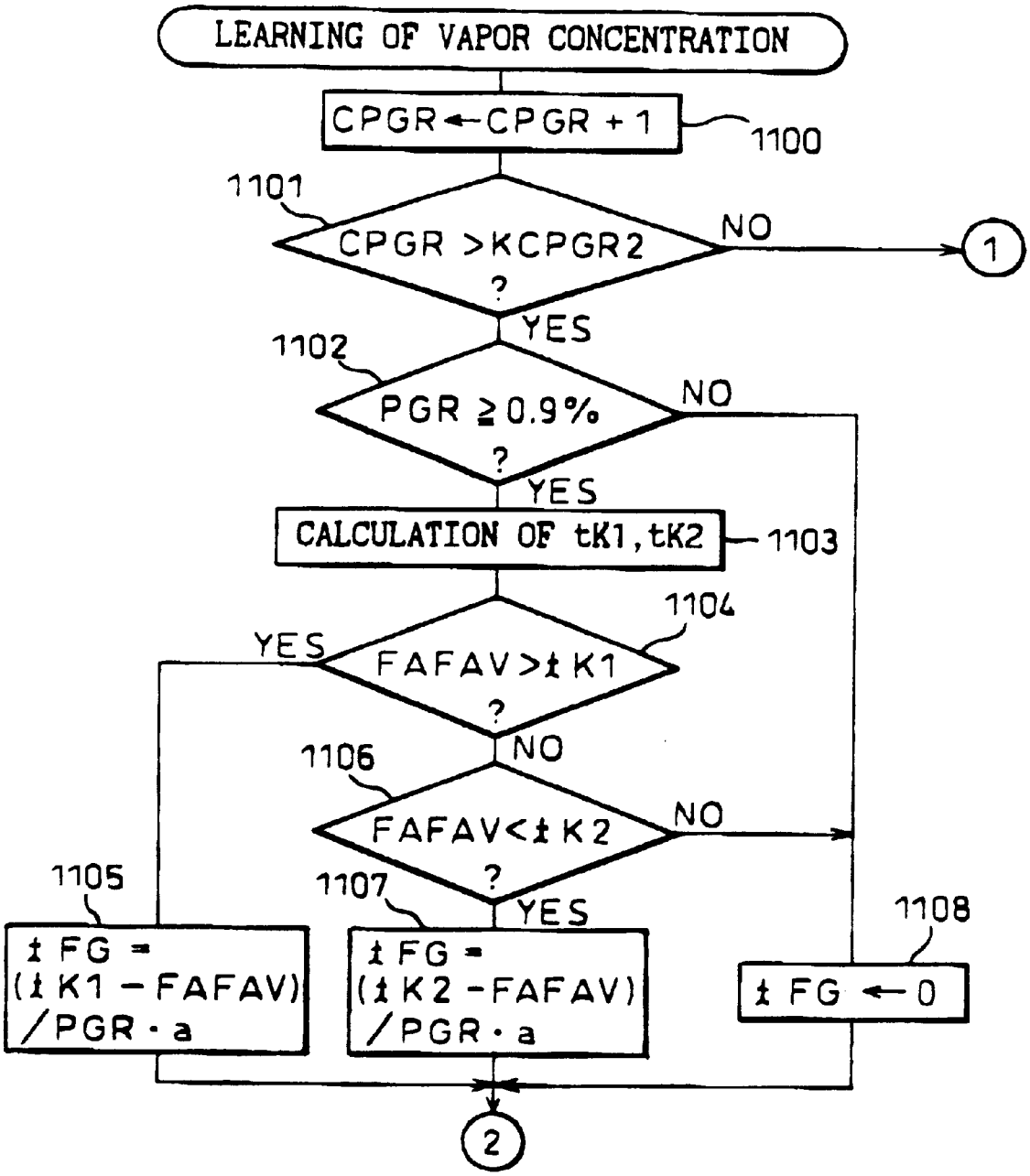
FIGS. 59 and 60 are flow charts of the learning of the vapor concentration used in a 13th embodiment.
Figure 60:
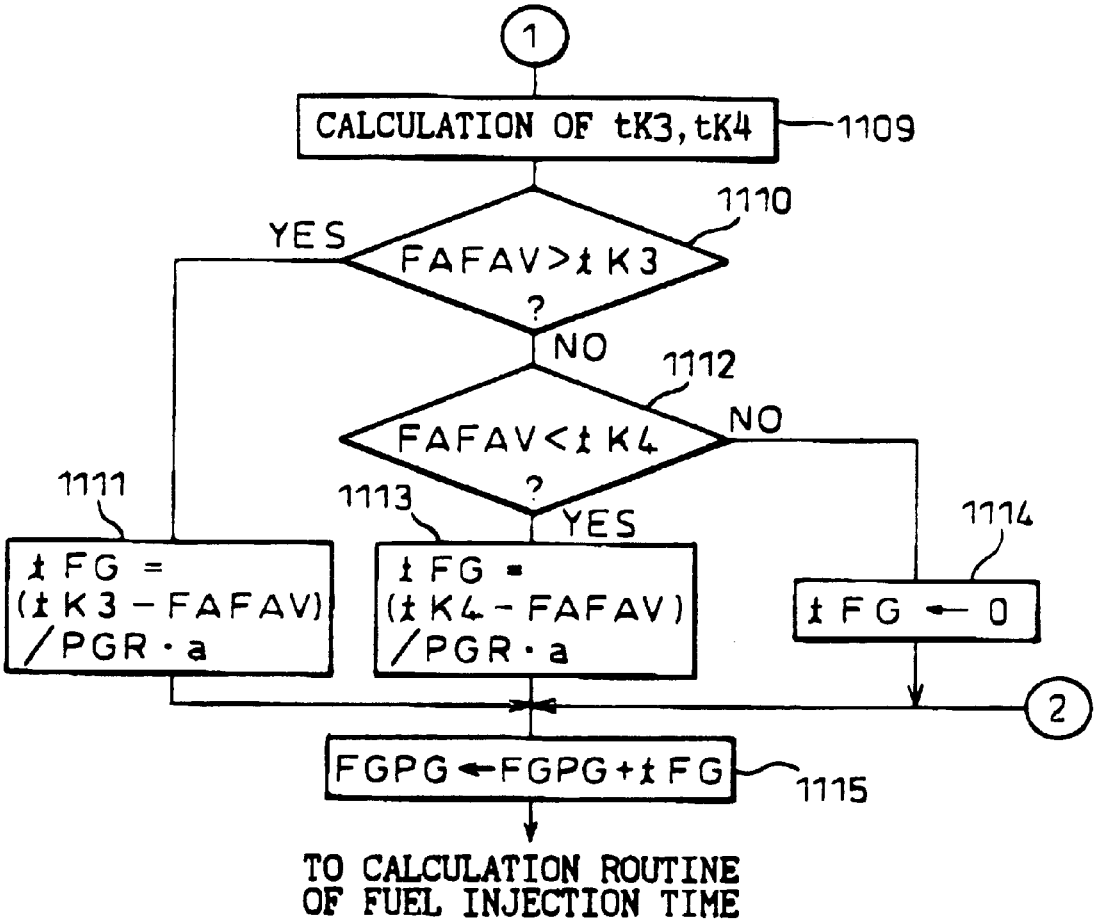

FIG. 59 and FIG. 60 show a routine for learning the vapor concentration for working the 13th embodiment. Note that the routines other than the routine for learning the vapor concentration are the same as those used in the first embodiment.

Referring to FIG. 59 and FIG. 60, first, at step 1100, the count CPGR of the purge execution time is incremented by 1. As explained above, the count CPGR of the purge execution time shows the cumulative time during which the purge action has been performed after engine startup.

Next, at step 1101, it is judged if CPGR>KCPGR2, that is, if 2 minutes have elapsed from the start of the purge action. When CPGR≦KCPGR2, the routine proceeds to step 1109, where the upper limit tK3 and the lower limit tK4 are calculated based on the purge rate PGR from the relationship shown in FIG. 55. Next, from step 1110 to step 1114, when the average value FAFAV of the feedback correction coefficient is out of the set range (between tX3 and tK4), half of the amount by which the set range is exceeded is made the update value tFG of the vapor concentration FGPG.

That is, at step 1110, it is judged if the average value FAFAV of the feedback correction coefficient is larger than the upper limit tK3 of the set range or not. When FAFAV>tK3, the routine proceeds to step 1111, where the update value tFG is calculated based on the following equation:

$$tFG-(tK3-FAFAV)/PGR\cdot a$$

Here, a is for example 2. That is, when FAFAV exceeds the upper limit tK3 of the set range, half of the difference between the upper limit tK3 and FAFAV is made the update value tFG.

On the other hand, when it is judged at step 1110 that FAFAV≦tK3, the routine proceeds to step 1112, where it is judged if the average value FAFAV of the feedback correction coefficient is smaller than the lower limit tK4 of the set range or not. When FAFAV<tK4, the routine proceeds to step 1113, where the update value tFC is calculated based on the following equation:

$$tFG-(tK4-FAFAV)/PGR\cdot a$$

Here too, a is for example 2. That is, when FAFAV becomes smaller than even the lower value tK4 of the set range, half of the difference of the lower limit tK4 and FAFAV is made the update value tFG.

On the other hand, when it is judged at step 1112 that FAFAV≧tK4, that is, when the average value FAFAV of the feedback control coefficient is in the set range, the routine proceeds to step 1114, where the update value tFG is made zero. Therefore, when FAFAV is in the set range, the vapor concentration FGPG is not updated.

If the update value tFG is calculated at step 1111, 1113, or 1114, the routine proceeds to step 1115, where the update value tFG is added to the vapor concentration FGPG. Next, the routine proceeds to the routine for calculation of the fuel injection time shown in FIG. 17.

On the other hand, when it is judged at step 1101 that CPGR>KCPGR2, that is, when it is judged that 2 minutes have elapsed from the start of the purge action, the routine proceeds to step 1102, where it is judged if the purge rate PGR is larger than a predetermined value, for example, 0.9 percent or not. When PGR≦0.9 percent, that is, when the purge rate PGR is small, the routine proceeds to step 1108, where the update value tFG is made zero. That is, when the purge rate PGR is small, the update action of the vapor concentration FGPG is stopped.

As opposed to this, when PGR≧0.9 percent, the routine proceeds to step 1103, where the upper limit tK1 and the lower limit tK2 are calculated based on the purge rate PGR from the relationship shown in FIG. 54. Next, from step 1104 to step 1108, when the average value FAFAV of the feedback correction coefficient is out of the set range (between tK1 and tK2), half of the amount by which the set range is exceeded is made the update value tFG of the vapor concentration FGPG.

That is, at step 1104, it is judged if the average value FAFAV of the feedback correction coefficient is larger than the upper limit tK1 of the set range or not. When FAFAV>tK1, the routine proceeds to step 1105, where the update value tFG is calculated based on the following equation:

$$tFG-(tK1-FAFAV)/PGR\cdot a$$

Here, a is for example 2. That is, when FAFAV exceeds the upper limit tK1 of the set range, half of the difference between the upper limit tK1 and FAFAV is made the update value tFG.

On the other hand, when it is judged at step 1104 that FAFAV≦tK1, the routine proceeds to step 1106, where it is judged if the average value FAFAV of the feedback correction coefficient is smaller than the lower limit tK2 of the set range or not. When FAFAV<tK2, the routine proceeds to step 1107, where the update value tFG is calculated based on the following equation:

$$tFG=(tK2-FAFAV)/PGR\cdot a$$

Here too, a is for example 2. That is, when FAFAV becomes smaller than even the lower value tK2 of the set range, half of the difference of the lower limit tK2 and FAFAV is made the update value tFG.

On the other hand, when it is judged at step 1106 that FAFAV≧tK2, that is, when the average value FAFAV of the feedback control coefficient is in the set range, the routine proceeds to step 1108, where the update value tFG is made zero. Therefore, when FAFAV is in the set range, the vapor concentration FGPG is not updated.

If the update value tFG is calculated at step 1105, 1107, or 1108, the routine proceeds to step 1115, where the update value tFG is added to the vapor concentration FGPG.

Note that the update action of the vapor concentration FGPG is performed every time the count CPGR of the purge execution time is incremented. Therefore, the count CPGR of the purge execution time shows the number of updates of the vapor concentration FGPG and therefore CPGR>KCPGR2 can be said to judge if the number of updates of the vapor concentration FGPG exceeds a predetermined value or not.

Next, a 14th embodiment will be explained. In the 14th embodiment, all of the amount of change AFAF (=1.0−FAF) of the feedback control coefficient FAF shown in FIG. 4 is reflected back once into the update value tFG regardless of the purge rate PGR. Next, a limit is placed on the update value tFG so that the cumulative value of the update value tFG will not exceed a set value determined by the purge rate PGR.

Figure 61:
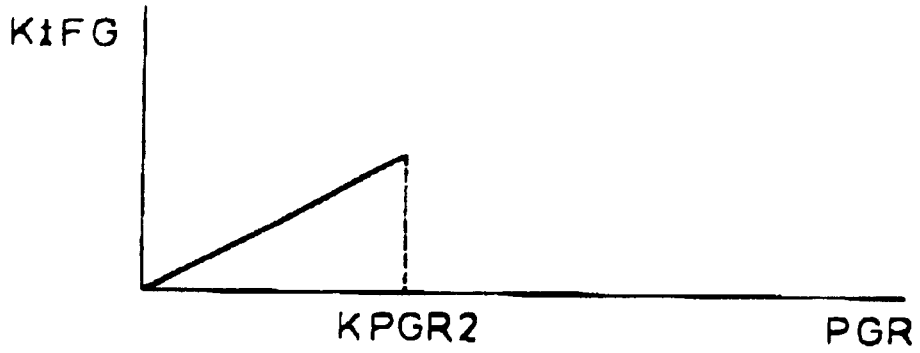
FIG. 61 is a view of the allowable limit KtFG.

That is, FIG. 61 shows the allowable limit KtFG on the cumulative value of the update value tFG for preventing the vapor concentration from increasing over a predetermined value when the purge rate PGR becomes larger than a small value, that is, the cumulative update value of the vapor concentration FGPG. That is, when the air-fuel ratio is fluctuating due to a change in the driving state ofl the vehicle in addition to the effect of the purge action, if the cumulative update value of the vapor concentration FGPG exceeds the allowable limit KtFG, when the purge rate PGR becomes larger, the calculated vapor concentration FGPG will deviate widely from the actual vapor concentration. Therefore, it becomes necessary to limit the update value tFG so that the cumulative update value of the vapor concentration FGPG does not exceed the allowable limit KtFG.

In this case, even if the cumulative update value of the vapor concentration FGPG is small the smaller the purge rate PGR, the amount of deviation of the vapor concentration FGPG becomes larger when the purge rate PGR becomes larger and therefore, as shown in FIG. 61, the allowable limit KtFG becomes smaller the smaller the purge rate PGR. Note that the allowable limit KtFG is set for a purge rate PGR under KPGR2 (=2%).

Figure 62:
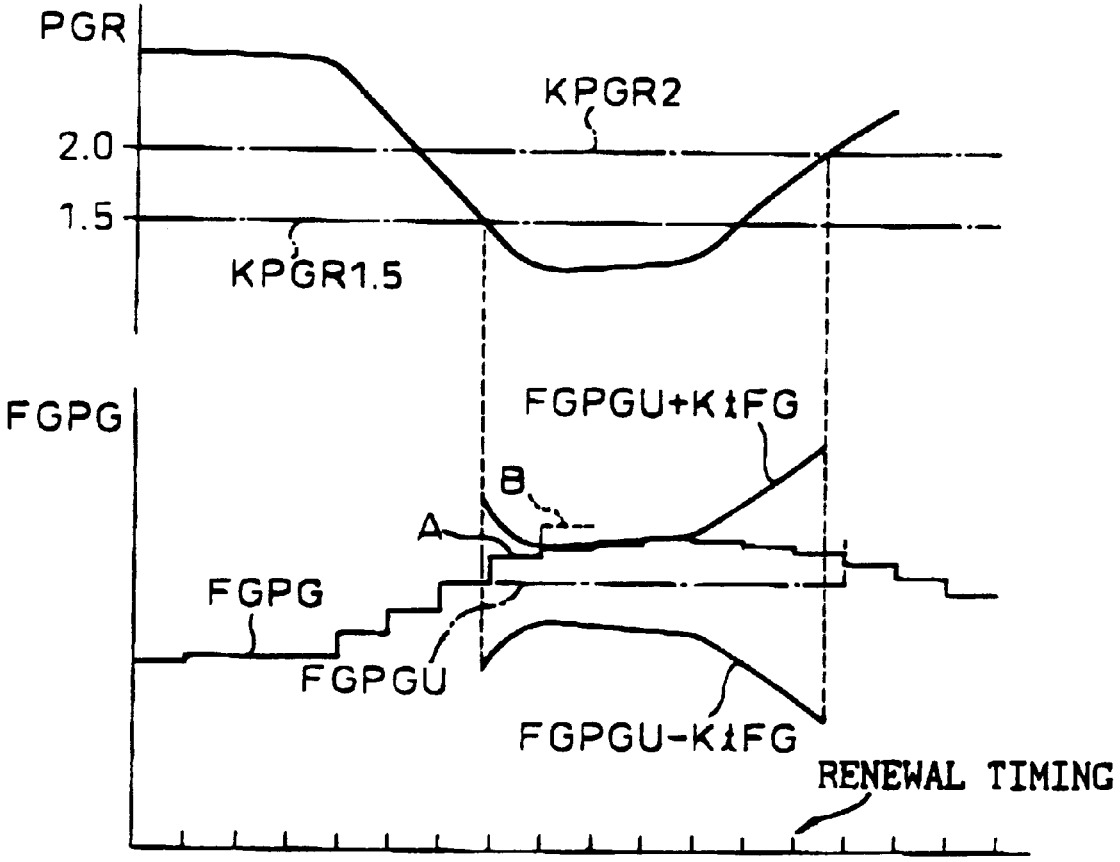
FIG. 62 is a view of the changes in the vapor concentration FGPG.

Next, a detailed explanation will be given of the control of the update value KtFG used in the 14th embodiment with reference to the FIG. 62. As shown in FIG. 62, if the purge rate PGR becomes less than the predetermined value KPGR1.5 (−1.5%), the vapor concentration FGPG at that time is stored as the reference vapor concentration FGPGU. Next, the value of the reference vapor concentration FGPGU plus the allowable limit KtFG (FGPGU+KtFG) is made the allowable upper limit of the fluctuation of the vapor concentration FGPG, while the value of the reference vapor concentration FGPGU minus the allowable limit KtFG (FGPGU−KtFG) is made the allowable lower limit of the fluctuation of the vapor concentration FGPG. If the purge rate PGR changes, the allowable limit KtFG also changes, so as shown in FIG. 62, the allowable upper limit (FGPGU+XtFG) and the allowable lower limit (FGPGU−KtFG) change in accordance with the purge rate PGR.

After the purge rate PGR becomes less than KPGR1.5, the vapor concentration FGPG is updated. When the updated vapor concentration FGPG is between the allowable upper limit (FGPGU+KtFG) and the allowable lower limit (FGPGU−KtFG) as shown by A in FIG. 62, the vapor concentration FGPG is updated to A. That is, the update value at this time is made the calculated update value tFG. Next, the vapor concentration FGPG is again updated. When the further updated vapor concentration FGPG ends up over the allowable upper limit (FCPGU+KtFG) as shown by the broken line B in FIG. 62, the update value is made an update value smaller than the update value tFG calculated. The vapor concentration FGPG at this time is made the allowable upper limit (FGPGU+KtFG). Next, if the calculated update value tFG continues to be a relatively large value, as shown in FIG. 62, the vapor concentration FGPG is changed along with the allowable upper limit (FGPGU+KtFG).

In this way, when the purge rate PGR becomes smaller than the predetermined value KPGR1.5 (=1.5%), the range of fluctuation of the vapor concentration FGPG is limited to between the allowable upper limit (FGPGU+KtFG) and the allowable lower limit (FGPGU−KtFG). This limitation continues until the purge rate PGR exceeds the predetermined value KPGR2 (=2%). That is, hysteresis is provided for the purge rate PGR limiting the range of fluctuation of the vapor concentration FGPG.

Figure 63:
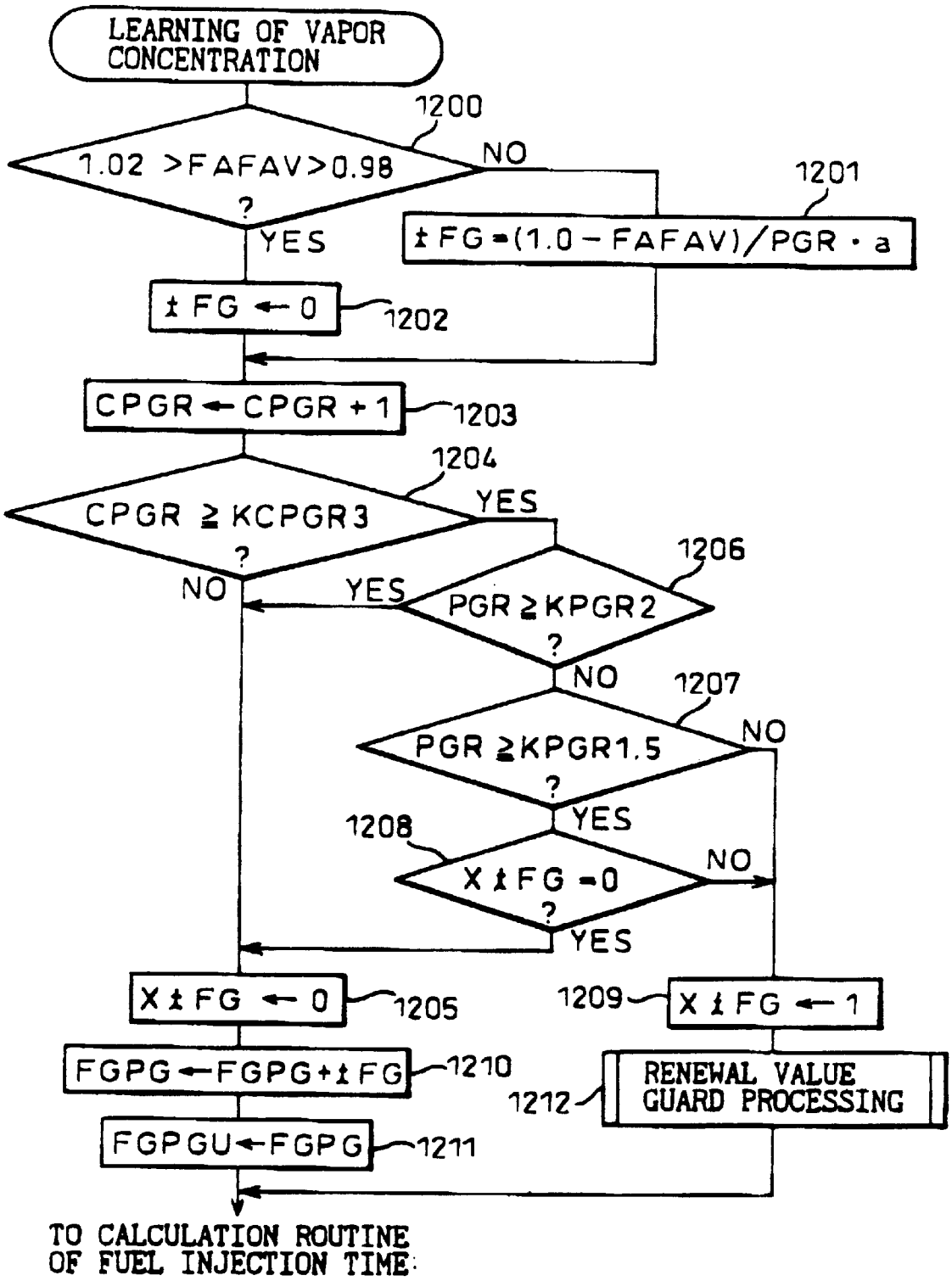
FIG. 63 is a flow chart of the learning of the vapor concentration used in a 14th embodiment.
Figure 64:
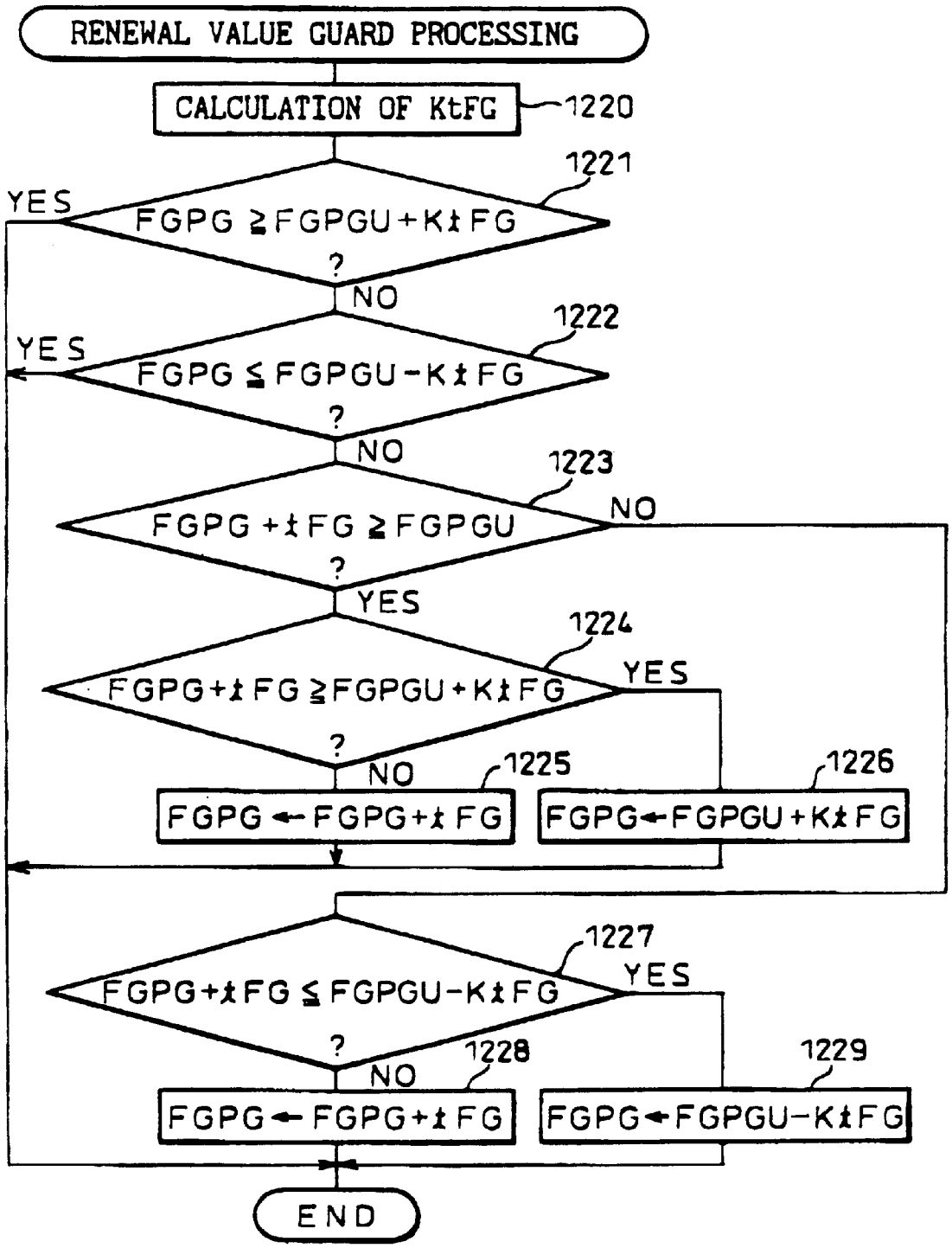
FIG. 64 is a flow chart of the execution of processing for guarding an update amount used in a 14th embodiment.

FIG. 63 and FIG. 64 show a routine for learning the vapor concentration for working the 14th embodiment. Note that the routines other than the routine for learning of this vapor concentration are the same as those used for the first embodiment.

Referring to FIG. 63 and FIG. 64, first, at step 1200, it is judged if the average value FAFAV of the feedback control coefficient is in the set range or not, that is, if 1.02>FAFAV>0.98 or not. When the average value FAFAV of the feedback control coefficient is in the set range, that is, when 1.02>FAFAV>0.98, the routine proceeds to step 1202, where the update value tFG of the vapor concentration FGPG per unit purge rate is made zero, then the routine proceeds to step 1203. Therefore, at this time, t[]he vapor concentration FGPG is not updated.

On the other hand, when it is judged at step 1200 that the average value FAFAV of the feedback control coefficient is outside of the set range, that is, when FAFAV≧1.02 or FAFAV≦0.98, the routine proceeds to step 1201, where the update value tFG of the vapor concentration IFGPG is calculated based on the following equation:

$$tFG=(1.0-FAPAV)/PGR\cdot a$$

Here, a is 2. That is, if the average value FAFAV of the feedback control coefficient is outside of the set range (between 0.98 and 1.02), half of the deviation of the FAFAV with respect to 1.0 is made the update value tFG. Next, the routine proceeds to step 1203. At step 1203, the count CPGR of the purge execution time is incremented by 1. As explained above, the count CPGR of the purge execution time shows the cumulative time during which the purge operation was performed after the startup of the engine. Next, at step 1204, it is judged if the count CPGR of the purge execution time is larger than a predetermined set value KCPGR3 or not. This set value KCPGR3 corresponds to about 3 minutes. Therefore, at step 1204, it is judged if the purge execution time is over about 3 minutes or not.

When CPGR<KCPGR3, that is, when the purge execution time is within about 3 minutes, the routine proceeds to step 1205, where the hysteresis flag XtFG is reset. Next, at step 1210, the update value tFG is added to the vapor concentration FGPG, then at step 1211, the vapor concentration FGPG is made the reference vapor concentration FGPGU. Next, the routine proceeds to the routine for calculation of the fuel injection time shown in FIG. 17.

On the other hand, when it is judged at step 1204 that CPGR≧KCPGR3, that is, when the purge execution time is over about 3 minutes, the routine proceeds to step 1206, where it is judged if the purge rate PGR is larger than the predetermined value KPGR2 (=2%) or not. When PGR≧KPGR2, the routine proceeds to step 1205. As opposed to this, when PGR<KPGR2, the routine proceeds to step 1207, where it is judged if the purge rate PGR is larger than the predetermined value KPGR1.5 (−1.5%) or not. When PGR≧KPGR1.5, the routine proceeds to step 1208, where it is judged if the hysteresis flag XtFC is reset or not. When the purge rate PGR falls from more than 2 percent to less than 2 percent, the hysteresis flag XtFG is reset (XtFG=0), so the routine proceeds to step 1205.

On the other hand, when it is judged at step 1207 that PGR<KPGR1.5, the routine proceeds to step 1209, where the hysteresis flag XtFG is set (XtFG<−1), then the routine proceeds to the processing for guarding the update value of step 1212. Next, when it is judged at step 1207 that PGR≧KPGR1.5, the routine proceedsd to step 1208, but at this time the hysteresis flag XtFG is set, so the routine passes through step 1208 to step 1212. That is, from step 1205 to step 1209, processing is performed to give hysteresis to the purge rate PGR for executing the processing for guarding the update value. The processing for guarding the update value at step 1212 is shown in FIG. 64.

Referring to FIG. 64, first, at step 1220, the allowable limit KtFG is calculated based on the purge rate PGR from the relationship shownin FIG. 61. Next, at step 1221, it is judged if the vapor concentration FGPG is larger than the allowable upper limit (FGPGU+KtFG) or not. When FGPG≧(KGPGU+KtFG), the processing cycle is ended. At this time, the update action of the vapor concentration FGPG is stopped. As opposed to this, when FGPG<FGPGU+KtFG, the routine proceeds to step 1222. At step 1222, it is judged if the vapor concentration FGPG is smaller than the allowable lower limit (FGPGU−KtFG) or not. When FGPG≦(FGPGU−KtFG), the processing cycle is ended. At this time, the update action of the vapor concentration FGPG is stopped. As opposed to this, when FGPG>FGPGU−KtFG, the routine proceeds to step 1223.

At step 1223, it is judged if the value of the vapor concentration FGPG plus the update value tFG (FGPG+tFG) is larger than the reference vapor concentration FGPGU or not. When FGPG+tFG≧FGPGU, the routine proceeds to step 1224, where it is judged if FGPG+tFG is larger than the allowable upper limit (FGPGU+KtFG) or not. When FGPG+tFG<FGPGU+KtFG, the routine proceeds to step 1225, where the update value tFG is added to the vapor concentration FGPG. As opposed to this, when FGPG+tFG≧FGPGU+KtFG, the routine proceeds to step 1226, where the allowable upper limit (FGPGU+KtFG) is made the vapor concentration FGPG.

On the other hand, when it is judged at step 1223 that PGPC+tFG <FGPGU, the routine proceeds to step 1227, where it is judged if FGPG+tFG is smaller than the allowable lower limit (FGPGU−KtFG) or not. When FGPG+TFG>FGPGU−KtFG, the routine proceeds to step 1228, where the update value tFG is added to the vapor concentration FGPG. As opposed to this, when FGPG+tTG≦FGPGU−KtFG, the routine proceeds to step 1229, where the allowable lower limit (FGPGU−KtFG) is made the vapor concentration FGPG.

While the invention has been described by reference to specific embodiments chosen for purposes of illustration, it should be apparent that numerous modifications could be made thereto by those skilled in the art without departing from the basic concept and scope of the invention.

I claim:

1. An evaporated fuel treatment device for an engine provided with an intake passage, comprising:

a purge control valve for controlling an amount of purge of fuel vapor to be purged into the intake passage so that the purge rate of the fuel vapor becomes a predetermined target purge rate;

air-fuel ratio detecting means for detecting the air-fuel ratio; and correcting means for correcting an amount of fuel injection by a feedback control coefficient and a purged air-fuel ratio correction coefficient, said feedback correction coefficient increasing or decreasing with respect to a reference value based on an air-fuel ratio detected by the air-fuel ratio detecting means so that the air-fuel ratio becomes a target air-fuel ratio, said purged air-fuel ratio correction coefficient increasing or decreasing so that an average value of fluctuation of the feedback correction coefficient returns to a predetermined set range including the reference value when the average value of fluctuation of the feedback correction coefficient exceeds the set range, and said set range being changed based on either one of a change of concentration of fuel vapor in intake air and a purge rate of the vapor of the fuel.

2. An evaporated fuel treatment device as set forth in claim 1, wherein said set range is comprised of a first set range extending centered from said reference value and a second set range broader than said first set range, said purged air-fuel ratio correction coefficient increases or decreases so that the average value of fluctuation of the feedback correction coefficient returns to within the first set range when the average value of fluctuation of the feedback correction coefficient exceeds the first set range, judgement means is provided for judging if the operating state of the engine is one in which a concentration of fuel vapor in the intake air changes by more than a predetermined concentration in accordance with a change of an amount of purge, the average value of fluctuation of the feedback correction coefficient is controlled to return to within said first set range by the purged air-fuel ratio correction coefficient when the engine operating state is one in which the concentration of fuel vapor does not change more than a predetermined concentration in accordance with a change of the amount of purge, and the purged air-fuel ratio correction coefficient being increased or decreased so that the average value of fluctuation of the feedback correction coefficient returns to near an upper limit or lower limit of said second set range when the average value of fluctuation of the feedback correction coefficient exceeds the upper limit or lower limit of said second set range when the engine operating state is one in which the concentration of fuel vapor changes more than a predetermined concentration in accordance with a change of the amount of purge.

3. An evaporated fuel treatment device as set forth in claim 2, wherein when the average value of fluctuation of the feedback correction coefficient exceeds the second set range, purged air-fuel ratio correction coefficient is increased or decreased so that the average value of fluctuation of the feedback correction coefficient returns toward the second set range by exactly the amount by which it exceeds the second set range.

4. An evaporated fuel treatment device as set forth in claim 2, wherein the upper limit and lower limit of the first set range are made constant values and the upper limit or lower limit of the second set range changes in accordance with any one of an amount of purge of the fuel vapor and a representative value representing the amount of purge of the fuel vapor.

5. An evaporated fuel treatment device as set forth in claim 4, wherein said representative value is at least one from among an amount of intake air, an amount of opening of the purge control valve, a vacuum generated in the intake passage, an amount of fuel injection, and a degree of opening of a throttle valve arranged in the intake passage.

6. An evaporated fuel treatment device as set forth in claim 4, wherein the upper limit of the second set range becomes larger relative to the upper limit of the first set range the greater either of the amount of is purge of the fuel vapor or the representative value become.

7. An evaporated fuel treatment device as set forth in claim 4, wherein the upper limit of the second set range matches with the upper limit of the first set range when either of the amount of purge of the fuel vapor and the representative value is smaller than a predetermined value and becomes larger than the upper limit of the first set range when either of the amount of purge of the fuel vapor and the representative value is larger than the predetermined value.

8. An evaporated fuel treatment device as set forth in claim 4, wherein the lower limit of the second set range becomes smaller relative to the lower limit of the first set range the greater either of the amount of purge of the fuel vapor and the representative value becomes.

9. An evaporated fuel treatment device as set forth in claim 1, wherein the lower limit of the second set range matches with the lower limit of the first set range when either of the amount of purge of the fuel vapor and the representative value is smaller than a predetermined value and becomes smaller than the lower limit of the first set range when either of the amount of purge of the fuel vapor and the representative value is larger than the predetermined value.

10. An evaporated fuel treatment device as set forth in claim 2, wherein when the engine operating state is one in which the concentration of fuel vapor changes by more than a predetermined concentration in accordance with a change in the amount of purge, the upper limit of the second set range is gradually made larger and the lower limit of the second set range is gradually made smaller as the concentration of fuel vapor in the intake air becomes lower.

11. An evaporated fuel treatment device as set forth in claim 10, wherein when the engine operating state is other than an idling operating state, the upper limit of the second set range is gradually made larger and the lower limit of the second set range is gradually made smaller as the concentration of fuel vapor in the intake air becomes lower.

12. An evaporated fuel treatment device as set forth in claim 2, wherein said judgement means judges that the engine operating state is one in which the concentration of fuel vapor changes by more than a predetermined concentration in accordance with a change in the amount of purge when a time of execution of a purge action after the start of engine operation exceeds a predetermined time.

13. An evaporated fuel treatment device as set forth in claim 12, wherein said predetermined time is made shorter the higher an atmospheric temperature.

14. An evaporated fuel treatment device as set forth in claim 2, wherein updating means is provided for performing an updating action on the purged air-fuel ratio correction coefficient so as to maintain the average value of fluctuation of the feedback correction coefficient within the first set range and said judgement means judges that the engine operating state is one in which the concentration of fuel vapor changes by more than a predetermined concentration in accordance with a change in the amount of purge when a number of updates of the purged air-fuel ratio correction coefficient exceeds a predetermined number.

15. An evaporated fuel treatment device as set forth in claim 2, wherein said judgement means judges that the engine operating state is one in which the concentration of fuel vapor changes by more than a predetermined concentration in accordance with a change in the amount of purge when the average value of fluctuation of the feedback correction coefficient exceeds a predetermined range centered on said reference value.

16. An evaporated fuel treatment device as set forth in claim 2, wherein detecting means is provided for detecting a representative value of a pressure in the fuel tank and said judgement means judges that the engine operating state is one in which the concentration of fuel vapor changes by more than a predetermined concentration in accordance with a change in the amount of purge when the representative value of the pressure in the fuel tank exceeds a predetermined value.

17. An evaporated fuel treatment device as set forth in claim 1, wherein judgement means is provided for judging if the engine operating state is one in which the concentration of fuel vapor in the intake air changes by more than a predetermined concentration in accordance with a change in the amount of purge, when the engine operating state is one in which the concentration of fuel vapor changes by more than a predetermined concentration in accordance with a change in the amount of purge and when the average value of fluctuation of the feedback correction coefficient exceeds an upper limit or lower limit of the set range, the purged air-fuel ratio correction coefficient being increased or decreased so that the average value of fluctuation of the feedback correction coefficient returns to near the upper limit or lower limit of the set range, when the engine operating state is one in which the concentration of fuel vapor changes by more than a predetermined concentration in accordance with a change in the &mount of purge and when the engine load becomes higher than a predetermined set load, the feedback correction coefficient is made a first set value larger than the lower limit of the set range once, then is increased based on the air-fuel ratio detected by the air-fuel ratio detecting means, and when the engine operating state is one in which the concentration of fuel vapor changes by more than a predetermined concentration in accordance with a change in the amount of purge and when the engine load becomes lower than a predetermined set load, the feedback correction coefficient is made a second set value smaller than the upper limit of the set range once, then is decreased based on the air-fuel ratio detected by the air-fuel ratio detecting means.

18. An evaporated fuel treatment device as set forth in claim 17, wherein said first set value is one of said reference value, the upper limit of said set range, and a value between said reference value and the upper limit of the set range.

19. An evaporated fuel treatment device as set forth in claim 17, wherein said second set value is one of said reference value, the lower limit of said set range, and a value between said reference value and the lower limit of the set range.

20. An evaporated fuel treatment device as set forth in claim 17, wherein when the average value of fluctuation of the feedback correction coefficient exceeds said set range, the purged air-fuel ratio correction coefficient is increased or decreased so that the average value of fluctuation of the feedback correction coefficient returns toward the set range by exactly the amount it exceeded said set range.

21. An evaporated fuel treatment device as set forth in claim 17, wherein the upper limit of said set range becomes larger the greater the amount of intake air and the lower limit of said set range becomes smaller the smaller the amount of intake air.

22. An evaporated fuel treatment device as set forth in claim 17, wherein said judgement means judges the engine operating state is one in which the concentration of fuel vapor changes by more than a predetermined concentration in accordance with a change in the amount of purge when the time of execution of the purge action alter the engine starts operating exceeds a predetermined time and the average value of fluctuation of the feedback correction coefficient exceeds a predetermined range centered on said reference value.

23. An evaporated fuel treatment device as set forth in claim 1, wherein said set range is comprised of a first set range extending centered from said reference value and a second set range broader than said first set range, said purged air-fuel ratio correction coefficient increases or decreases so that the average value of fluctuation of the feedback correction coefficient returns to within the first set range when the average value of fluctuation of the feedback correction coefficient exceeds the first set range, when the engine operating state is one in which the concentration of fuel vapor does not change by more than a predetermined concentration in accordance with a change in the amount of purge, the average value of fluctuation of the feedback correction coefficient being controlled to return to within the first set range by the purged air-fuel ratio correction coefficient, when the engine operating state is one in which the concentration of fuel vapor changes by more than a predetermined concentration in accordance with a change in the amount of purge and when the average value of fluctuation of the feedback correction coefficient exceeds an upper limit or lower limit of the second set range, the purged air-fuel ratio correction coefficient being increased or decreased so that the average value of fluctuation of the feedback correction coefficient returns to near the upper limit or lower limit of the second set range, when the engine operating state is one is which the concentration of fuel vapor changes by more than a predetermined concentration in accordance with a change in the amount of purge and when the engine load becomes higher than a predetermined set load, the feedback correction coefficient is made a first set value larger than the lower limit of the second set range once, then is increased based on the air-fuel ratio detected by the air-fuel ratio detecting means, and when the engine operating state is one in which the concentration of fuel vapor changes by more than a predetermined concentration in accordance with a change in the atmount of purge and when the engine load becomes lower than a predetermined set load, the feedback correction coefficient is made a second set value smaller than the upper limit of the second set range once, then is decreased based on the air-fuel ratio detected by the air-fuel ratio detecting means.

24. An evaporated fuel treatment device as set forth in claim 1, wherein a predetermined ratio of the amount of deviation of the air-fuel ratio from the target air-fuel ratio is made an update value of the purged air-fuel ratio correction coefficient and the predetermined ratio is made smaller when the purge rate of the fuel vapor is small than when the purge rate of the fuel vapor is large.

25. An evaporated fuel treatment device as set forth in claim 24, wherein the amount of deviation from the target air-fuel ratio is found from the amount of deviation of the average value of fluctuation of the feedback correction coefficient from the set range.

26. An evaporated fuel treatment device as set forth in claim 25, wherein the upper limit of the set range is made larger the smaller the purge rate, the lower limit of said set range is made smaller the smaller the purge rate, and the amount of deviation of the feedback correction coefficient from the upper limit or lower limit of the set range is reflected back into the update value of the purged air-fuel ratio correction coefficient.

27. An evaporated fuel treatment device as set forth in claim 26, wherein the lower limit of the set range is changed in accordance with the time from when the purge action started and the lower limit of the set value in the interval when that time is short is made larger than the lower limit of the set range when that time is long.

28. An evaporated fuel treatment device as set forth in claim 24, wherein when the purge rate is less than a predetermined purge rate, the update value of the purged air-fuel ratio correction coefficient is made zero.

29. An evaporated fuel treatment device as set forth in claim 1, wherein when the purge rate is less than a predetermined purge rate, the update value of the purged air-fuel ratio correction coefficient is limited.

* * * * *

UNITED STATES PATENT AND TRADEMARK OFFICE

CERTIFICATE OF CORRECTION

PATENT NO. : 5,988,150
DATED : November 23, 1999
INVENTOR(S) : Akinori OSANAI

It is certified that error appears in the above-identified patent and that said Letters Patent is hereby corrected as shown below:

On the cover page, change

"[22] Filed: Oct. 3, 1997
[30] Foreign Application Priority Data

| | | | |
|---|---|---|---|
| Dec. 5, 1996 | [JP] | Japan | 8-325426 |
| Feb. 7, 1997 | [JP] | Japan | 9-925389 |
| Feb. 14, 1997 | [JP] | Japan | 9-930386 |
| Nov. 10, 1997 | [JP] | Japan | 9-307614" |

to

-- [22] Filed: Dec. 3, 1997
[30] Foreign Application Priority Data

| | | | |
|---|---|---|---|
| Dec. 5, 1996 | [JP] | Japan | 8-325426 |
| Feb. 7, 1997 | [JP] | Japan | 9-25389 |
| Feb. 14, 1997 | [JP] | Japan | 9-30386 |
| Nov. 10, 1997 | [JP] | Japan | 9-307614 -- |

Signed and Sealed this

First Day of August, 2000

*Attest:*

Q. TODD DICKINSON

*Attesting Officer*

*Director of Patents and Trademarks*